US011598056B2

(12) United States Patent
Mullaney et al.

(10) Patent No.: US 11,598,056 B2
(45) **Date of Patent: *Mar. 7, 2023**

(54) MODULE FOR A STRUCTURE

(71) Applicant: InQuik IP Holdings Pty Ltd, Penrith (AU)

(72) Inventors: Nicholas Bruce Mullaney, Marulan (AU); James Richard Howell, Clarence Town (AU)

(73) Assignee: InQuik IP Holdings Pty Ltd, Penrith (AU)

( * ) Notice: Subject to any disclaimer, the term of this patent is extended or adjusted under 35 U.S.C. 154(b) by 52 days.

This patent is subject to a terminal disclaimer.

(21) Appl. No.: 17/346,397

(22) Filed: Jun. 14, 2021

(65) Prior Publication Data

US 2022/0002954 A1 Jan. 6, 2022

Related U.S. Application Data

(63) Continuation of application No. 16/806,393, filed on Mar. 2, 2020, now Pat. No. 11,053,647, which is a (Continued)

(30) Foreign Application Priority Data

May 21, 2015 (AU) ..... 2015901870

(51) Int. Cl.
*E01D 19/12* (2006.01)
*E02D 27/01* (2006.01)
(Continued)

(52) U.S. Cl.
CPC ..... *E01D 19/125* (2013.01); *E01D 2/04* (2013.01); *E01D 21/00* (2013.01); *E02D 27/01* (2013.01);
(Continued)

(58) Field of Classification Search
CPC ..... E01D 2/04; E01D 19/125; E01D 21/00; E01D 2101/26; E02D 27/01;
(Continued)

(56) References Cited

U.S. PATENT DOCUMENTS 1,863,258 A 6/1932 Tashjian
2,017,832 A 10/1935 Hovey
(Continued)

FOREIGN PATENT DOCUMENTS

CN 2385028 6/2000
CN 101481935 7/2009
(Continued)

OTHER PUBLICATIONS

International Search Report for Application No. PCT/AU2016/050390 dated Aug. 5, 2016 (3 pages).
International Preliminary Report on Patentability for Application No. PCT/AU2016/050390 dated Sep. 18, 2017 (153 pages).
(Continued)

*Primary Examiner* — Abigail A Risic
(74) *Attorney, Agent, or Firm* — Michael Best & Friedrich LLP

(57) ABSTRACT

A construction module for a structure, comprising: a formwork member that includes a base, a pair of parallel side walls that extend upwardly from the base, and a pair of parallel end walls. The base, the side walls and the end walls define a cavity for reinforcement and concrete. A reinforcement member includes an upper portion and a lower portion. When the reinforcement member is located in the cavity and concrete fills the cavity, the lower portion of the reinforcement member and the concrete define an elongate beam.

16 Claims, 44 Drawing Sheets

Related U.S. Application Data continuation of application No. 16/394,267, filed on Apr. 25, 2019, now Pat. No. 10,619,315, which is a continuation of application No. 15/576,064, filed as application No. PCT/AU2016/050390 on May 20, 2016, now Pat. No. 10,323,368.

(51) Int. Cl.

| | |
|---|---|
| ***E04B 5/40*** | (2006.01) |
| ***E04C 5/06*** | (2006.01) |
| ***E04G 11/46*** | (2006.01) |
| ***E01D 2/04*** | (2006.01) |
| ***E01D 21/00*** | (2006.01) |
| ***E04C 5/065*** | (2006.01) |
| *E01D 101/26* | (2006.01) |

(52) U.S. Cl.

CPC ..... *E02D 27/013* (2013.01); *E02D 27/016* (2013.01); *E04B 5/40* (2013.01); *E04C 5/0604* (2013.01); *E04C 5/065* (2013.01); *E04C 5/0609* (2013.01); *E04C 5/0636* (2013.01); *E04C 5/0645* (2013.01); *E04G 11/46* (2013.01); *E01D 2101/26* (2013.01)

(58) Field of Classification Search

CPC ..... E02D 27/013; E02D 27/016; E04C 5/0604; E04C 5/0609; E04C 5/0636; E04C 5/0645; E04C 5/065; E04G 11/46; E04B 5/70

See application file for complete search history.

(56) References Cited

U.S. PATENT DOCUMENTS

| | | | |
|---|---|---|---|
| 2,233,291 | A | 2/1941 | Leebov |
| 4,991,248 | A | 2/1991 | Allen |
| 5,653,077 | A | 8/1997 | Carnicello |
| 5,987,680 | A | 11/1999 | Sakaya |
| 6,170,105 | B1 | 1/2001 | Doyle et al. |
| 6,578,343 | B1 | 6/2003 | Dumler et al. |
| 2003/0093961 | A1 | 5/2003 | Grossman |
| 2006/0144000 | A1 | 7/2006 | Patrick |
| 2007/0000077 | A1 | 1/2007 | Wilson |
| 2008/0000177 | A1 | 1/2008 | Siu |
| 2009/0100776 | A1 | 4/2009 | Seccombe |
| 2017/0241139 | A1 | 8/2017 | Moyano |
| 2018/0030745 | A1 | 2/2018 | Dinmore |

FOREIGN PATENT DOCUMENTS

| | | |
|---|---|---|
| CN | 201671215 | 12/2010 |
| CN | 104032869 | 9/2014 |
| DE | 2546769 | 4/1977 |
| EP | 0818287 | 1/1998 |
| EP | 2549028 | 1/2013 |
| FR | 2903437 | 1/2008 |
| NL | 2007556 | 4/2013 |
| NL | 2011430 | 3/2015 |
| WO | 2009087321 | 7/2009 |

OTHER PUBLICATIONS

European Patent Office Search Report for Application No. 16795563.2 dated Apr. 18, 2018, 8 pages.

Chinese Patent Office Action for Related Application No. 201680041118.6 dated Aug. 12, 2019 (19 pages including English translation).

MODULE FOR A STRUCTURE

RELATED APPLICATIONS

This application is a continuation of U.S. Ser. No. 16/806,393, which is a continuation of U.S. Ser. No. 16/394,267, which is a continuation of U.S. Ser. No. 15/576,064, which is the national phase of PCT/AU2016/050390, which claims priority to AU 2015901870. The foregoing applications are incorporated herein by reference.

TECHNICAL FIELD

This invention relates to modules for building a structure such as bridges and single or multi-storey buildings, and a method of building a structure from a plurality of modules and a structure comprising a plurality of modules.

BACKGROUND

A problem with existing construction methods for precast concrete bridges and other structures is that pre-cast concrete components are heavy, difficult to transport and can be damaged easily in transit.

Conventional in-situ construction methods are time consuming, expensive and require high levels of expert supervision.

There is a need to design improved bridges and other structures and methods for economical and efficient construction thereof.

SUMMARY OF THE INVENTION

In broad terms, the invention provides a module for a structure, comprising: a formwork member defining a cavity; and a reinforcement member that includes an upper portion and a lower portion, wherein when the reinforcement member is located in the cavity and concrete fills the cavity, the lower portion of the reinforcement member and the concrete define an elongate beam.

In more specific terms, in accordance with the present invention, there is provided a module for a structure, comprising: a formwork member that includes a base, a pair of parallel side walls that extend upwardly from the base, and a pair of parallel end walls, with the base, the side walls and the end walls defining a cavity for reinforcement and concrete; and a reinforcement member that includes an upper portion that is formed to extend across the width and along the length of an upper section of the cavity and a lower portion that is formed to extend at least substantially along the length of a lower section of the cavity, wherein when the reinforcement member is located in the cavity and concrete fills the cavity, the lower portion of the reinforcement member and the concrete define an elongate beam.

The module may form part of a larger structure. The structure may be a bridge in which the module forms a span of the bridge. The structure may be a single or a multi-storey building, in which the module forms at least part of a floor or a foundation of the building. A plurality of modules may be used to form a plurality of structural levels arranged and supported to form a multi-storey building.

The module of the invention, when used in modular bridge construction, reduces, if not resolves, some of the limitations encountered currently in bridge construction. The modular bridge construction of the invention further provides a fast and easy-to-install bridge or alternative structure.

The applications of the modules of the invention assist in constructing new or replacing old bridges, by providing a pre-engineered product equally suitable for use in both highly regulated markets and emerging markets. The modules further provide a sturdy foundation for emergency housing.

The invention additionally relates to a pre-formed bridge reinforcement panel where the reinforcement steel is constructed in such a way as to structurally support the formwork or mould that the form is to take. A settable material is introduced around the reinforcement, and once set, cures to form a robust reinforced structure.

Further uses of this modular construction of the invention are in building structures where slabs and beams are combined to form single structures and, accordingly, the modules can be assembled in such a way as to create an overall reinforced building structure.

The modules can further be coupled with additional elements which can be used individually or combined to provide a bridge superstructure, headstocks, piers, rail systems, overpasses, fly overs and other complimentary components.

The system can be assembled from individual parts (without the concrete, which is introduced to the formwork member only after the formwork panels are installed).

The reinforcement member is a modular design.

The reinforcement member comprises two primary elements: an upper portion and a lower portion. The lower portion can be further split into longitudinal members and parallel members which support the upper portion or deck. These components of the reinforcement member can be preassembled and easily mass-produced in volume.

A bridge can be constructed in accordance with the invention by positioning one or a plurality of the bridge modules side by side along the length of the bridge. More particularly the side walls of the modules may be arranged side by side and be formed to interconnect or interlock, such that there is no break between subsequent modules when arranged side-by-side. This allows the concrete or alternative settable material, to flow freely across subsequent modules. This creates a homogeneous structure which offers improved resistance to the inertia forces caused by vehicles traversing the structure.

A further benefit of the invention is an ability for subsequent modules to receive a supporting member or additional structural members across subsequent modules, for example, overlapping bars or the like, that can slide into position, extending between adjacent modules, and lock into position.

The modules described above can also be used for suspended floors in buildings.

The lower portion of the reinforcement member and the concrete may define a plurality of elongate beams spanning the length of the module separated by lands. The plurality of elongate beams may be configured in any one of the following arrangements: parallel and spaced apart; diagonally extending across the base; extending across the base in a Z-shaped form; and extending across the base in a V-shaped form.

The lower portion of the reinforcement member may further include an end portion, such that when the reinforcement member is located in the cavity and concrete fills the cavity, the lower portion of the reinforcement member and the concrete define a cross-beam oriented perpendicularly of the elongate beam. The lower portion of the reinforcement member may extend around a periphery of the cavity of the formwork member.

A section of the base of the formwork may project upwardly from the base and defines a land portion within the cavity that separates the lower section of the cavity into at least first and second elongate parallel cavities.

The reinforcement may be made from mesh that includes a plurality of parallel line wires and a plurality of parallel cross-wires connected together. The plurality of parallel line wires and the plurality of parallel cross-wires of the reinforcement member may be welded together.

The lower portion of the reinforcement member may comprise a plurality of trusses. Each truss may include a pair of parallel line wires being interconnected by a cross-wire. The cross-wire may extend diagonally back and forth between the pair of parallel line wires. The cross-wire may be welded to the pair of parallel line wires.

Each truss may include a spacer and a plurality of parallel line wires held in spaced apart configuration by the spacer. The spacer may be a pressed plate. The spacer may be substantially planar. The spacer may comprise a plurality of connectors oriented to cradle the plurality of line wires and cross-wires and retain the wires in a predetermined relationship to one another. Each truss may further comprise a brace member. The brace member may be retained in engagement with the truss by tension. At least one brace may be integrally formed with the spacer.

The upper portion of the reinforcement member may comprise a plurality of layers of mesh.

The lower portion of the reinforcement member and the upper portion of the reinforcement member may be integrally formed.

At least one of the upper portion of the reinforcement member and the lower portion of the reinforcement member may project upwardly from the module and extends above the cavity.

The reinforcement member may be configured to conform to the cavity of the formwork member.

At least one of the formwork member and the reinforcement member may be tensionable such that the module is pre-tensioned.

The formwork member may further comprise engagement members to interconnect with a subsequent module or alternative supporting structure.

The reinforcement member may be structurally integrated with the formwork member by the concrete to form the module.

The reinforcement member may be fully immersed within the concrete of the finished module.

The reinforcement member may be partially immersed within the concrete of the finished module. The reinforcement member may partially extend from the concrete of the finished module, to provide an engagement portion. The engagement portion may be used to engage the module with building components, bridge components, support members and further modules. The reinforcement member is fully covered by the concrete within the cavity.

The reinforcement provides a structural skeleton integrated within the concrete of the module.

The lower portion and the upper portion are configured to form a unitary reinforcement member.

In accordance with another aspect of the invention, there is provided an assembly of a formwork member defining a cavity for reinforcement and concrete, and a reinforcement member that includes an upper portion that is formed to extend across the width and along the length of an upper section of the cavity and at least one lower portion that is formed to extend at least substantially along the length of a lower section of the cavity.

In accordance with the present invention there is further provided a reinforced modular bridge, comprising a plurality of modules, with each module comprising a formwork member and a reinforcement member located in a cavity defined by the formwork member, with each module engaged with a subsequent module in side by side overlapping arrangement, such that each module spans a portion of a width of the bridge, and a material such as concrete in the cavities and covering the reinforcement members.

The concrete reinforced bridge can be constructed using the modules as described above. A formwork panel can be made to predetermined dimensions and a cooperating reinforcement member to be received therein. The reinforcement can further be configured to extend above the formwork panel, such that the protruding reinforcement provides a side rail, a hand rail truss, a safety barrier or a culvert side-form to the finished bridge.

In accordance with the present invention there is still further provided a method of constructing a concrete reinforced bridge using a plurality of bridge modules, the method comprising the steps of:

(i) supporting a formwork member of a first bridge module in a predetermined location;

(ii) positioning a reinforcement member within a cavity of the formwork member either before or after step (i); and (iii) introducing a concrete mix into the cavity to at least partially cover the reinforcement member.

The method may further comprise an additional step of placing a subsequent formwork member in interlocking engagement with the first bridge module. The method may repeat steps (i) and (ii) and position a plurality of formwork members of successive bridge modules in interlocking engagement and positioning reinforcement members within the cavity of the formwork members either before or after step (i), and repeating step (iii) of introducing a concrete mix into each of the cavities of the formwork members.

Further still, one aspect of the invention provides a module for a structure, the module, comprising: a formwork member defining a cavity; and a reinforcement member that includes an upper portion and a lower portion, wherein when the reinforcement member is located in the cavity and concrete fills the cavity, the lower portion of the reinforcement member and the concrete define an elongate beam.

In accordance with another aspect of the invention, there is provided a module for a structure comprising: a formwork tray comprising a plurality of discrete sections configured to form a base and a pair of side walls that extend upwardly from the base and thereby define a cavity for reinforcement and concrete, the formwork tray including an upper portion and a lower portion; and a reinforcement member that includes an upper portion that is formed to extend across a width and along a length of the upper portion of the formwork tray, and a lower portion that is formed to extend at least substantially along the length of the lower portion of the formwork tray such that the upper and lower portions of the reinforcement member each span the plurality of discrete sections of the formwork tray, wherein the reinforcement member is located in the cavity, and concrete fills the cavity at least partially covering the reinforcement member, such that a portion of the reinforcement member of the module and the concrete defines at least one elongate beam.

In accordance with another aspect of the invention, there is provided a module for a structure, comprising: a formwork member that includes a base and a pair of side walls that extend upwardly from the base, with the base and the side walls defining a cavity for reinforcement and concrete, the cavity having an upper cavity portion and a lower cavity portion; and a plurality of reinforcement plates that partition a length of the formwork tray, spaced at discrete intervals therealong such that the reinforcement plates extend substantially across a cross-section of the lower cavity portion, wherein each of the plurality of reinforcement plates is configured to support a plurality of longitudinal reinforcing members thereon, wherein when the reinforcement plates are located in the cavity having the longitudinal reinforcing members supported thereon and concrete fills the cavity, the reinforcement plates and the concrete define an elongate beam.

The terms "line wire" and "cross-wire" are understood herein to include elements that are formed from any one or more wires, rods, and bars. The elements may be single wires, bars or rods. The elements may be formed from two or more wires, rods, or bars joined to each other.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

DETAILED DESCRIPTION OF EMBODIMENTS

The invention will now be described more fully hereinafter with reference to the accompanying drawings, in which various embodiments, although not the only possible embodiments, of the invention are shown. The invention may be embodied in many different forms and should not be construed as being limited to the embodiments described below.

While the invention is described hereafter in relation to constructing a bridge, the invention is applicable to other structures, including but not limited to other forms of infrastructure for example; footpaths, roads, road sound panels, short and long span bridges, bridge decks and road, rail tunnels, buildings and high-rise blocks.

Figure 1:
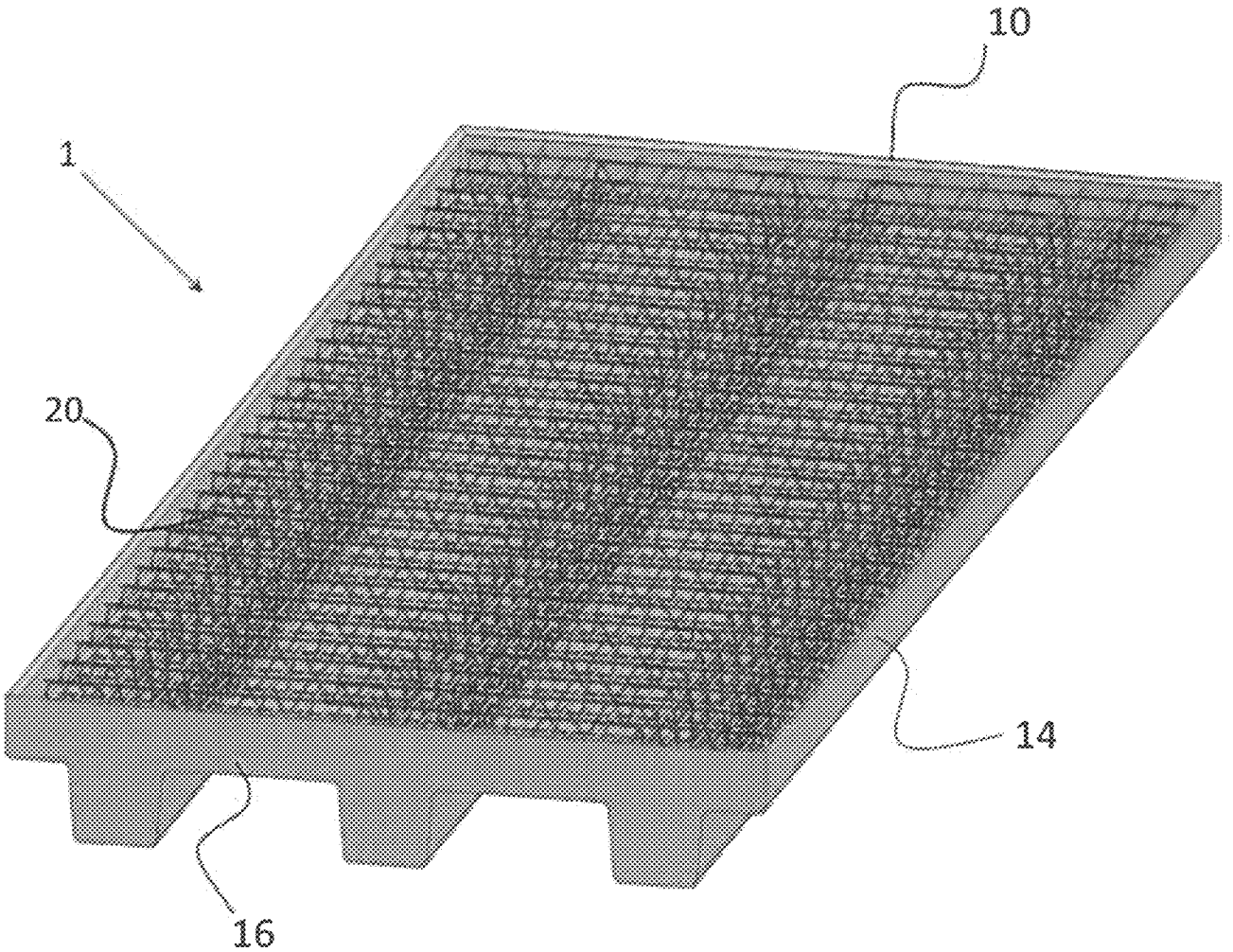
FIG. 1 is a perspective view of a bridge module according to one embodiment of the invention.
Figure 3:
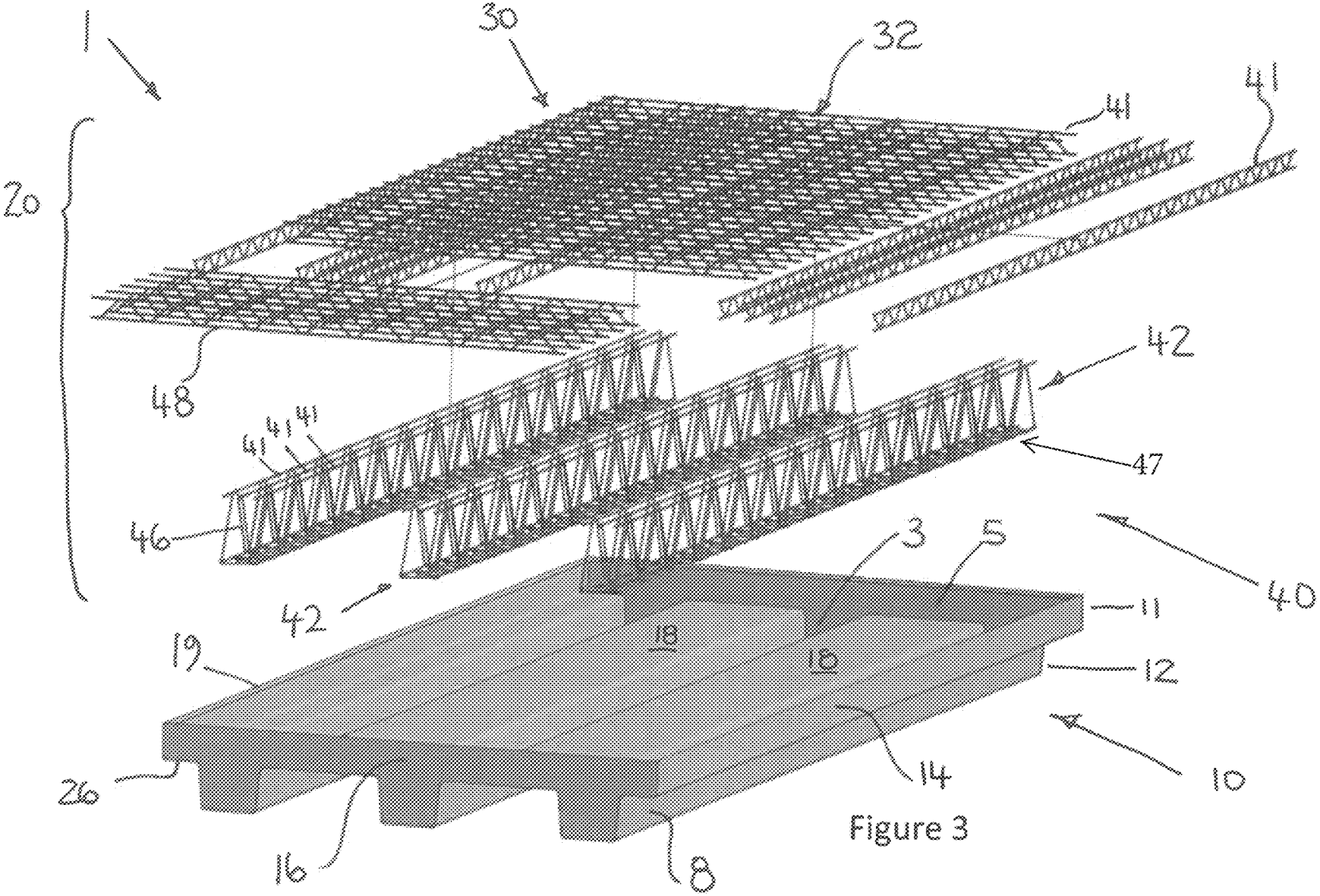
FIG. 3 is an exploded perspective view of the bridge module of FIG. 1.

With particular reference to FIGS. 1 and 3, an embodiment of a module 1 for forming a bridge (in this embodiment), comprises (a) a formwork member 10 that includes a base 12, a pair of parallel side walls 14 that extend upwardly from the base 12, and a pair of parallel end walls 16, with the base 12, the side walls 14 and the end walls 16 defining a cavity 3 for reinforcement and concrete, and (b) a reinforcement member 20 that includes an upper portion 30 that is formed to extend across the width and along the length of an upper section 5 of the cavity 3 and at least one lower portion 40 that is formed to extend at least substantially along the length of a lower section of the cavity 3, whereby when the reinforcement member 20 is located in the cavity 3 and concrete fills the cavity 3, the lower portion 40 of the reinforcement member 20 and the concrete define an elongate beam, as illustrated in FIG. 1.

As the concrete surrounds the reinforcement member 20 from all sides, the formwork 10, the reinforcement 20 and the concrete become integrated into the finished module 1. The load applied to the module 1 is thus reacted by both the formwork 10 and the reinforcement 20 when the concrete has cured, essentially forming a steel reinforced concrete, or composite, structure.

Figure 2:
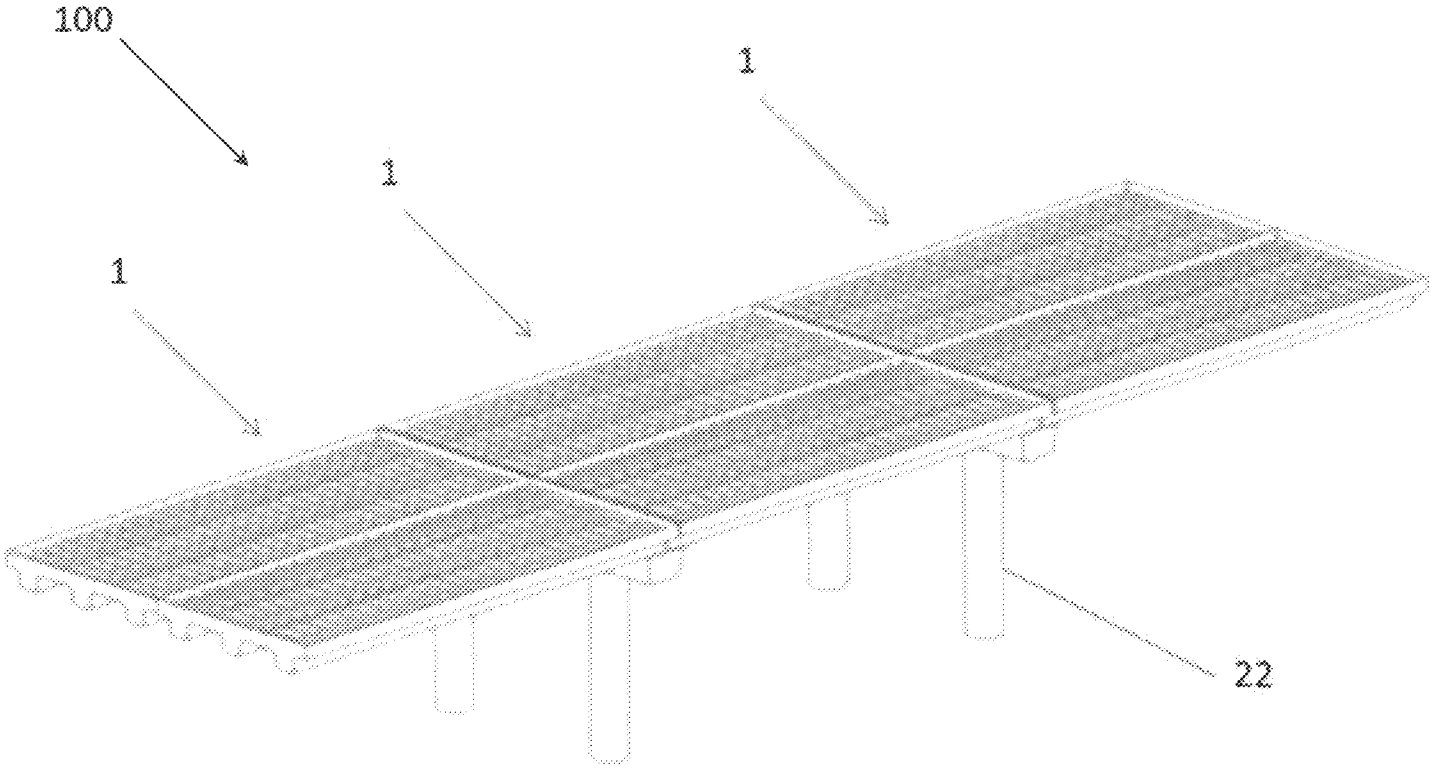
FIG. 2 is a perspective view of a bridge constructed from a plurality of bridge modules according to the module of FIG. 1.

With reference to FIG. 2, a plurality of modules 1 can be laid out in side-by-side arrangement and in end-to-end arrangement to form a bridge 100 of varying dimensions. The modules 1 are supported on a plurality of piers 22 positioned along the span of the bridge 100 upon which the load of the modules 1 is borne. One example of a bridge 100 constructed using the modules 1 of the invention is illustrated in FIG. 2. The bridge of FIG. 2 is constructed from 6 identical modules 1; however, the bridge 100 can be extended, both in span (length) and width, by the addition of further modules 1.

The piers 22 of bridge 100 can be constructed from concrete, steel, steel reinforced concrete or other structural materials. The number of piers 22 required for any given bridge 100 will depend on the width and span of the bridge 100.

FIG. 3 is a perspective view of the module 1 of FIGS. 1 and 2. For clarity, the elements of the module 1 are illustrated in an exploded view, all of which are configured to package within the formwork member 10. In its simplest form the module 1 comprises a formwork member 10 for receiving concrete and a reinforcement member 20 that becomes integrated with the formwork member 10 as concrete is poured and sets within the formwork member 10. The reinforcement member 20 is constructed from the upper reinforcement 30 and the lower reinforcement 40.

The Formwork Member

The formwork member 10 is made from a resilient, structural material and is capable of supporting the loads of both the module 1 and static and dynamic loads that will be applied to the module 1 in use. In one embodiment the formwork member 10 is fabricated from steel. When made from steel the formwork member 10 is made from a steel thickness ranging from 1.0 millimetres (mm) to 3.0 mm.

The dimensions of the formwork member can be 12 metres (m)×2.4 m×0.6 m. These dimensions can be varied to meet the requirements of a predetermined bridge 100.

The formwork member 10 comprises an upper portion 11 and a lower portion 12. The upper portion 11 has a larger cross-sectional area than that of the lower portion 12 and is configured to substantially enclose the upper portion of the reinforcement member 30.

The lower portion 12 of the formwork member 10 comprises three cavities 3 that are spaced across the width of the module 1 in parallel to each other. The cavities 3 are configured to house and conform to the lower reinforcement member 40 such that when concrete 7 is poured into the formwork member 10 around the lower portion 40 of the reinforcement 20, three elongate beams 8 are created running the length of the module 1.

In other embodiments of the invention there can be a single elongate beam 8 running along the span of the module 1. In some embodiments a plurality of elongate beams 8 are provided. The plurality of elongate beams 8 can be oriented in a myriad of configurations relative to one another: parallel; perpendicularly bisecting; diagonally bisecting; and combinations of the above. The dimensions of the bridge 100 and the loads to be supported will determine the optimised arrangement of the elongate beams 8 of the formwork member 10.

The side walls 14 and end walls 16, in combination, form a barrier 19 around the perimeter of the formwork member 10. The barrier 19 provides additional structural stiffness to the formwork member 10, and further constrains the concrete 7 while curing within the formwork member 10. The barrier 19 can be provided with apertures or voids (not illustrated) to allow concrete to flow between subsequent modules 1 such that a single concrete pour can be made across a bridge 100 and one piece of reinforced concrete formed.

Figure 19:
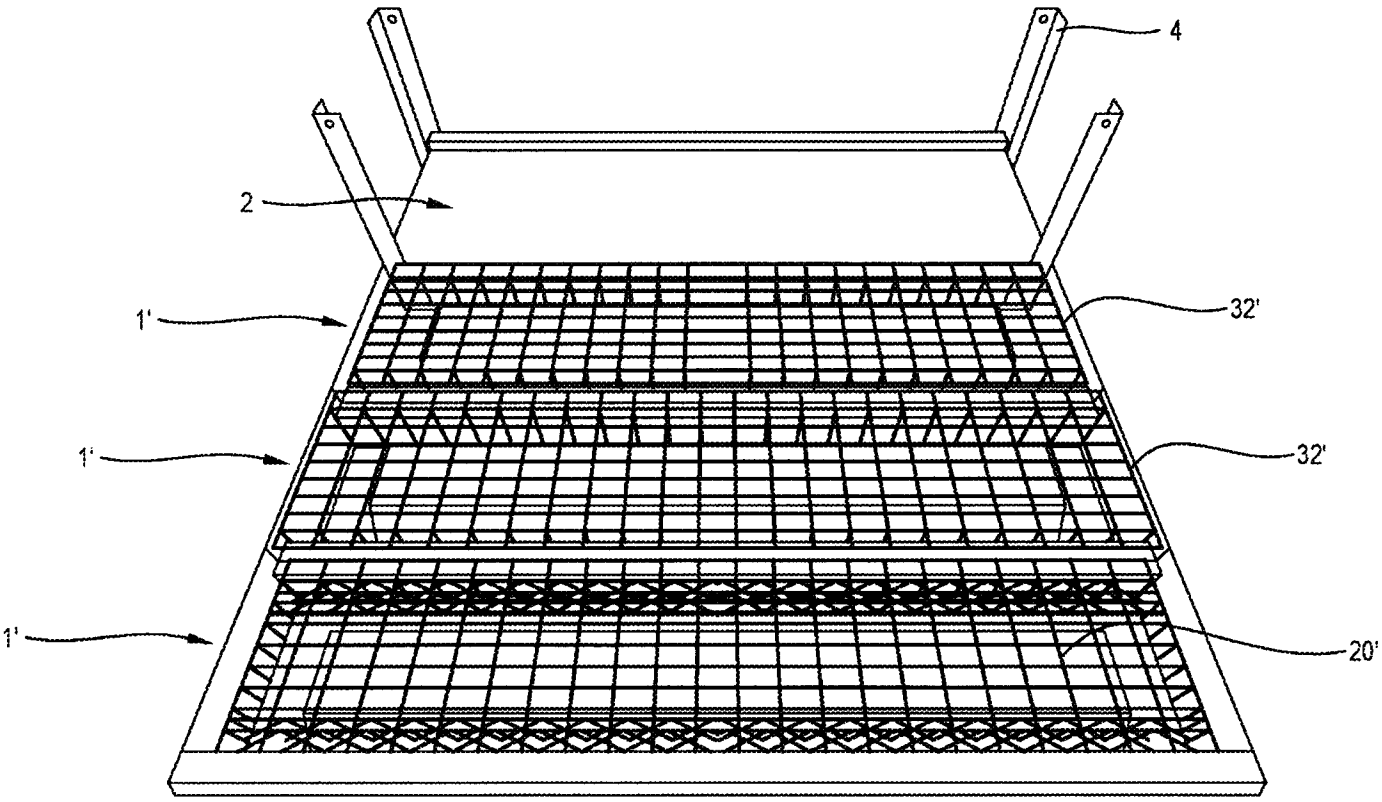
FIG. 19 is a perspective view of a partially assembled bridge model comprising a plurality of bridge modules.

The elongate beams 8 are spaced inwardly from the side walls 14 to provide a pair of shoulders 26 on opposing sides of the formwork member 10. These shoulders 26 provide a reaction surface upon which to support the module 1 on the piers 22. Alternatively, the shoulders 26 can be configured to overlay or interlock with a subsequent module 1, as illustrated in FIG. 19.

Adjacent to the elongate beams 8 of the formwork member 10 there is further provided a pair of land portions 18. The land portions 18 partially correspond to the form of the cavity 3. Accordingly, the land portions 18 define a volume of the formwork member 10 that will not receive concrete 7. The larger the volume of the land portion 18 the lesser the weight of the concrete 7 within the module 1. A plurality of land portions 18 are illustrated in FIG. 3, each disposed between two of the three elongate beams 8.

Figure 17A:
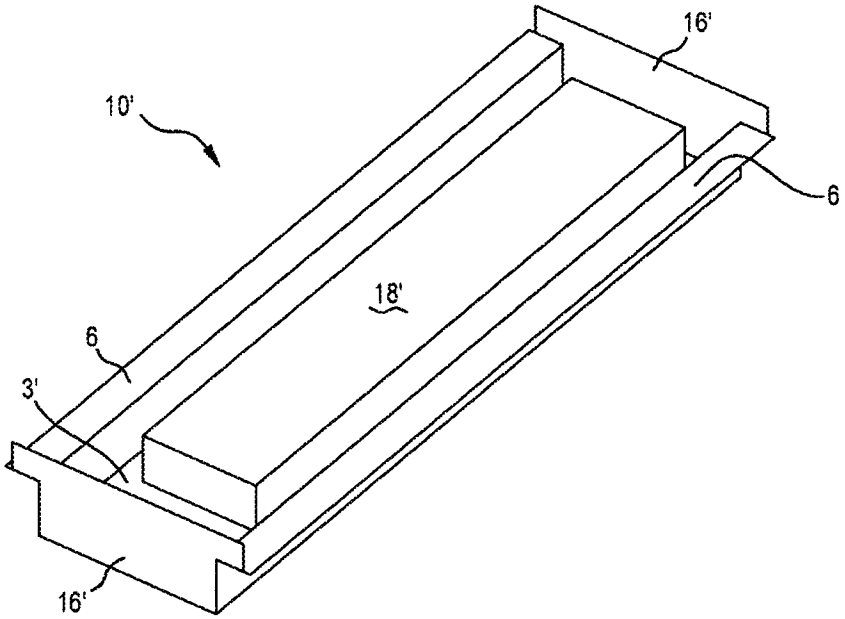
FIG. 17A is a perspective view of the formwork member according to one embodiment of the invention.
Figure 17B:
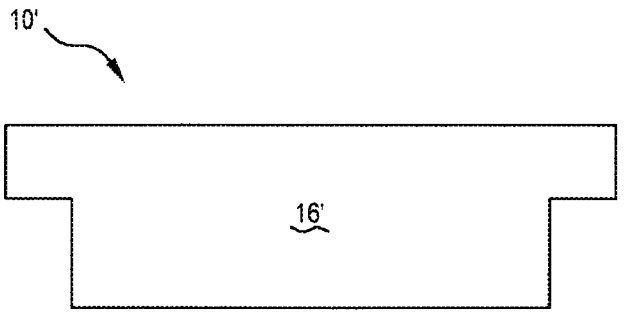
FIG. 17B is an end view of the formwork member of FIG. 17A, illustrating load bearing surfaces on the underside of the formwork.
Figure 17C:
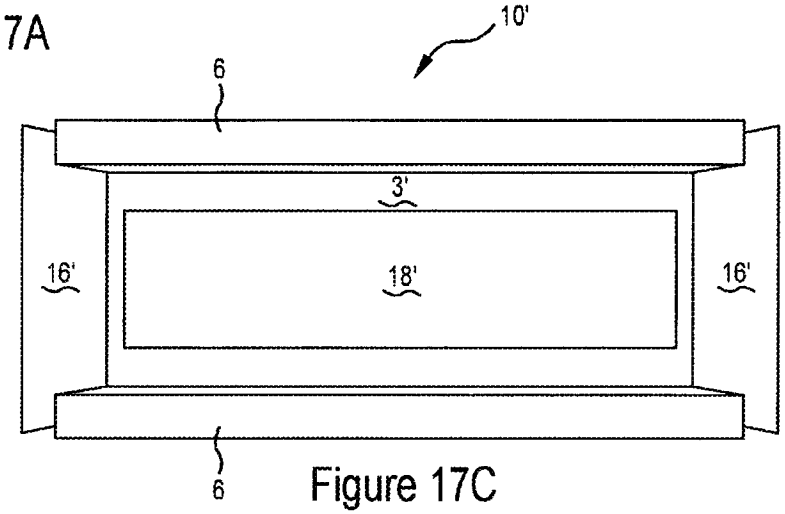
FIG. 17C is a top view of the formwork member of FIG. 17A, illustrating a central land portion.

In FIG. 3, the land portions 18 extend fully between the two end walls 16. It is contemplated that the land portions 18 can only extend partially between the two end walls 16, defining a central land portion 18 such that the cavity 3 extends fully around an outer region of the formwork member 10, as illustrated in FIGS. 17A-17C.

The formwork member 10 can be fabricated in a standard design or a number of different designs for example; a light-weight module 1, a medium-weight module 1 and a heavy duty module 1. The geometry of the module 1 can also be reproduced in a variety of different spans, for example 6 metres (m), 9 m and 12 m. It is further contemplated to achieve increment lengths, such as 7 m or 8 m, cantilever head walls can be poured on site, which operate to stretch out the additional lengths required.

Figure 24A:
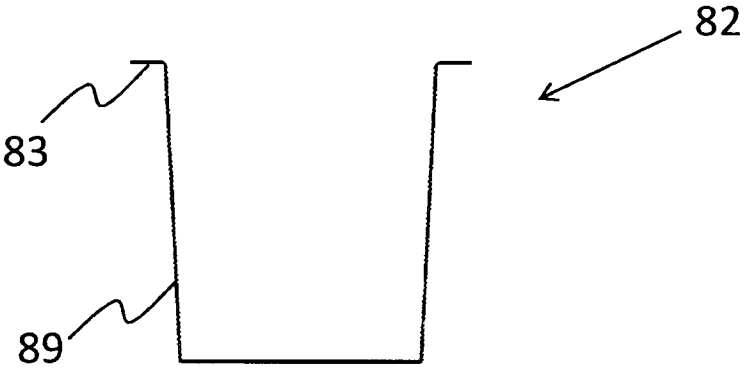
FIG. 24A is a sectional view of the trough of FIG. 24, illustrating a U-shaped section.
Figure 24:
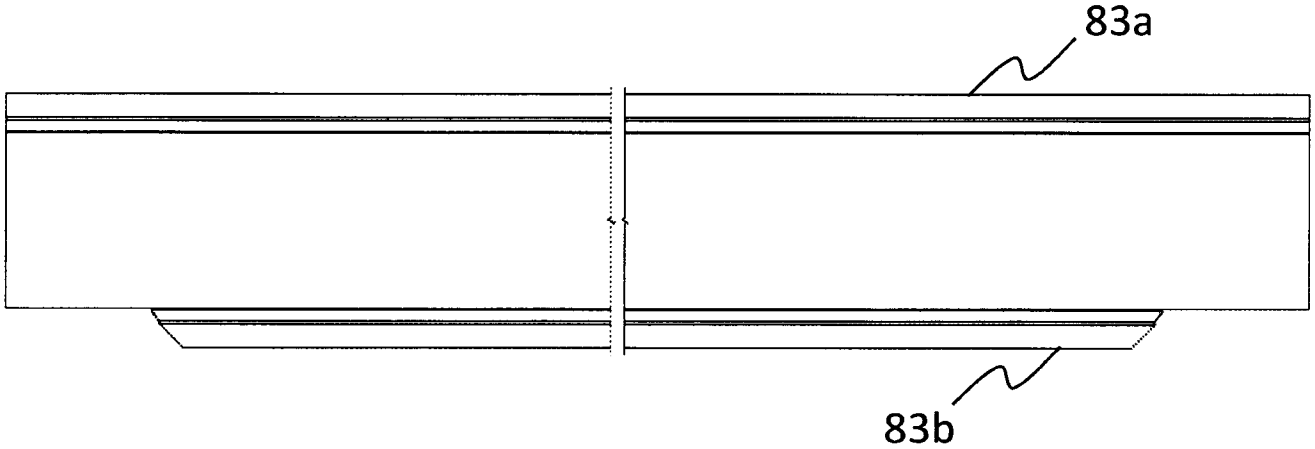
FIG. 24 is a top view of a trough of the formwork of the module.
Figures 25, 25A:
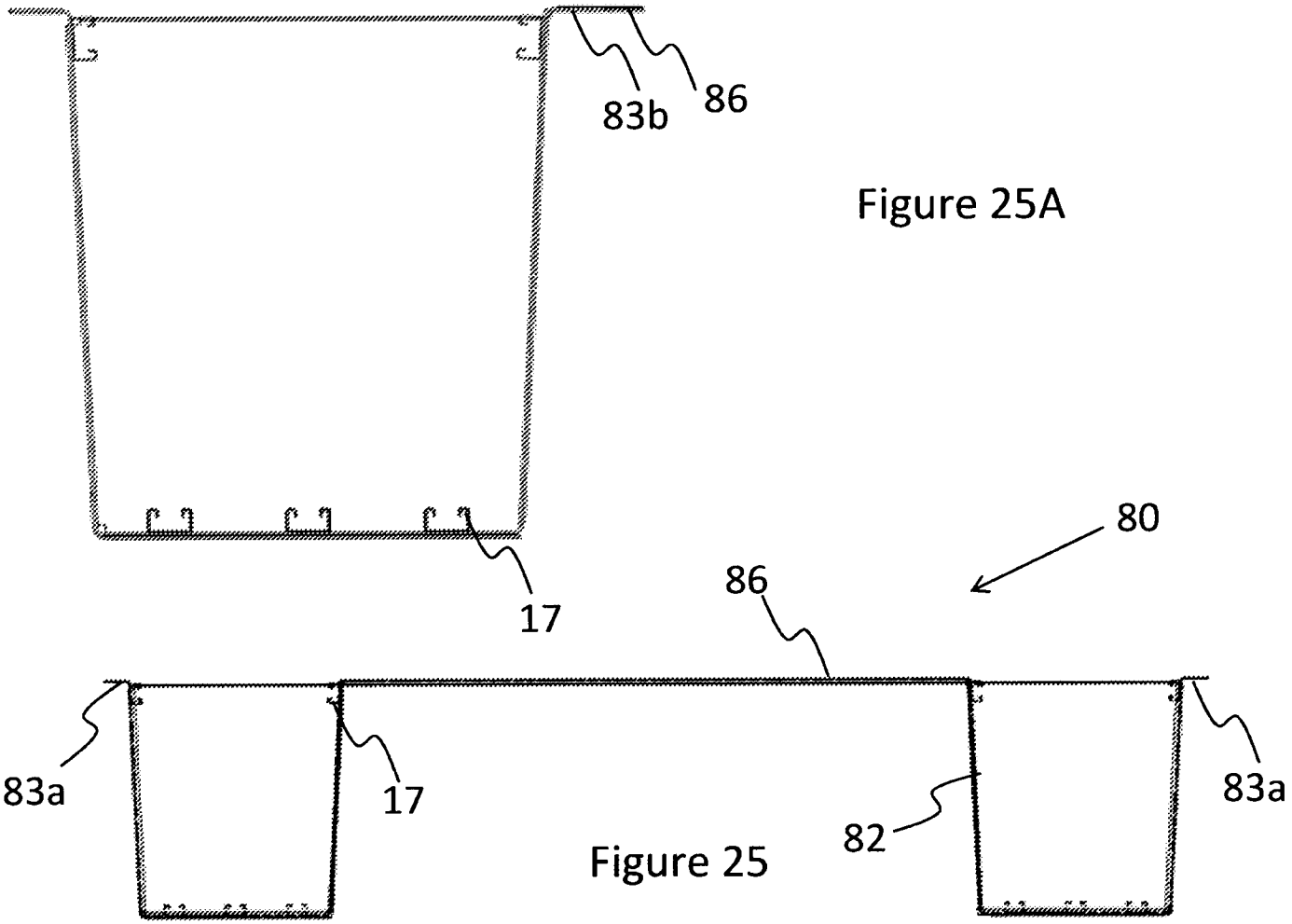
FIG. 25 is a sectional view of a formwork pan, comprising a pair of troughs from FIG. 24, connected by a stiffening plate.
FIG. 25A is an enlarged view of FIG. 25, illustrating a plurality of channels, attached to an internal surface of the formwork pan.
Figure 26A:
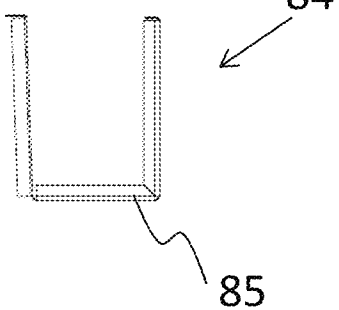
FIG. 26A is a cross-sectional view of the end wall of FIG. 26.
Figure 26:
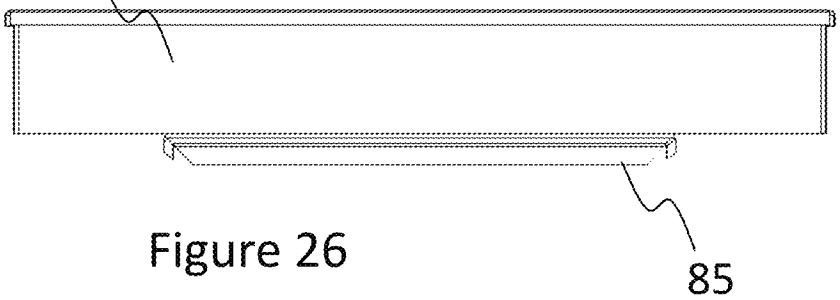
FIG. 26 is a top view of an end wall of the formwork, illustrating flanges for engagement with the formwork pan of FIG. 25.
Figure 26B:
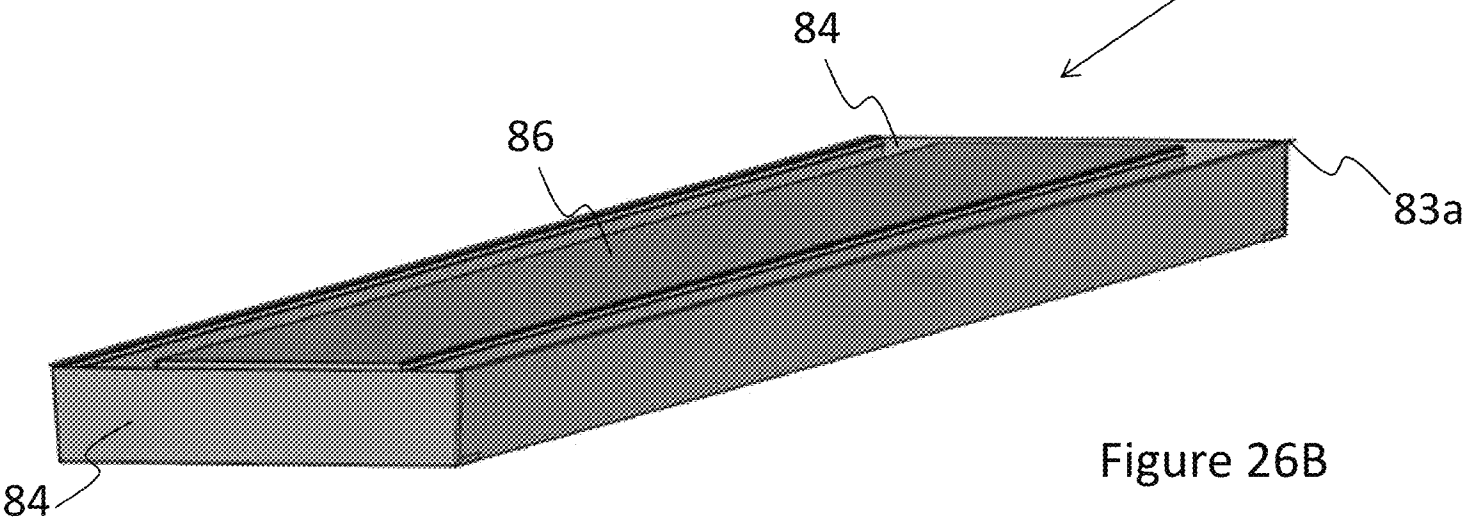
FIG. 26B is a perspective view of the assembled formwork, two troughs, two end walls and a stiffening plate.

The module 1 is designed to use 40 MPa concrete, by way of example, which is readily available. This is also a suitable concrete for the formation of abutments with which to support the modules 1, in constructing a bridge. In one embodiment, the formwork 10 is comprised of two troughs 82, which in connection with a stiffening plate 86 form a pan 80, and two end caps 84 (as illustrated in FIGS. 24 to 26). An additional mid-span cross beam (not illustrated) can also be incorporated to traverse the stiffening plate 86 (this cross beam would reduce twisting thus making the formwork 10 stronger and more rigid).

The troughs 82 are roll formed or pressed from galvanized steel to form a U-shaped section. Each trough typically weighs about 350 kg. The periphery of the U-section has two opposing horizontal flanges 83. An outer flange 83*a* is configured to engage side structure on an outer side of the module and an inner flange 83*b* which is configured to engage and support a stiffening plate 86. The depth of each trough 82 can be configured to provide additional strength depending on the desired span and load capacity of the bridge 1.

The stiffening plate 86 is mounted on opposing sides to the flanges 83*b* of two adjacent troughs 82 (see FIG. 25). The stiffening plate 86 can be welded, riveted or bonded to the troughs to form a W-section. Within each of the troughs 82 are disposed a plurality of channels 17, illustrated in FIG. 25A as C-channels. These channels 17 engage with the reinforcement 20 as it is introduced into the formwork to join the two components. In this manner the reinforcement 20 adds to the stiffness of the formwork 10 even though no concrete has been introduced to bond the two together.

Figures 31, 31A:
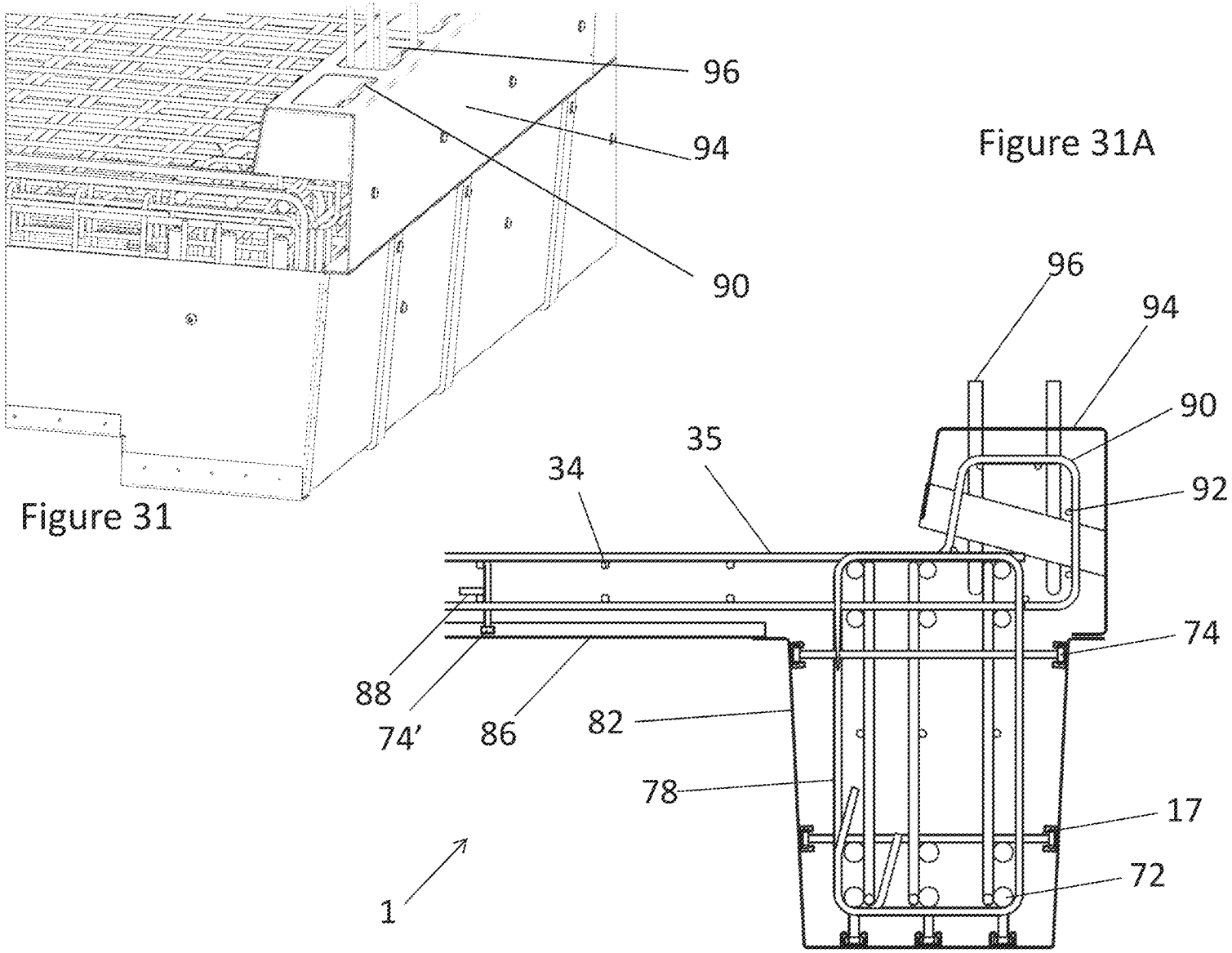
FIG. 31 is a perspective of the module further comprising a side shield encasing the wall supporting structure.
FIG. 31A is a sectional view through the module and side shield of FIG. 31.

Reinforcement channels 17 can also be attached to the stiffening plate 86 to join the reinforcement mesh 20 to the formwork over the stiffening plate 86 (illustrated in FIG. 31A). As the stiffening plate 86 is long and flat, it is predisposed to bending, more so when the load of the reinforcement 20 is introduced into the formwork 10. As such additional connections to brace the stiffening plate 86 to the reinforcement 20 significantly reduce bending loads in the formwork 10.

Two end caps 84 are roll formed or pressed to form a mounting flange 85. These end caps 84 are then welded or bonded to the pan 80 to complete the formwork 10. As illustrated in FIG. 26 the formwork 10 provides a cavity 3 that runs around a periphery of the formwork 10 to receive the reinforcement 20. It is contemplated that additional troughs 82 can be used to construct the formwork 10, such that two, three, four or even five cavities are created to receive the reinforcement and thereby create up to five elongate beams across the module 1.

The channels 17 are fixed to the formwork troughs 82 by welding or bonding and transfer the load of the wet concrete into the reinforcement as well as the formwork 10 providing additional support thereto. These channels 17 can be replaced by stiffening form pressed or rolled into the troughs 82, for example swages, indents, protrusions or the like.

The Reinforcement Member

The reinforcement member 20 comprises the upper portion 30 and the lower portion 40.

Figure 15:
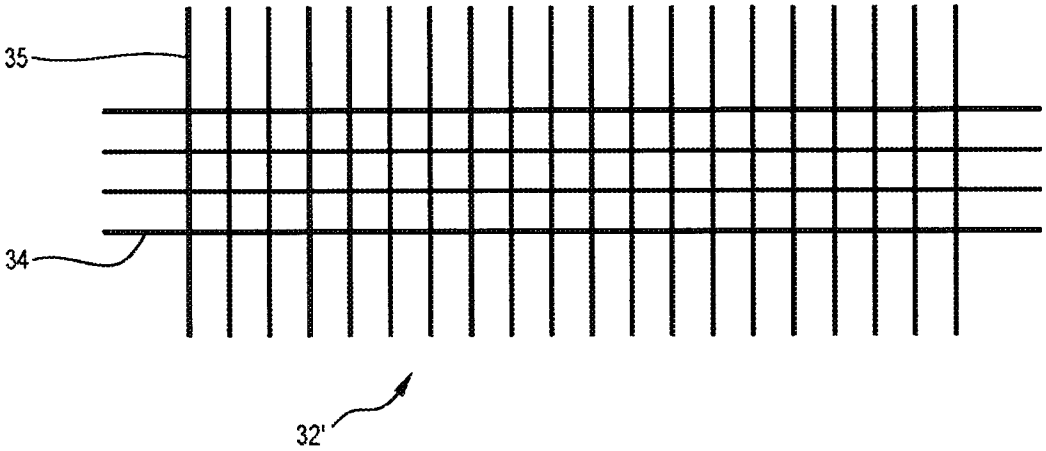
FIG. 15 is a top view of an upper portion of the reinforcement member configured to provide a deck.

The upper portion 30 is formed from a single layer of mesh, illustrated in FIG. 15 as a deck 32. Alternatively, the upper portion 30 can be formed from a plurality of decks 32. The deck 32 can be configured from a lattice work of line-wires 34 and cross-wires 35, wherein the line wires traverse the cross-wires substantially perpendicularly thereto, as described further in relation to FIGS. 15 and 16.

Returning to FIG. 3, wherein the deck 32 is formed from a plurality of frames 41. Each frame 41 comprises a pair of longitudinal members 44 and an intermediate member 46 that traverses back and forth between the pair of longitudinal members 44. This configuration of the frame 41 is illustrated in more detail in FIG. 4.

The intermediate member 46 extends diagonally between the pair of longitudinal members 44 to structurally reinforce, and stiffen the frame 41. The intermediate member 46 is permanently engaged with the longitudinal members 44 at multiple connection points 45 along the length of the frame 41. The engagement member 46 can be bolted, or welded to the longitudinal members 41. From a side view of the frame 41, the intermediate member 46 defines a sinusoidal waveform traveling along the length of the frame 41.

Each frame 41 of the deck 32 is arranged in a spaced relationship across the lower portion 40 of the reinforcement member 20. The deck 32 can be supported on the lower portion 40 without attachment thereto, and as such, the setting concrete will provide a bond between the upper 30 and lower portion 40 of the reinforcement 20.

In some embodiments, the deck 32 is permanently affixed to the lower portion 40 of the reinforcement 20. The upper 30 and lower 40 portions may be bolted, welded, clipped, or otherwise adhered to one another. In this embodiment, the reinforcement 20 can be fully constructed and rigorously tested to structural and safety standards to be certified independently of the formwork member 10. The testing can be carried out away from the construction site, meaning that the reinforcement 20, once installed in the formwork member 10 need not be certified or tested further. The mixing and integrity of the concrete 7 are the only variables to be managed at the installation site. This can be advantageous, where a structure or bridge 100 is to be constructed in a remote location that is hard to reach or in an area where architects and other qualified professionals are in short supply for certification purposes.

Figure 4:
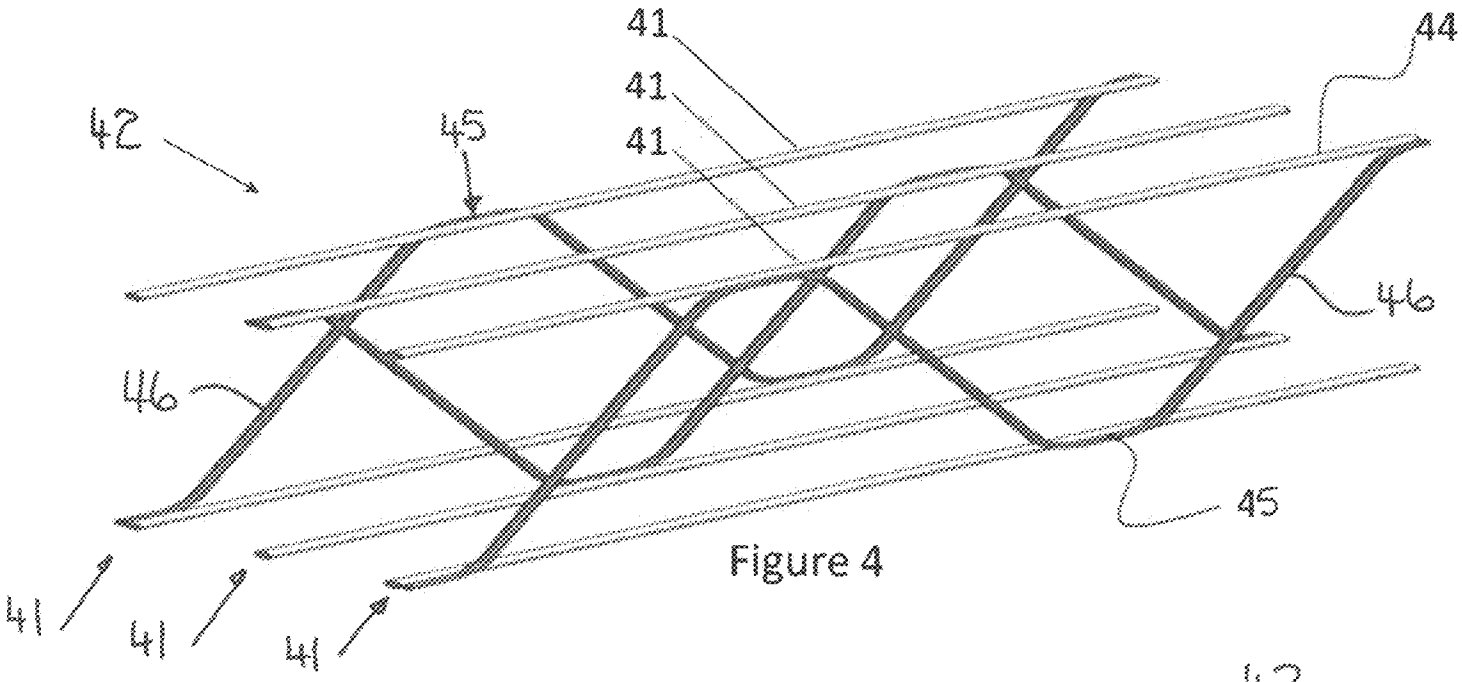
FIG. 4 is a perspective view of a lower portion of a reinforcement member comprising a plurality of frames arranged to form a truss.

The lower portion 40 of the reinforcement 20 is also constructed from frames 41. The frames 41 of the lower reinforcement 40 are grouped in threes, to form a truss 42, as illustrated in FIG. 4. For different types of bridges 100 the frame 41 can be grouped in twos, fours, fives, sixes etc.

As each frame 41 is comprised of a pair of outer longitudinals 44 and an intermediate member 46, the strength of the frame 41 is not constant along its length. Accordingly, the structural rigidity of the frame increases at the connection points 45 between the members 44 and 46. To rectify this varying strength along the length of the frame 41, each frame is displaced relative to the subsequent frame 41. In this manner the strength of the overall truss 42 is more consistent. This is illustrated in FIG. 4 and FIG. 5.

Figure 5:
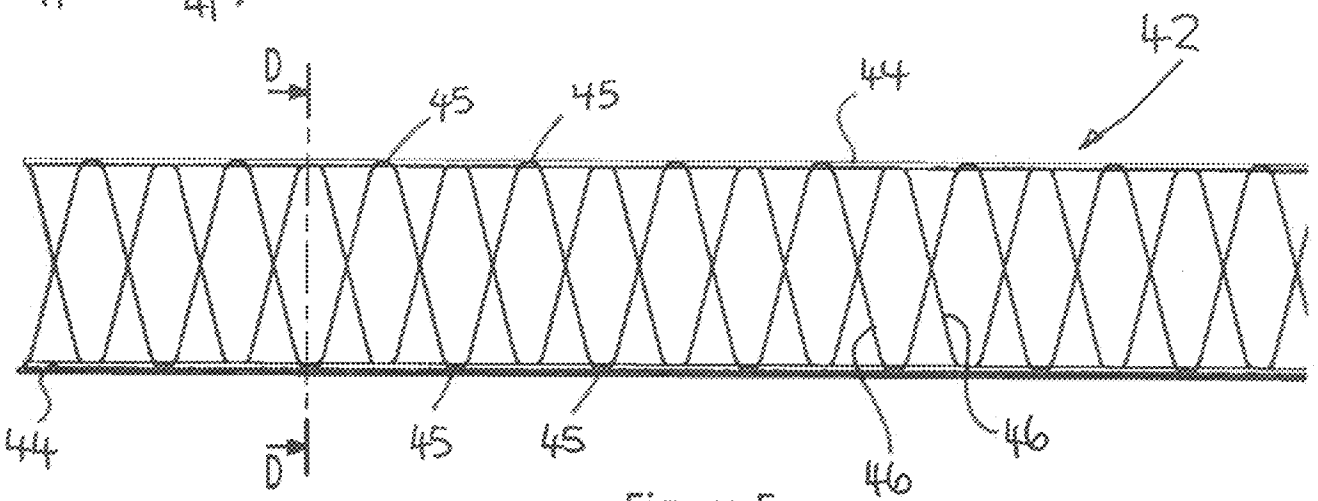
FIG. 5 is a side view of the truss of FIG. 4.

FIG. 5 is a side view of the truss 42 visually illustrating the rectification effect of offsetting subsequent frames 41. The truss 42 illustrated in FIG. 5 uses three frames 41, wherein the outer two of the three frames 41 are in alignment with one another and the central frame 41 is offset. The offset is apparent by virtue of the intermediate member 46, as the sinusoidal waveform is offset by approximately half a wavelength to the intermediate members 46 of the outer two frames 41.

Figure 5A:
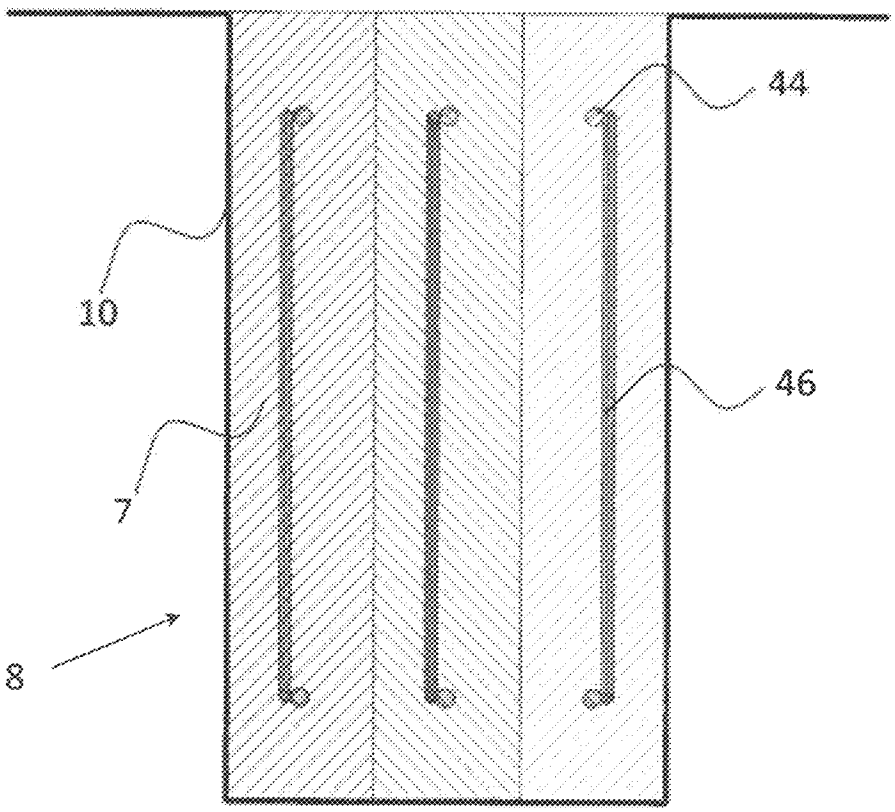
FIG. 5A is an end view of the truss of FIG. 4, illustrated in situ within the bridge module and surrounded by a substrate material.

FIG. 5A is an end view of the truss 42 of FIG. 5, illustrated in situ within the module 1 surrounded by cured concrete 7 to form the elongate beam 8.

Returning again to FIG. 3, the lower portion 40 of the reinforcement 20 is arranged in three trusses 42, spaced in alignment with the three cavities 3 of the corresponding formwork member 10.

Each of the trusses 42 further comprises a fourth and final frame 41 which provides a stable support base 47 to each truss 42.

The three trusses 42 are arranged in a predetermined relationship and the plurality of frames 41 that comprise the deck 32 of the reinforcement 20 are laid out perpendicularly along the trusses 42. The deck 32 and the trusses 42 are then permanently attached to form a single reinforcement member 20 to be received by the formwork member 10. The reinforcement member 20 can be jigged for dimensional tolerance and control of the fabrication and assembly process. The finished reinforcement 20 will be tested and certified before being dispatched to the bridge 100 installation sites.

Fabricating the finished reinforcement 20 provides many advantages aside from reducing the difficulties associated with certification. In some embodiments, the reinforcement 20 can be configured to slide into the formwork member 10 and form a mechanical connection thereto, see FIG. 6.

Figure 6:
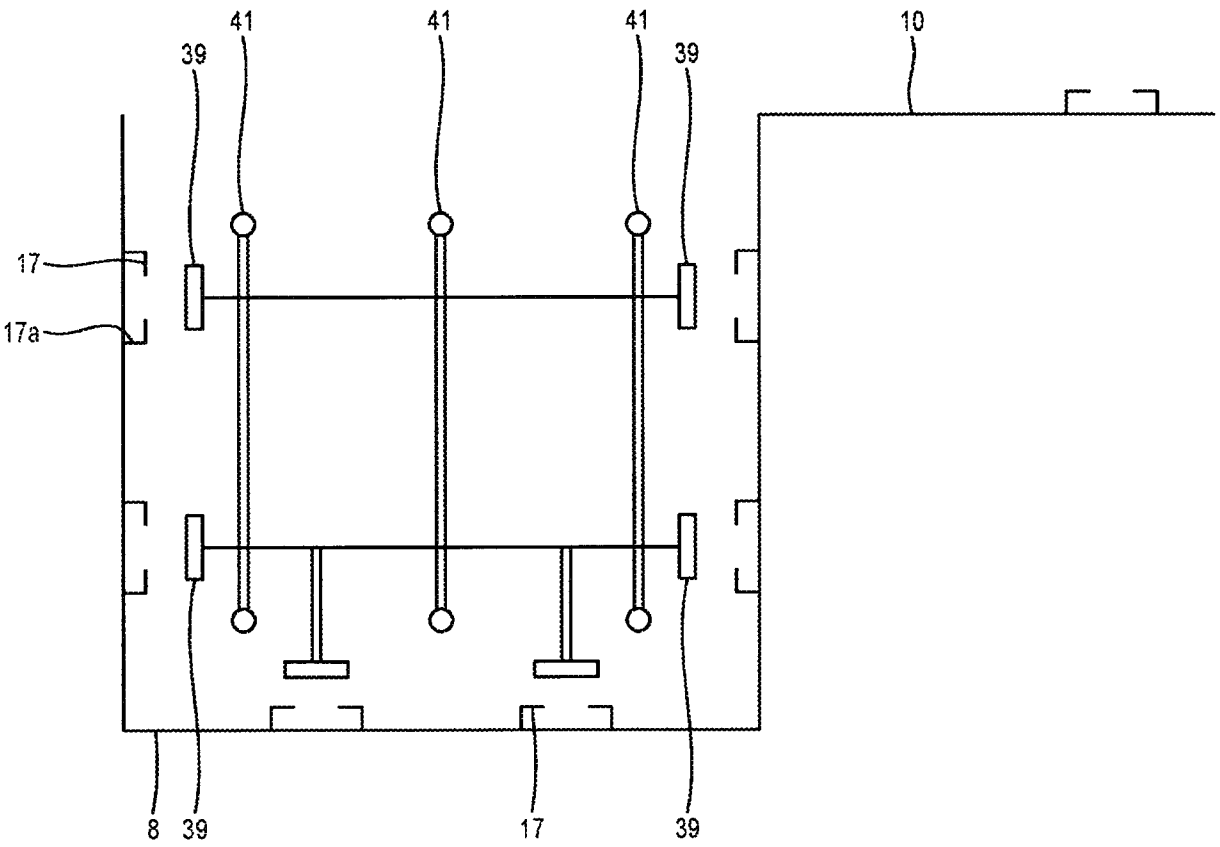
FIG. 6 is a sectional view of the module, illustrating a plurality of open channels for engaging the lower portion of the reinforcement.

FIG. 6 is a sectional view of the formwork member 10 having a plurality of open channels 17 for engaging mounts 39 on the frames 41. The mounts are welded or integrally formed with the individual frames 41 or to the finished trusses 42. The mounts 39 provide a simple mechanical connection to the open channels 17 of the formwork member 10. The channels 17 can be fully open or partially open and thereby providing slots or keying features to receive the mounts 39. As the truss 42 and mount 39 are slid along the channels 17, the truss 42 and formwork member 10 become engaged.

In an alternate embodiment, the channels 17 can be formed with only a lower portion 17*a* in which the mounts 39 can be seated. The weight of the reinforcement 20 sitting in the formwork member 10 will retain the reinforcement 20 until such time as the concrete 7 is poured and set within the formwork member 10.

The module 1 can be further modified by attaching elements that extend above or below the formwork member 10, for example a culvert section (not illustrated) or rail 67. In some embodiments, the rail 67 is an integral part of either the lower reinforcement 40 or the upper reinforcement 30. The rail 67 is arranged to extend above the deck 32 of the reinforcement 20. As the concrete cures around the reinforcement 20 binding it to the formwork member 10, the rail 67, as part of reinforcement 20, becomes affixed within the formwork member 10. The rail 67 can be formed from non-structural gauge reinforcement 20 to provide a handrail for the module 1. However, in some embodiments the rail 67 is formed from heavy gauge reinforcement 20 to provide a safety rail or safety barrier for the module 10. The rail 67 can further be used as an engagement point within the finished module 1 for mounting to or attaching a crane to lift the module 1 into position.

In some embodiments, the rails 67 can be connected to a support truss 69 to support parts of the bridge 100 which require additional support during or after construction. The support truss 69 is illustrated and described in more detail in relation to FIGS. 21A-21D.

A Reinforced Truss

Figure 7:
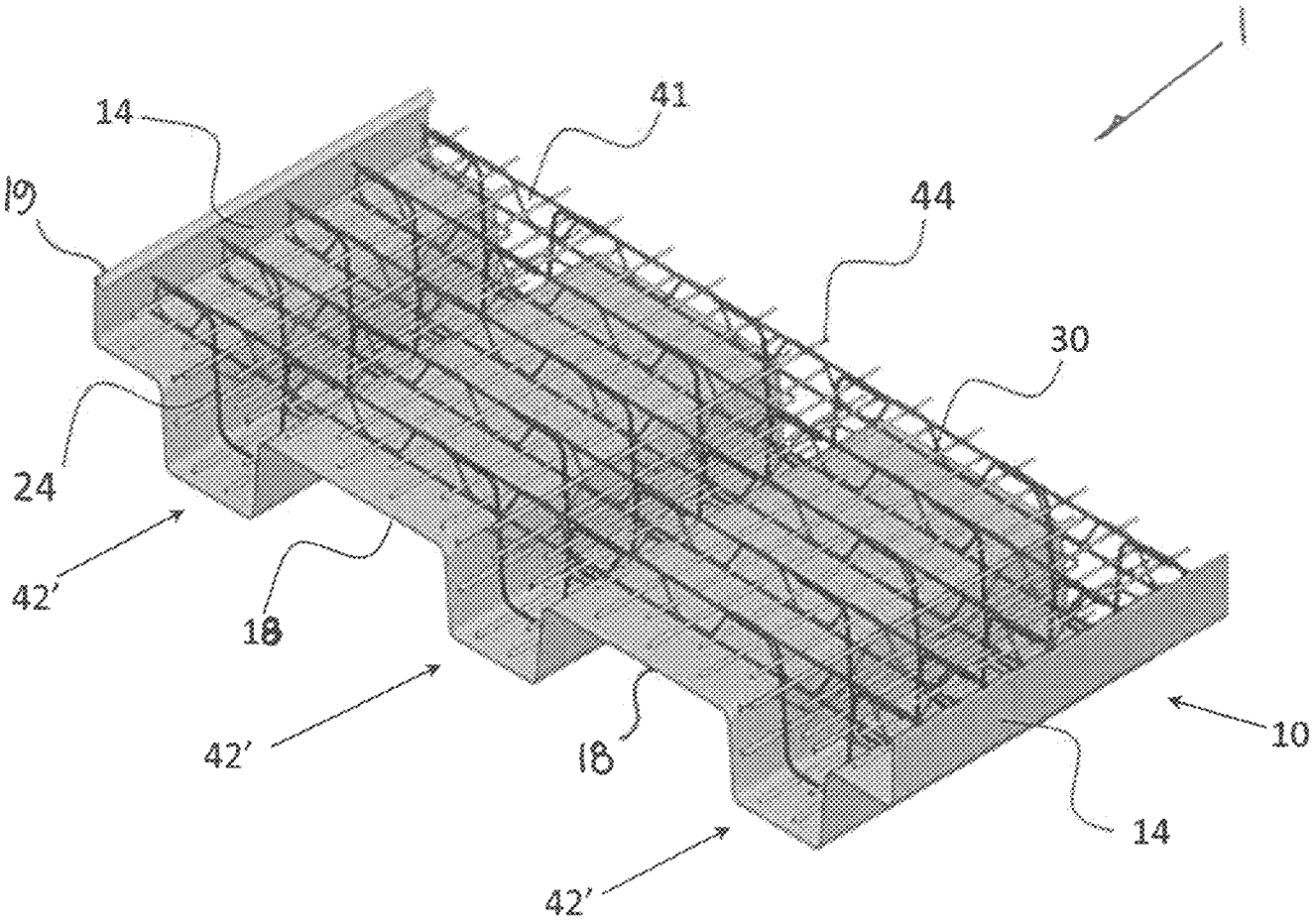
FIG. 7 is a perspective cut-away section of the bridge module of FIG. 1, illustrating the configuration of the reinforcement member within a support of the module.

FIG. 7 is a perspective cut-away section of the bridge module of FIG. 1, illustrating the configuration of the reinforcement member 20 within the formwork member 10 of the module 1.

Extending laterally between the side walls 14 of the formwork member 10 are a plurality of frames 41. Extending along the span of the module 1 is a plurality of trusses 42' interconnected by a plurality of frame supports 24. In this particular embodiment, a frame support 24 is provided for each frame 41 of the upper portion 30 of the reinforcement 20.

Figure 8:
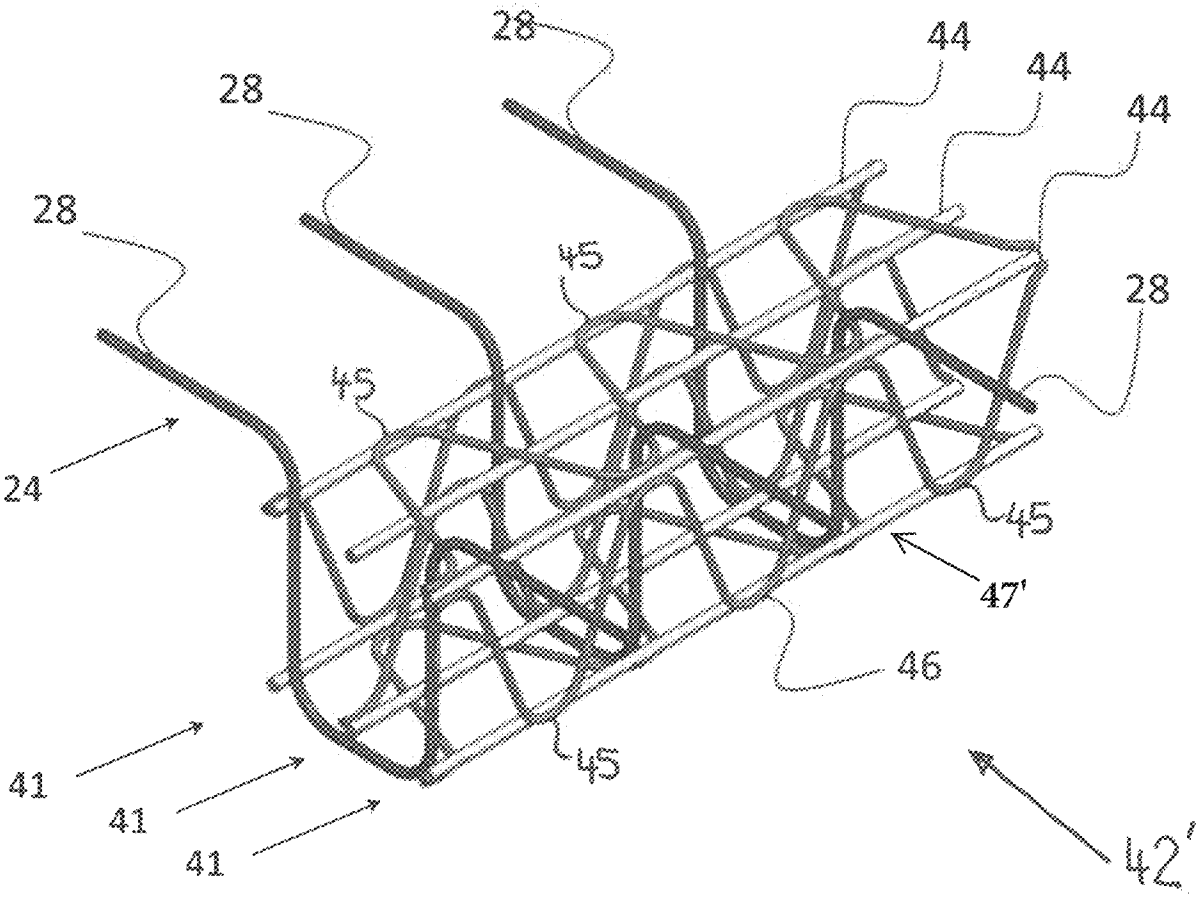
FIG. 8 is a perspective view of an alternative truss that forms the lower portion of the reinforcement member.

FIG. 8 illustrates a perspective view of truss 42' connected to frame supports 24 in isolation from the formwork member 10.

Truss 42' comprises three frames 41 arranged in spaced configuration having one additional intermediate member 46 arranged along an upper face of the truss 42' and one additional intermediate member 46 arranged along the base 47' of the truss 42'.

The truss 42' is stronger than truss 42 due to the additional cross bracing of two additional intermediate members 46.

At spaced intervals along the truss 42' there is provided a plurality of frame supports 24. Each frame support 24 comprises an elongate bar or rod that is formed in a U-shape. The body of the U-shape is configured to conform to the outer profile of the truss 42'. Each end of the U-shaped frame support 24 extends at right angles to the U-shaped body to provide a pair of arms 28. The frame supports 24 are welded or otherwise rigidly affixed to the truss 42'.

When the truss 42' is lowered into a corresponding cavity 3 in the formwork member 10, the arms 28 are supported on the land portions 18 of the formwork member 10. In this manner the trusses 42' are supported by the formwork member 10 ready to receive the concrete mixture.

Each frame support 24 is further connected by welding or similar, to the frames 41 extending laterally between the side walls 14, thereby forming a single reinforcement 20 for inserting into the formwork member 10 of the module 1.

Each truss 42' is made from a strong material, such as steel, and is designed to span the length of the module 1 with the ability to support the formwork 10 and concrete 7 while not set. The frame supports 24 provide additional reinforcing means by being integrated between the trusses 42' and frames 41 of the deck 32.

Additional trusses 42' and frame supports 24 can be further integrated into the structure to provide rails 67, or to add further strength and rigidity to reinforcement 20 or to provide mounting points to and from the module 1.

When fabricating the reinforcement 20 the trusses 42' and frames 41 can be positioned or temporarily affixed to a jig in order to set the dimensional tolerances of the overall reinforcement 20. It is further contemplated that the jig can be configured such that the finished reinforcement 20 is pre-tensioned as it is fabricated. When removed from the jig or fixture, the reinforcement 20 will remain pre-tensioned when placed in position within the formwork member 10. This will ultimately provide a pre-tensioned module 1 from which to construct the bridge 100.

The reinforcements 20 can be transported to the bridge 100 installation location in isolation or in combination with the formwork members 10. The two components are designed to cooperate with one another and as such nest well for transportation, when shipped from a single manufacturing source.

As described above, modules 1 provide a form of integrated truss 42 within each bridge module 1. The formwork member 10 is light and transportable, thus reducing transport costs. Once on site, the reinforcement member 20 is combined with the formwork member 10 and located therein. Once both the formwork member 10 and the reinforcement 20 are in position the concrete in pourable form is added into the formwork tray 10 to complete the module 1. The concrete 7, as it cures and sets, integrates the reinforcement 20 into the formwork member 10, thereby strengthening the module 1.

Figure 32:
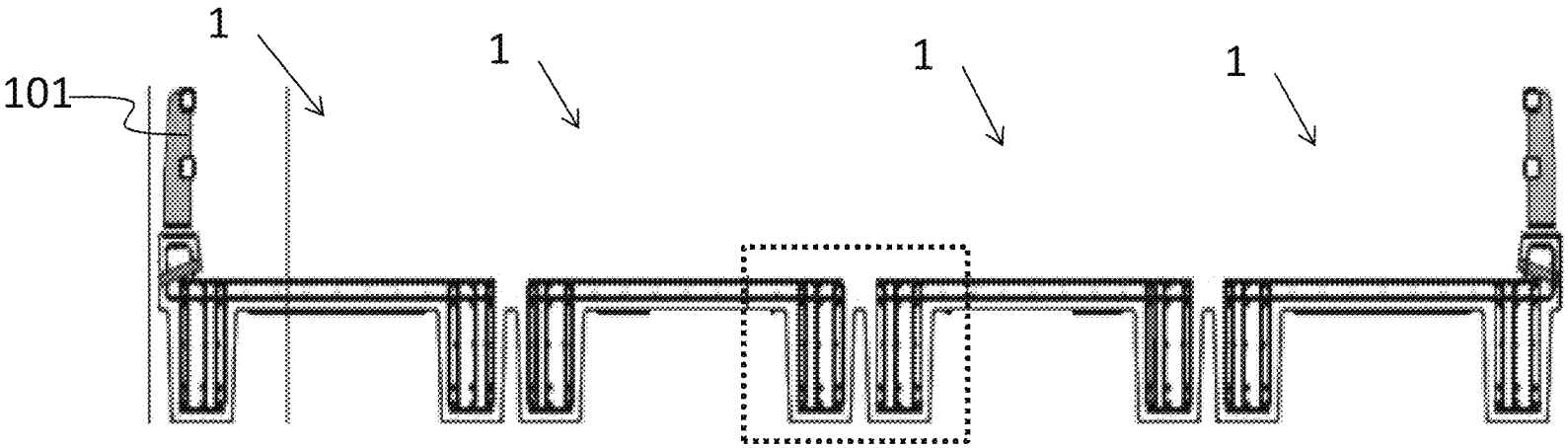
FIG. 32 is a sectional view of a bridge comprising a plurality of modules arranged in a side-by-side configuration.
Figure 32A:
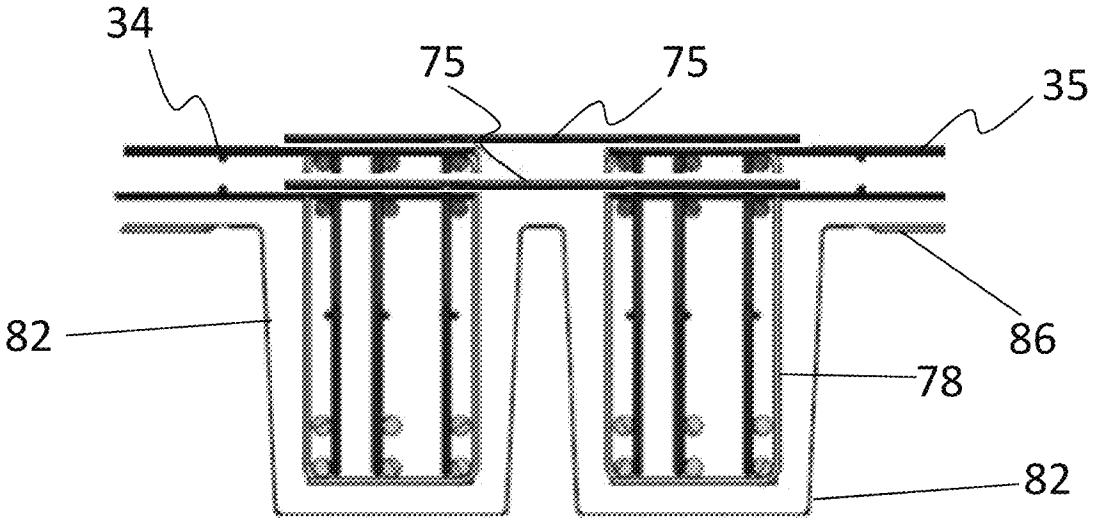
FIG. 32A is an enlarged view of FIG. 32 from within the dotted box, illustrating a pair of overlap bars for interconnecting adjacent modules.

In this manner Integrated Truss Technology (ITT) can provide a module 1 where the strength of the finished module is greater than that of its constituent parts. The integrated trusses inherently reduce the deflection of the formwork member 1 and disperse load more evenly across the module 1.

Where a bridge is to be constructed using two modules 1 disposed in side-by-side configuration, it is contemplated that the reinforcement 20 can be oversized to extend beyond the side walls 14 of each formwork tray 10. When the two formwork members 10 are located side-by-side the extending reinforcements 20 of each become interleaved or at least partially overlap, such that the concrete introduced into the pair of formworks 10 sets around the interleaved reinforcements 20 from each thereby integrating each reinforcement 20 into both the first module 1 and the subsequent module. Alternatively, additional overlap bars 75 can be inserted between the adjacent reinforcements 20 to interconnect the cross-wires 35 of the adjacent decks 32, see FIGS. 32 and 32A. The overlap bars 75 can be welded or engaged with the deck 32 using an adhesive. However, the overlap bars 75 can be positioned and not engaged with the deck 32, such that the addition of concrete or cement into the formwork 10 will produce a structural bond between the overlap bar 75 and reinforcement 20. The overlap bars 75 are typically made from a steel or alternative suitably strong material. The overlap bars 75 can have a diameter of 20-60 mm, the required gauge being a result of the size and span of the bridge to be constructed. The overlap bars 75 are not confined to a circular cross-section and can be oblate or square; however, circular bar of standard sizes is more widely available.

Secondary Supports

The variations of truss 42 described above are subject to significant loads. The full reinforcement 20 alone can weigh up to 2600 kg by way of example. As the upper 30 and lower 40 reinforcements are combined whether by welding or adhesives, the trusses 42 and deck must withstand the loads thereon. Secondary supports can be incorporated into reinforcement 20 to counteract these loads and resist torsion and bending before attachment to the formwork 10.

Figures 27, 27A:
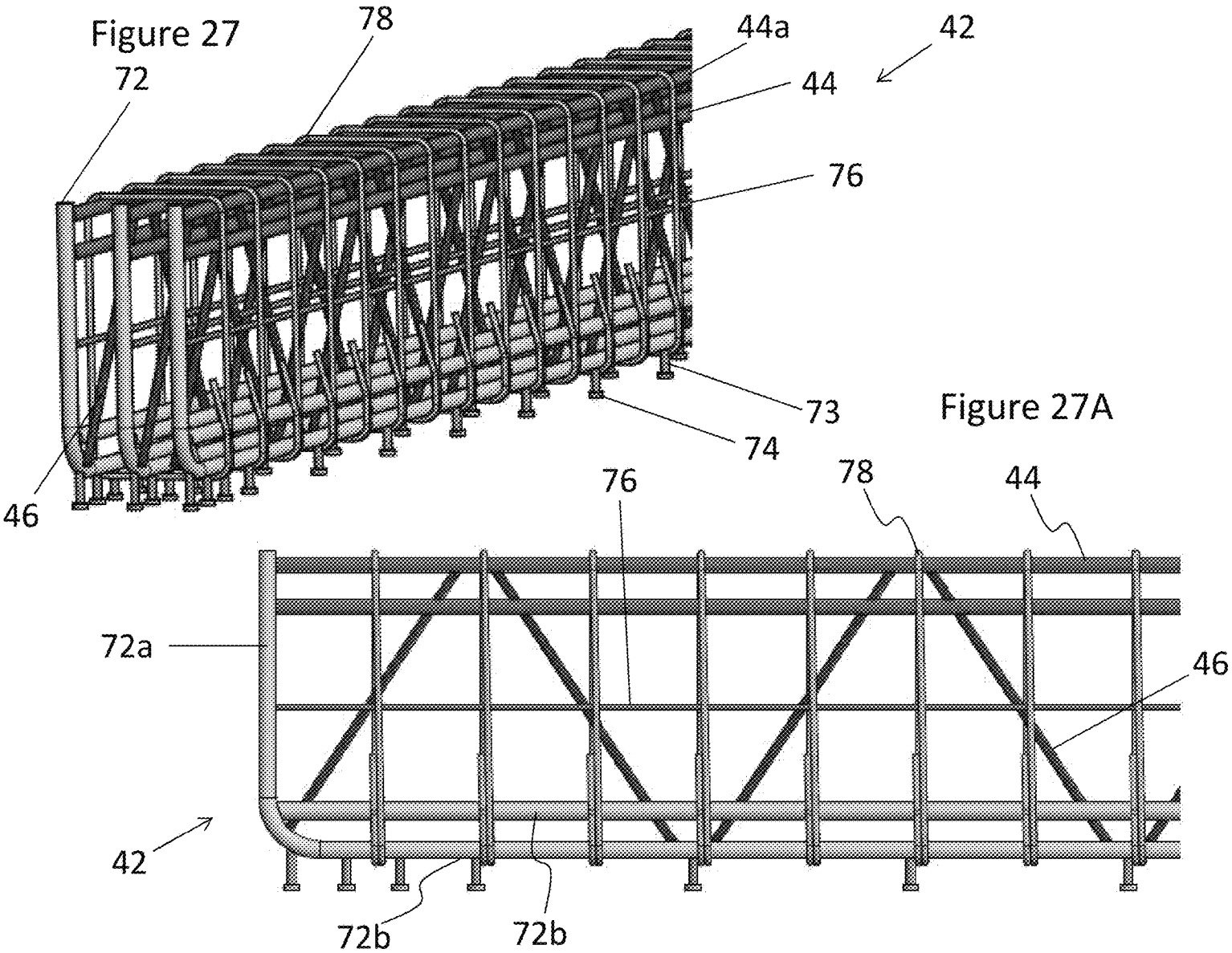
FIG. 27 is a perspective view of a truss, having a series of secondary supports.
FIG. 27A is a side view of the truss of FIG. 27, illustrating a plurality of feet for engaging the truss with the formwork.

Illustrated in FIGS. 27 and 27A are a number of secondary supports. The longitudinal member 44 has been duplicated to provide an upper 44*a* and lower 44*b* reinforcement. Further, the lower longitudinal member 44*b* has been provided in a U-shaped configuration, illustrated as a longitudinal member 72 having a cog, or hooked end 72*a*. The member 72 has a pair of opposing hooked ends 72*a*, and a duplicated, parallel longitudinal rail 72*b* that extends the entire length of the truss 42. The hooked ends 72*a* of member 72 are up-turned by 90 degrees to from the hook. The hooked ends 72*a* are welded into the intermediate member 46, the longitudinal rails 72*b* and the central brace beam 76. This configuration of member 72 provides additional shear reinforcement transverse to the flexing of the trusses 42. The member 72 having hooked ends 72*a* further provides reduction in the deflection of the formwork 10 when subjected to bending loads.

The intermediate members 46 of the truss 42 are joined to a central brace beam 76 which extends the length of the truss 42 and is connected to the intermediate member 46 at each point the two members cross.

A lateral ligature reinforcement 78 is wound around the truss 42 constraining the frames 41 from separating from one another under load. These ligatures 78 are peripheral to the truss 42 and are repeated at spaced intervals along the length of the truss 42.

A plurality of legs 73 extend from the longitudinal rails 72*b* of the member 72 at regular intervals. As illustrated in FIG. 27A, each leg 73 provides a foot 74 for connection to the channels 17 within the trough 72 of the formwork 10. These legs and feet provide an additional load path back into the formwork 10 prior to the introduction of the concrete 7. The legs 73 can be spaced together closely in the end regions of the formwork 10 and spaced further apart along the central length of the truss 42. The legs can be welded to the member 72 or attached using an adhesive or bolted connection.

The member 72 is of a greater cross section to that of the ligature 78 and central brace beam 76. The member 72 is between 30-50 mm in diameter. In contrast the ligature 78 and central brace beam 76 are between 10-20 mm in diameter. It is contemplated that these secondary supports are made from steel or similar high tensile material.

Figures 28, 28A, 28B:
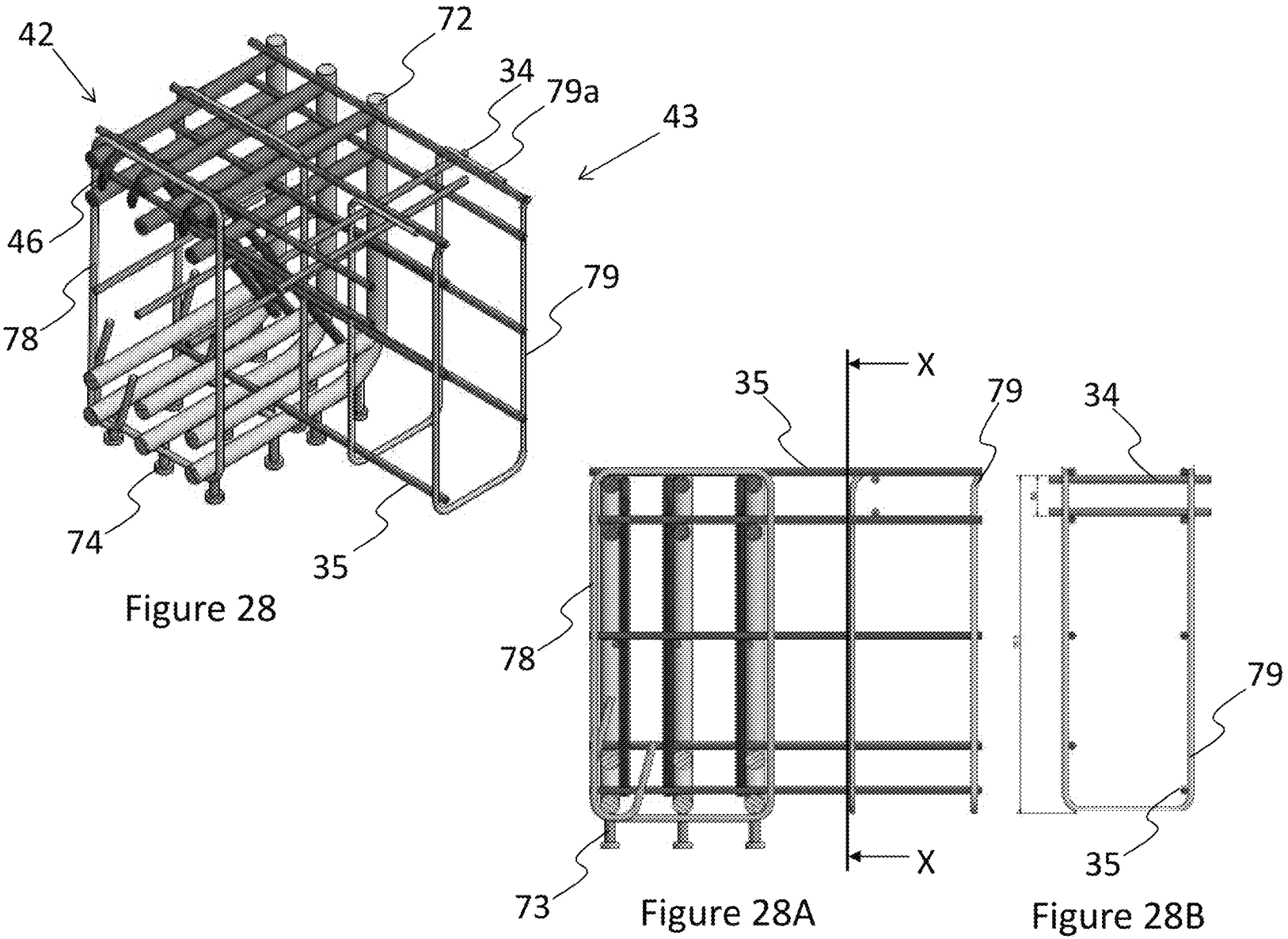
FIG. 28 is a perspective view of the truss of FIG. 27, illustrating an interconnection with a reinforcement end portion having secondary supports.
FIG. 28A is an end view of the truss and interconnected end portion of FIG. 28.
FIG. 28B is a sectional view along line X-X of FIG. 28A, illustrating an end ligature of the reinforcement.

FIG. 28 illustrates further secondary supports incorporated into the end portion 48 of the lower reinforcement. A lateral ligature 79, similar to that of the longitudinal ligature 78 is introduced to support the end portions 48 of the lower reinforcement 40, creating an end truss 43. The ligature 79 is wrapped around a plurality of cross wires 35 that extend at intervals through the thickness of the reinforcement 20, effectively spanning the upper 30 and lower reinforcement 40. The ligature also embraces multiple cross wires 35 across the reinforcement to give width and depth to the end truss 43. As with the longitudinal ligatures 78, the lateral ligatures can be joined to the cross-wires at points of intersection. In this manner the lateral ligatures 79 create an end truss 43 and resist the separation of the cross wires 35 under load.

FIG. 28A illustrates a side view of end truss 43 and the interweaving of the cross-wires 35 and line wires 34 which can be seen through the ligature 79. FIG. 28B is a section taken along line X-X of FIG. 28A, illustrating the U-shape of the ligature 79. In this embodiment of the ligature 79 the end truss 43 is not completely encircled by the ligature 79. The ligature 79 is a U-shape having two opposing ends 79*a* that extend at right angles to the plane of the ligature 79. These ends 79*a* will align with the cross wires 35 of the end truss 43 to facilitate bonding or welding thereto.

Figure 29A:
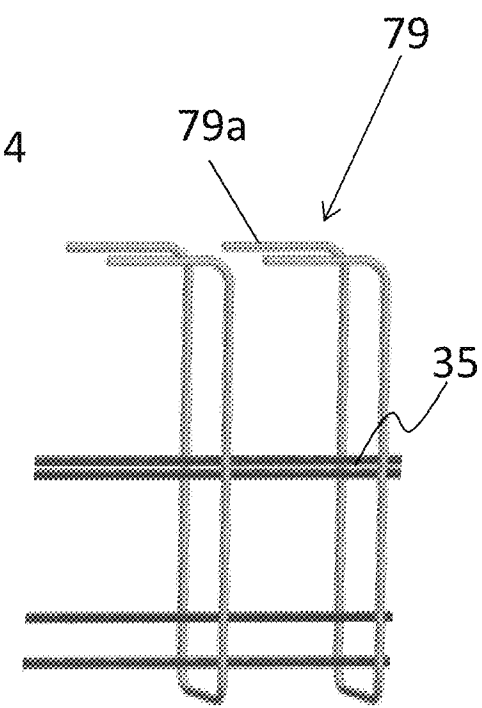
FIG. 29A is a perspective view of the end ligature of FIG. 28B, illustrating two opposing ends that extend at right angles to the plane of the ligature.
Figure 29:
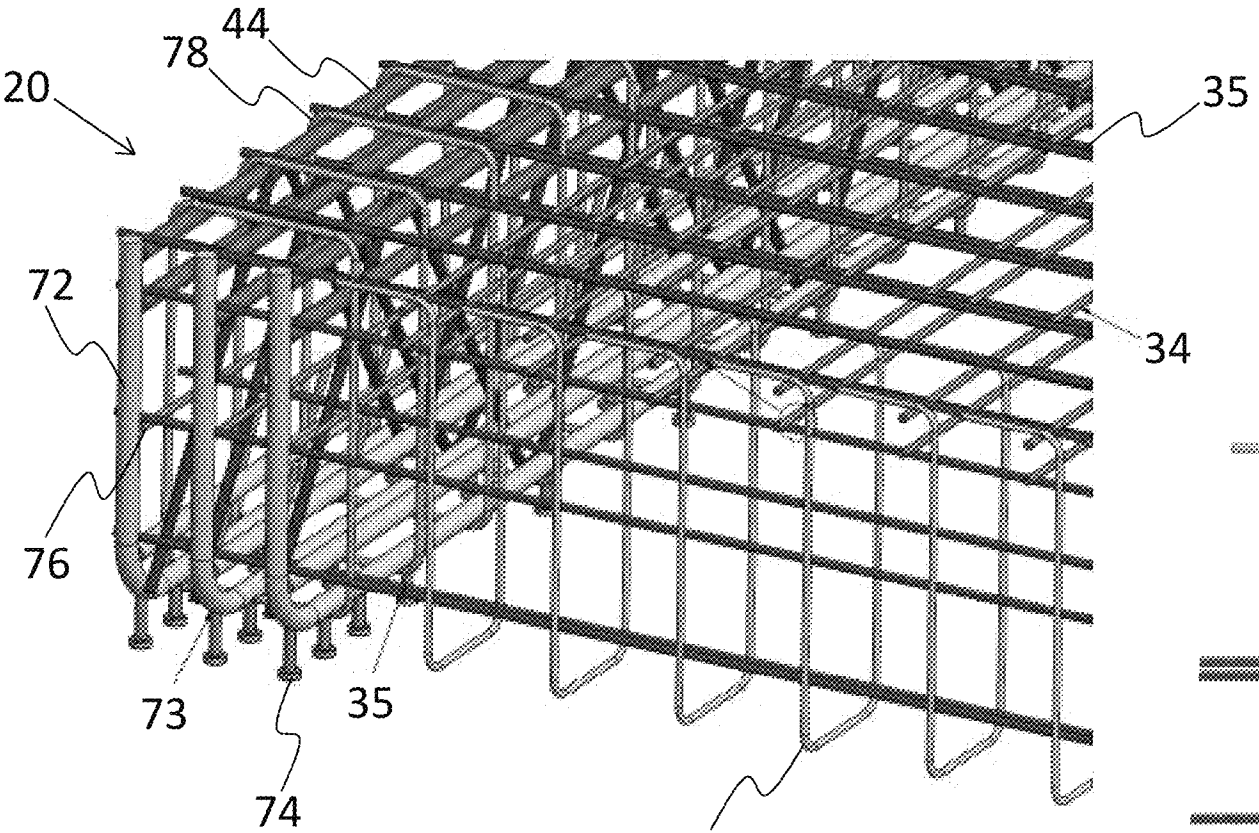
FIG. 29 is a perspective view of a corner of the reinforcement, illustrating both upper and lower reinforcement having secondary supports.

FIG. 29 incorporates all of the features of FIGS. 27 to 28 illustrating a corner of the reinforcement 20, comprising both upper 30 and lower 40 components. In this embodiment there are no feet provided on the end truss 43; however, for additional support and additional engagement with the formwork 10, legs 73 and feet 74 can be provided on the end truss 43 engaged with the ligatures 79. It is further noted, that two layers of line wire 34 are provided in the upper reinforcement 30 which are also engaged with the ligatures 79 whether by welding or alternative bonding means.

Flat-Pack Truss

Depending on the distance between manufacture and installation, the cost of shipping the components to construct bridge 100 can comprise a significant financial outlay. With this in mind, in some embodiments a truss 42" is designed to be flat-packed for transportation.

Figure 9:
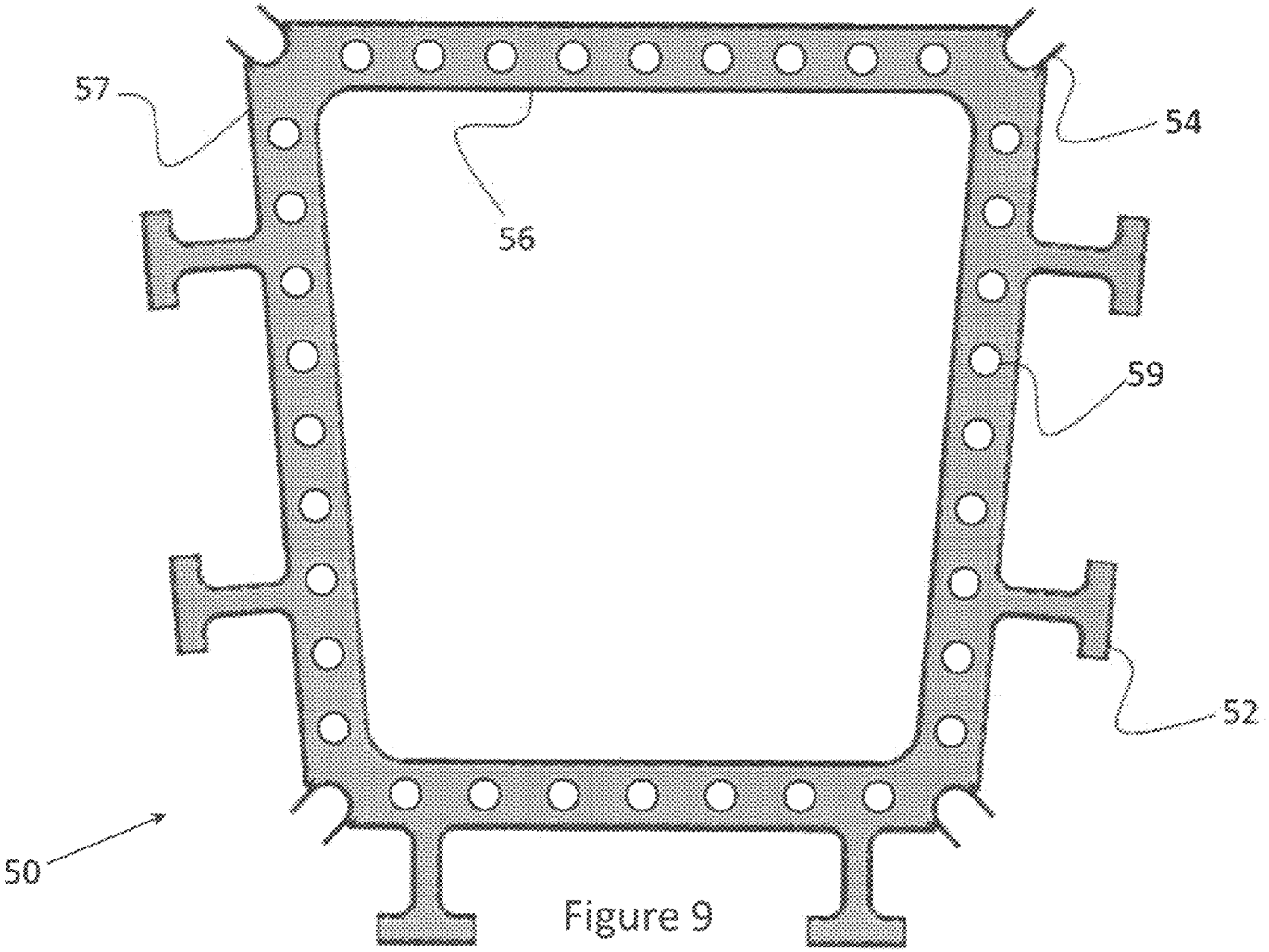
FIG. 9 is an end view of a reinforcement frame, illustrating a plurality of connectors for receiving and engaging elongate reinforcement members.
Figure 12:
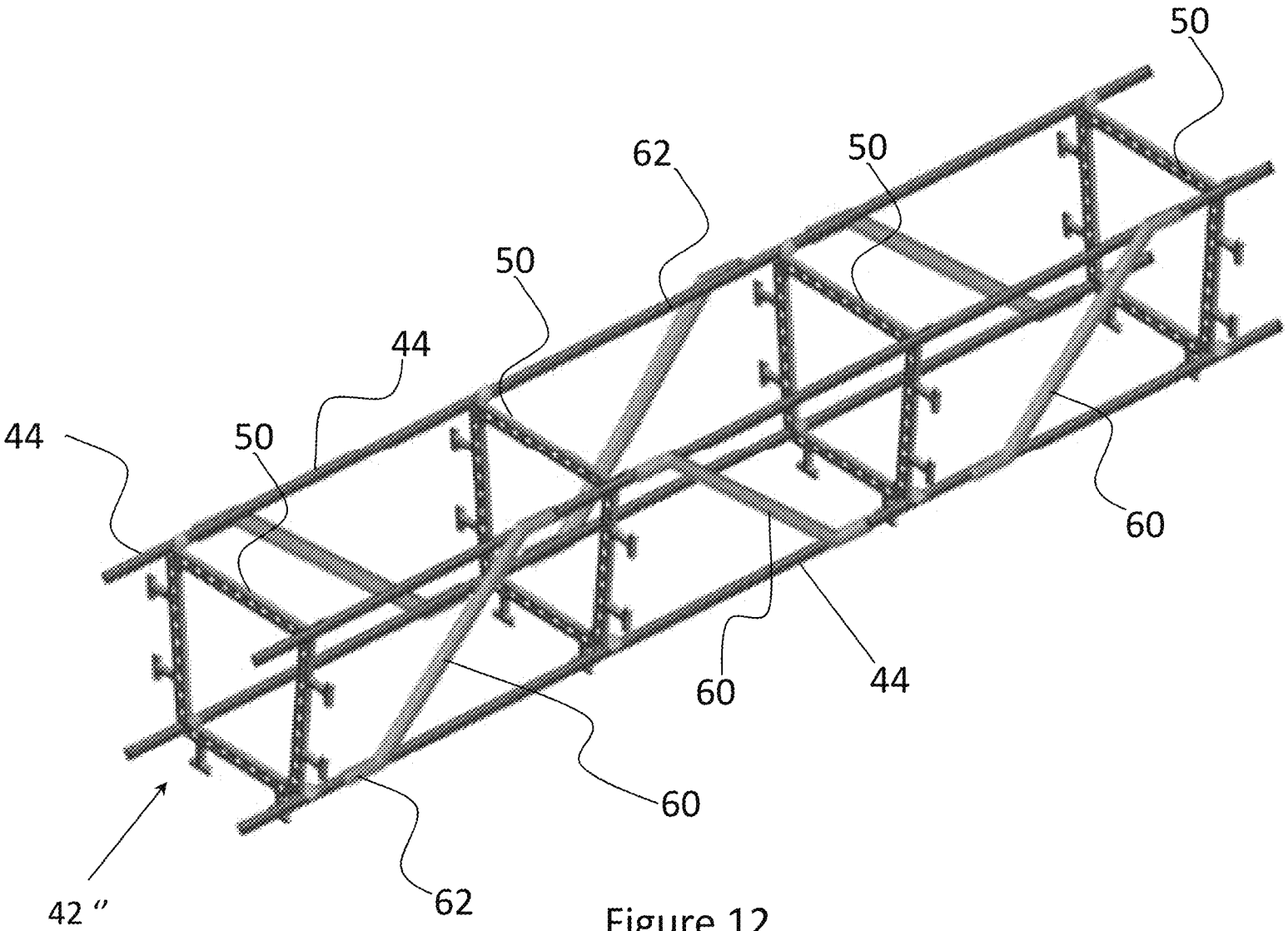
FIG. 12 is a perspective view of an assembled reinforcement truss, constructed from longitudinal rails braced with the pressed brace members of FIG. 11A.

FIG. 9 illustrates a spacer 50 which when suspended between a plurality of longitudinal members 44, form the truss 42", illustrated in FIG. 12.

The spacer 50 is manufactured from a sheet material having sufficient strength to support the necessary load requirements and being suitably resilient to be formed by, for example steel.

The spacer 50 once formed is substantially planar and includes a plurality of lightening holes 59 therethrough. The holes 59 assist is reducing unnecessary material mass and thereby improve material utilisation of the spacer 50. The holes 59 also facilitate material flow of concrete around the finished truss 42" reducing the occurrence of inclusions in the cured concrete 7 of the finished module 1.

The spacer 50 includes a plurality of cradles for receiving and retaining longitudinals 44. A plurality of proximal cradle 54 is disposed at each corner of the spacer 50. Each proximal cradle 54 is U-shaped and engages the spacer perpendicularly to each longitudinal 44.

The spacer 50 further includes a plurality of distal cradles 52. Each distal cradle 52 is T-shaped in frontal view and extends outwardly from three sides of the spacer 50. The T-bar of the distal cradle 52 is U-shaped in cross-section for receiving a brace member 60 or other cooperating structure within the formwork member 10. The distal cradles 52 can be configured to engage with channels 17 within the formwork member 10. Alternatively, the distal cradles 52 can engage with brace members 60 that extend in-plane with the spacer 50.

Figure 10A:
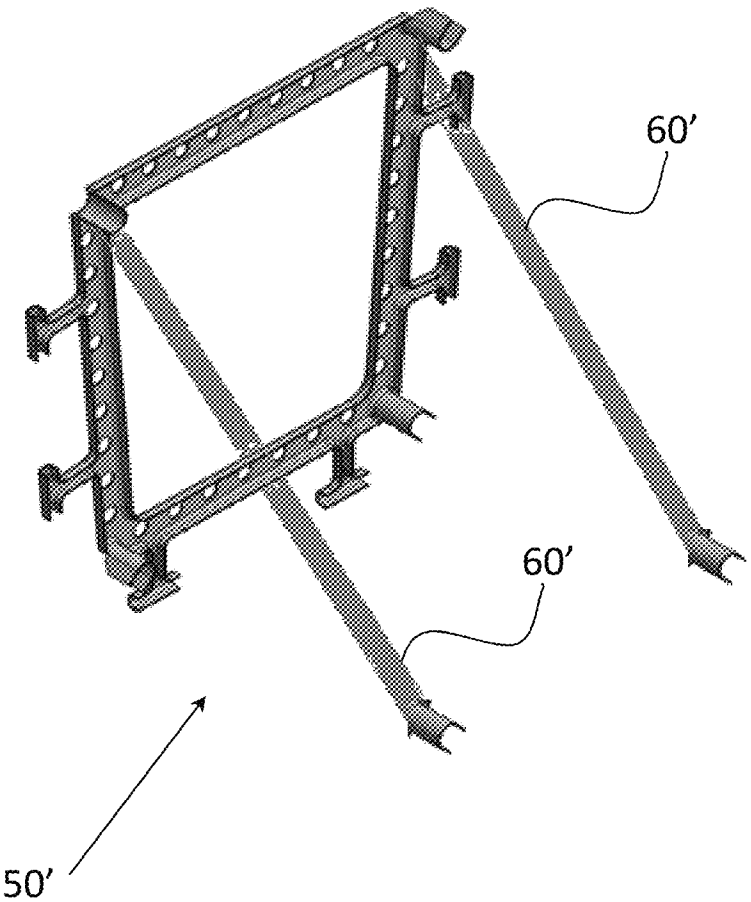
FIG. 10A is a perspective view of the reinforcement frame of FIG. 10, illustrating a pair of integrated brace members.
Figure 10:
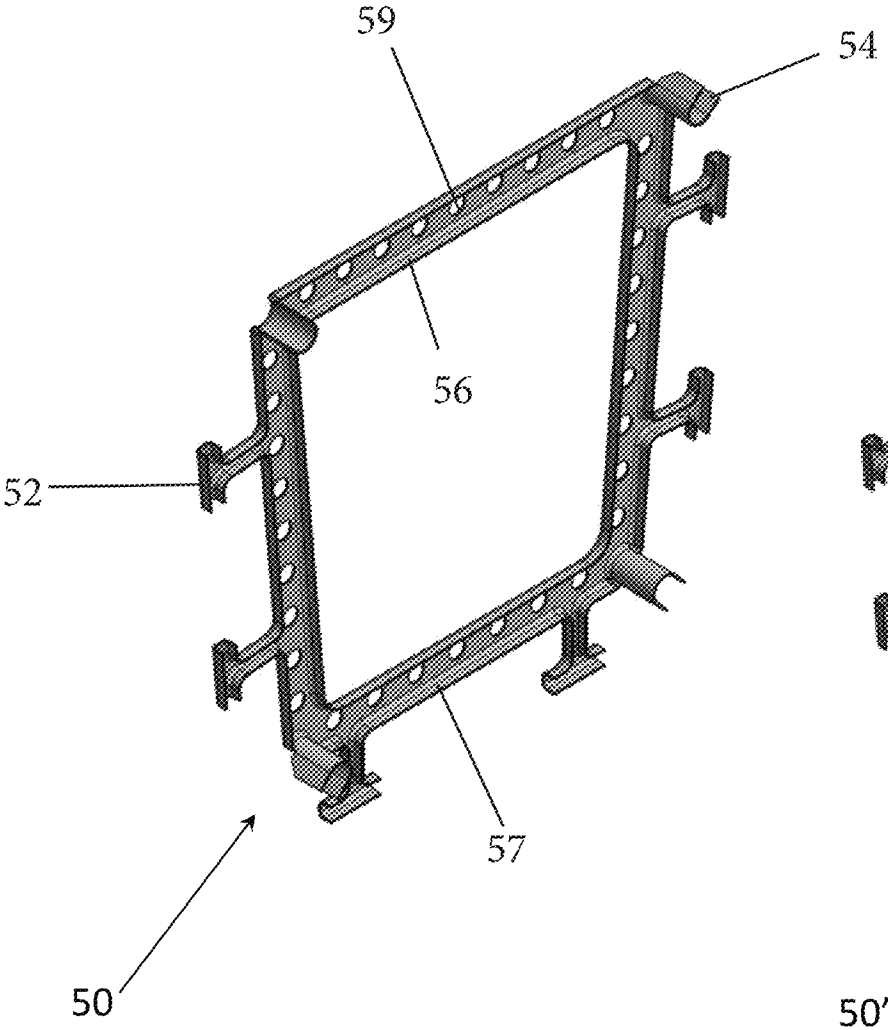
FIG. 10 is a perspective view of the reinforcement frame of FIG. 9, illustrating a substantially planar section having peripheral stiffening flanges.
Figure 11A:
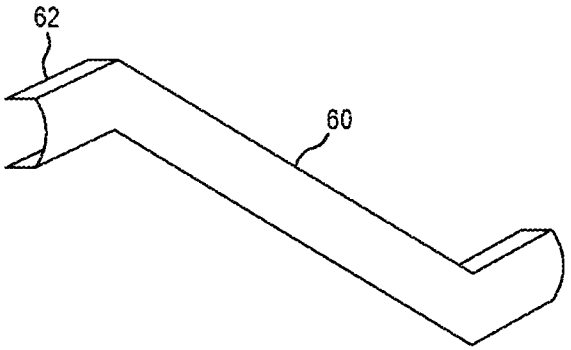
FIG. 11*a* is a perspective view of a pressed brace member, for use with a non-welded reinforcement structure.

FIG. 10 illustrates the spacer 50 in a perspective view. The inner perimeter 56 and outer perimeter 57 of the spacer 50 are flanged to provide additional stiffness to the substantially planar spacer 50. It is contemplated that the spacer 50' can be pressed or fabricated integrally with the brace 60' for engagement with longitudinal members 44, as illustrated in FIG. 10A. The brace 60 can also be formed as an independent member, as illustrated in FIG. 11A.

Figure 11:
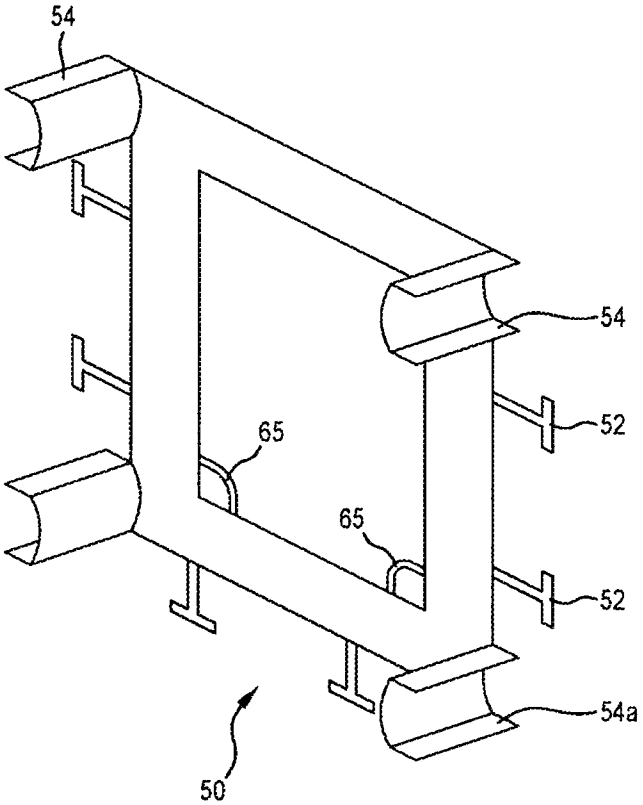
FIG. 11 is a perspective view of the reinforcement frame of FIG. 10, illustrating a pair of connectors.

The spacer 50 can further provide internal connectors 65, illustrated in FIG. 11. These connectors 65 can be used to support additional longitudinal members 44. Connectors 65 can also be used to attach tensioning members or tensioning cables to pre-tension the truss 42" prior to insertion into the formwork member 10.

Alternatively, the formwork member 10 can be pre-tensioned by attaching stranded cables to the base 12 and increasing the tension in the cables, such that the base 12 becomes cambered, upwardly. When the reinforcing concrete 7 is added to the formwork member 10 the additional weight of the concrete 7 counteracts the camber of the base 12, straightening the base 12 and also pre-tensioning the formwork member 10 in the process.

The brace member 60 is formed by pressing a metal, for example steel. The brace 60 includes flanges 62 at each end thereof. The flanges 62 are configured to cooperate with the proximal cradles 54 of the spacer 50. The flanges 62 can be welded, crimped, swaged, etc. to form a permanent connection with the proximal cradles 54 of the spacer 50.

FIG. 12 illustrates a truss 42" constructed using the spacer 50 and pressed braces 60. As the flanges 62 at each end of the brace 60 are open, the brace 60 can be slid into position between a pair of longitudinal members 44. The brace 60 is oriented between the longitudinal members 44 and rotated to bring the opposing end flanges 62 into engagement with each of the longitudinal members 44, respectively. This tensions the brace 60 and holds the brace 60 in position within the truss 42" without the need for welding the brace 60 into the truss 42".

The brace 60 can also be provided with holes or threaded holes (not illustrated) facilitating a bolted connection with the longitudinals 44 or the spacer 50.

As an alternative to welding, the spacer 50 can be adhesively engaged to the longitudinal members 44. Each cradle 54 provides a curved, smooth inner surface 54*a* to which an adhesive or epoxy can be applied for retaining the longitudinal members 44 thereto.

Alternatively to welding or adhesive, the brace 60 or spacer 50 can be dimensioned for an interference fit with longitudinal members 44 such that the members 44 are aligned with the cradles 54 of the spacer 60, or the flanges 62 of each brace 60, and pushed into locking connection with each other.

There are benefits gained in eliminating welding from high frequency bridges, thus pressed spacers 50 to form trusses 42" provide performance benefits as well as cost savings from their flat-pack transport configuration.

A nylon grommet (not illustrated) placed between the reinforcement 20 and formwork member 10 will allow for easy installation of the truss 42" and further provide a barrier to resist corrosion. The distal cradles 52 can be made from stainless steel or be coated with a corrosion-resistant resin.

An advantage of the spacer 50 is to eliminate welding to reduce possible fatigue. Eliminating welding of the spacers and braces also accelerates the assembly process.

Roll Formed Truss

Figure 22A:
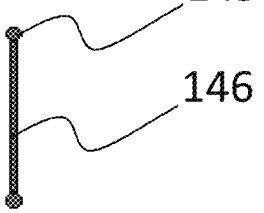
FIG. 22A is a cross-section of the frame of FIG. 22.
Figure 22:
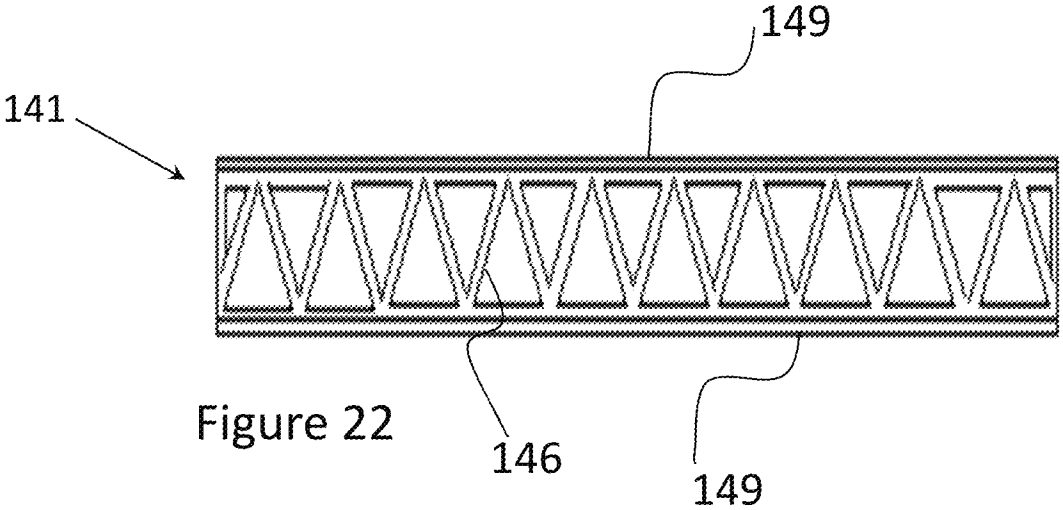
FIG. 22 is a side view of an alternative embodiment of a reinforcing frame for forming a truss.

FIGS. 22 and 22A illustrate a further embodiment of a frame 141 for grouping with similar frames 141 as a truss to form a lower portion of the reinforcement. Frame 141 comprises an intermediate member illustrated as a central web 146 bounded by two end flanges 149. The central web 146 is a smaller thickness than that of the end flanges 146 and is stamped or formed from a steel of other structurally suitable material. The end flanges 149 can be of square or round cross-section and can be formed integrally with the central web 146 or joined to the central web 146 in a secondary operation. This modular format allows central webs 146 of different thicknesses and dimensions to be attached to standard end flanges 149, thus allowing frames 141 of predetermined length to be formed.

FIG. 22A illustrates a section of frame 141 with rounded end flanges 149. The relative size of the end flanges 149 is not scaled to the thickness of the central web 146, and is merely representative of the cross-section contemplated.

Figure 23A:
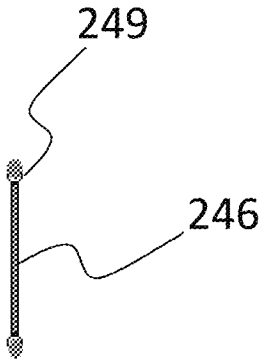
FIG. 23A is a cross-section of the frame of FIG. 23.
Figure 23:
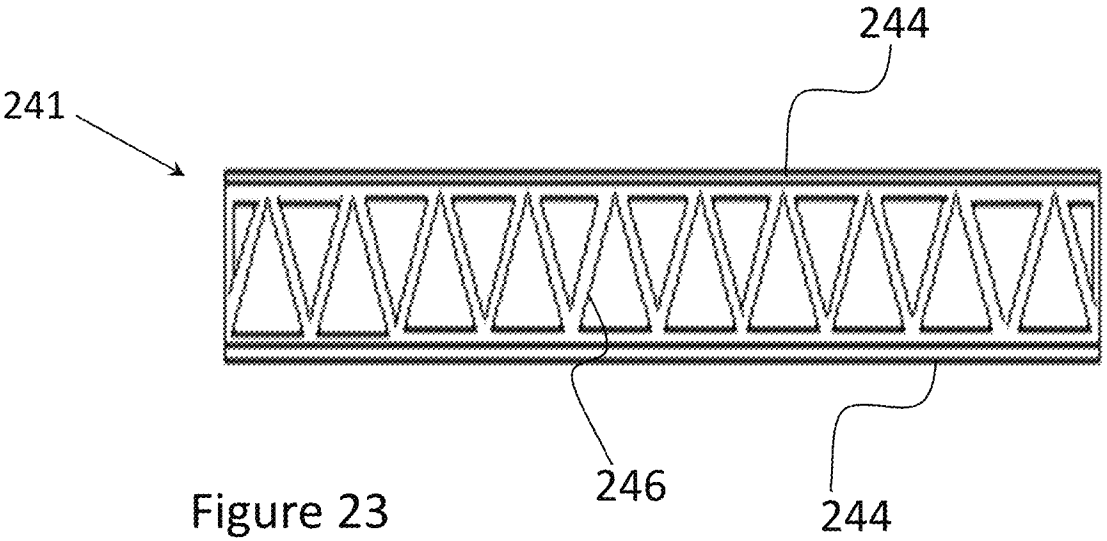
FIG. 23 is a side view of an alternative embodiment of a reinforcing frame for forming a truss.

FIGS. 23 and 23A illustrate a still further embodiment of a frame 241, wherein the central web 246 is manufactured separately to be engaged with standard pre-ordered longitudinal members 244. As with the previous embodiment, the central web 246 can be roll formed or stamped allowing the material utilisation to be efficient i.e. placed exactly, and only where needed. The roll formed, or stamped central web 246 can be manufactured in continuous lengths and cut to predetermined sizes. Furthermore, the continuous central web 246 can be manufactured in standard dimensions and gauges allowing for difference depths of frames 241 to be manufactured for different strength modules 1. The connection between the central web 246 and the longitudinal members 244 can be made such as to create a frame 241 for shipping or can be freighted as a flat pack, for assembly in a secondary location.

The longitudinal members 244 can be manufactured off the back of a truck in a continuous process like gutters.

The central web 246 is also contemplated to be formed of a honey comb structure with the reinforcement incorporated as a round bar or flat plate.

FIG. 23A illustrates a cross-section of frame 241, where a C-shaped end flange 249 is formed in opposing ends of the central web 246. The C-shaped end flange 249 is dimensioned to seat and/or engage a standard rebar or alternative longitudinal member 244. The end flanges 249 can be welded to the central web 246 or joined with an adhesive or other settable material.

Rebated Formwork

Figure 33:
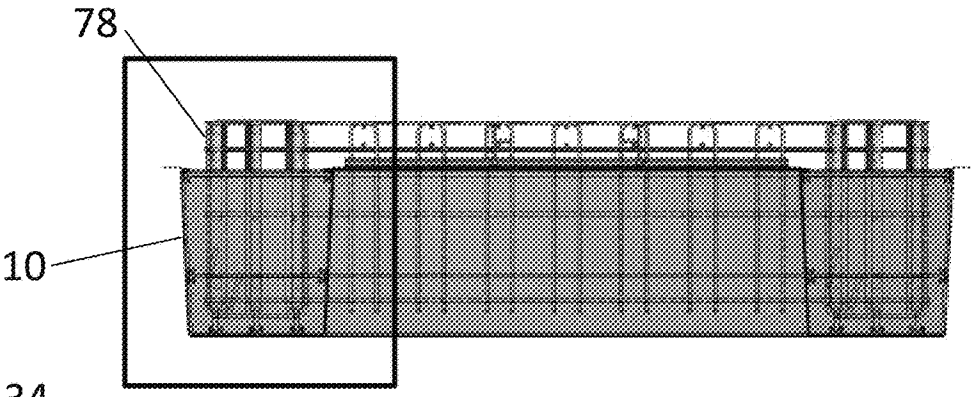
FIG. 33 is a side view of module illustrating the reinforcement in hidden view within the formwork.

FIG. 33 illustrates the reinforcement 20 in place within the formwork 10, such that the reinforcement protrudes from the top of the formwork 10. This relationship is better illustrated in FIG. 33A, which is an enlarged view from FIG. 33. The formwork 10 is shown in hidden line in FIG. 33A, to clearly illustrate the location of the reinforcement 20 within the formwork 10. As such, the feet 74 of the truss 42 can be seen interconnected with the channels 17 within the trough 82. An additional cross-brace (also illustrated in FIG. 31A) is shown tying together the two opposing sides of trough 82. The cross-brace 77 is made from a steel bar approximately 10-30 mm in diameter and having a foot 74 at either end thereof. This allows the cross-brace 77 to slide into a pair of aligned channels 17 on side walls 89 of the trough 82.

Figure 33A:
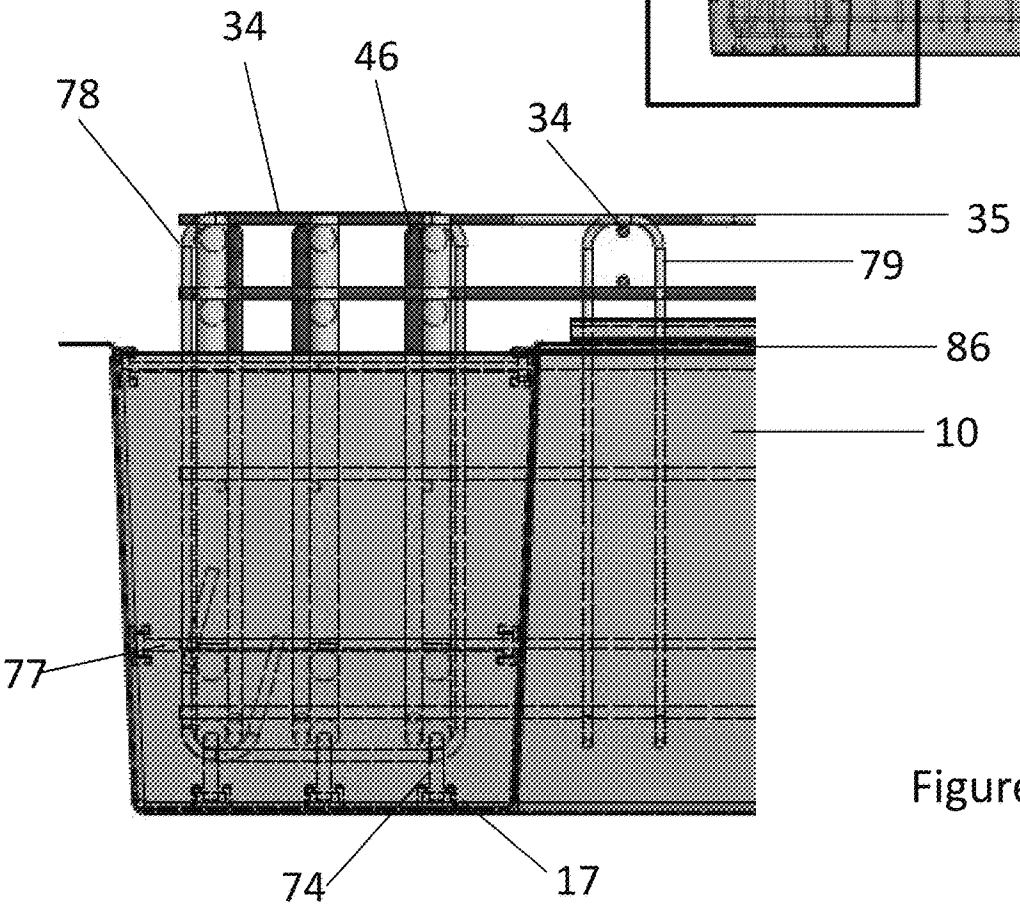
FIG. 33A is an enlarged view of the boxed section of FIG. 33, illustrating engagement between the reinforcement and the formwork, and the deck protruding above the formwork.

The formwork 10 of FIGS. 33 and 33A is intended to be capped, such that an edge profile is introduced to the modules once in place. This allows differing finishes to be achieved on pouring the cement or concrete of the top deck.

Deck Capping

To simplify the concrete placement into the positioned formwork 10 a sliding screed board (not illustrated) is used that runs between the outside form of the formwork 10 to guide and limit the concrete cover to a predetermined thickness when pouring the deck. The outside form of the formwork 10 can be manufactured to provide a guide and thereby produce a required camber to the road surface and further provide grooves or imprints to adhere the road surface or to allow better grip to the surface.

Figure 37C:
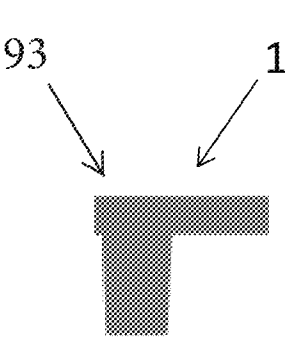
FIG. 37C is a sectional profile of a module having no side shield (an internal module for use in a multi-module bridge span)
Figure 37B:
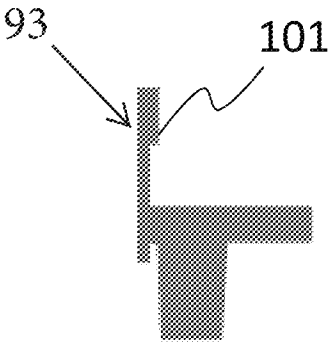
FIG. 37B is a sectional profile of a side shield configured for use as an alternative road safety barrier.
Figure 37A:
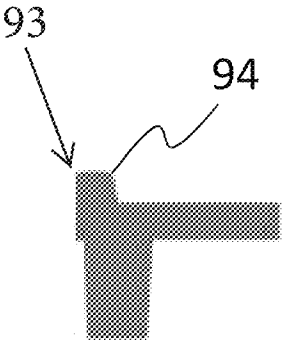
FIG. 37A is a sectional profile of a side shield configured for use as a kerb to the module.
Figure 37:
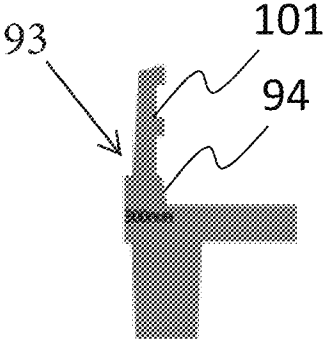
FIG. 37 is a sectional profile of a side shield configured for use as a high strength barrier.
Figure 38:
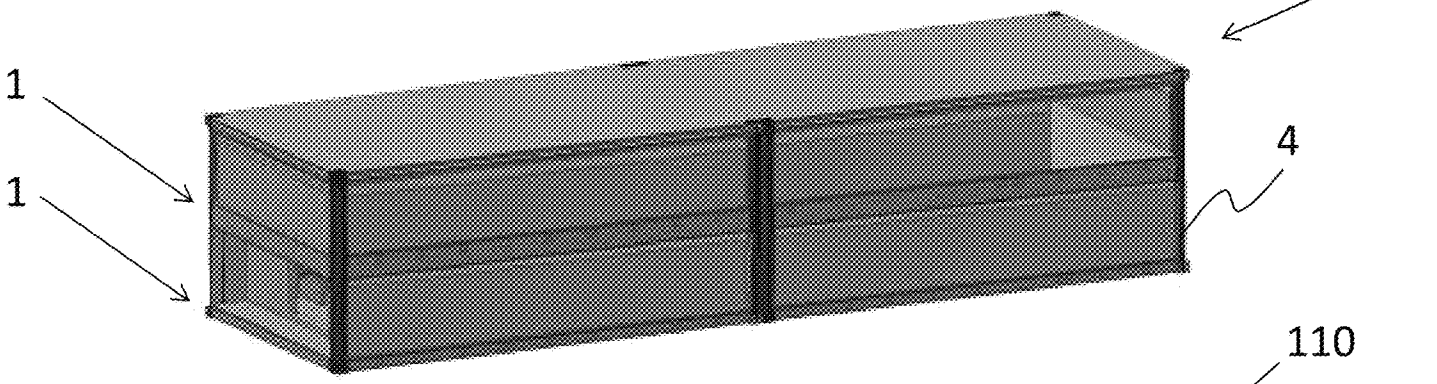
FIG. 38 is a pair of modules supported one above the other, in a compacted configuration and held in engagement by a plurality of reinforcement columns.
Figure 38A:
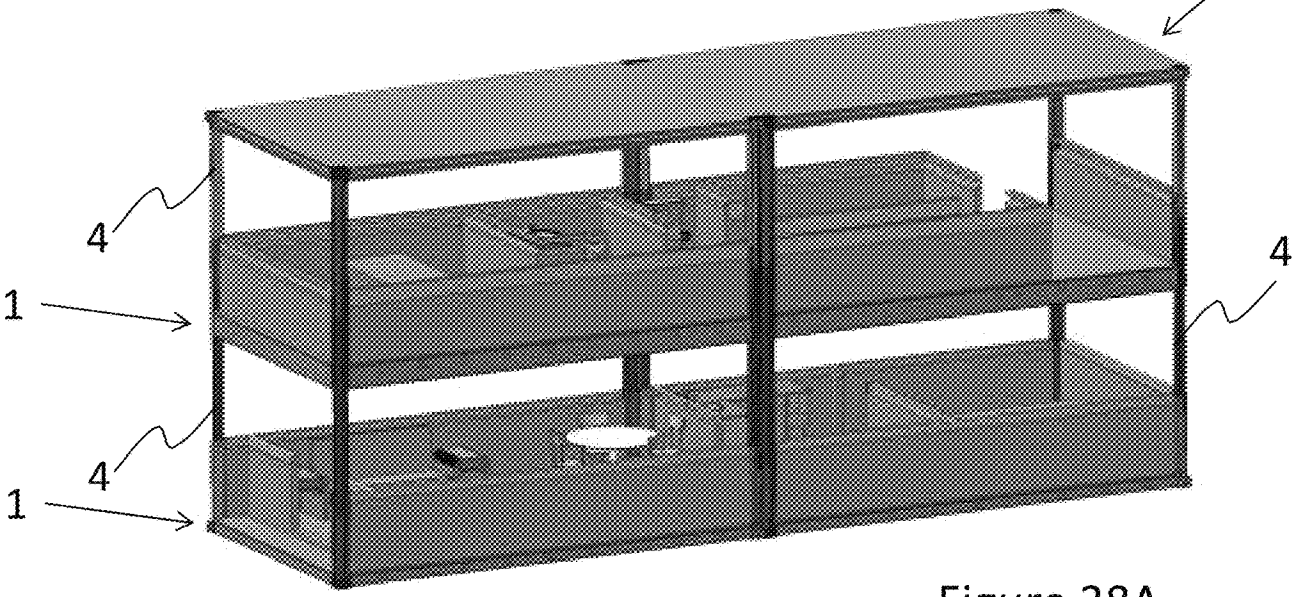
FIG. 38A is the pair of modules of FIG. 38 in an expanded configuration, still engaged to one another by the plurality of reinforcement columns.
Figure 39:
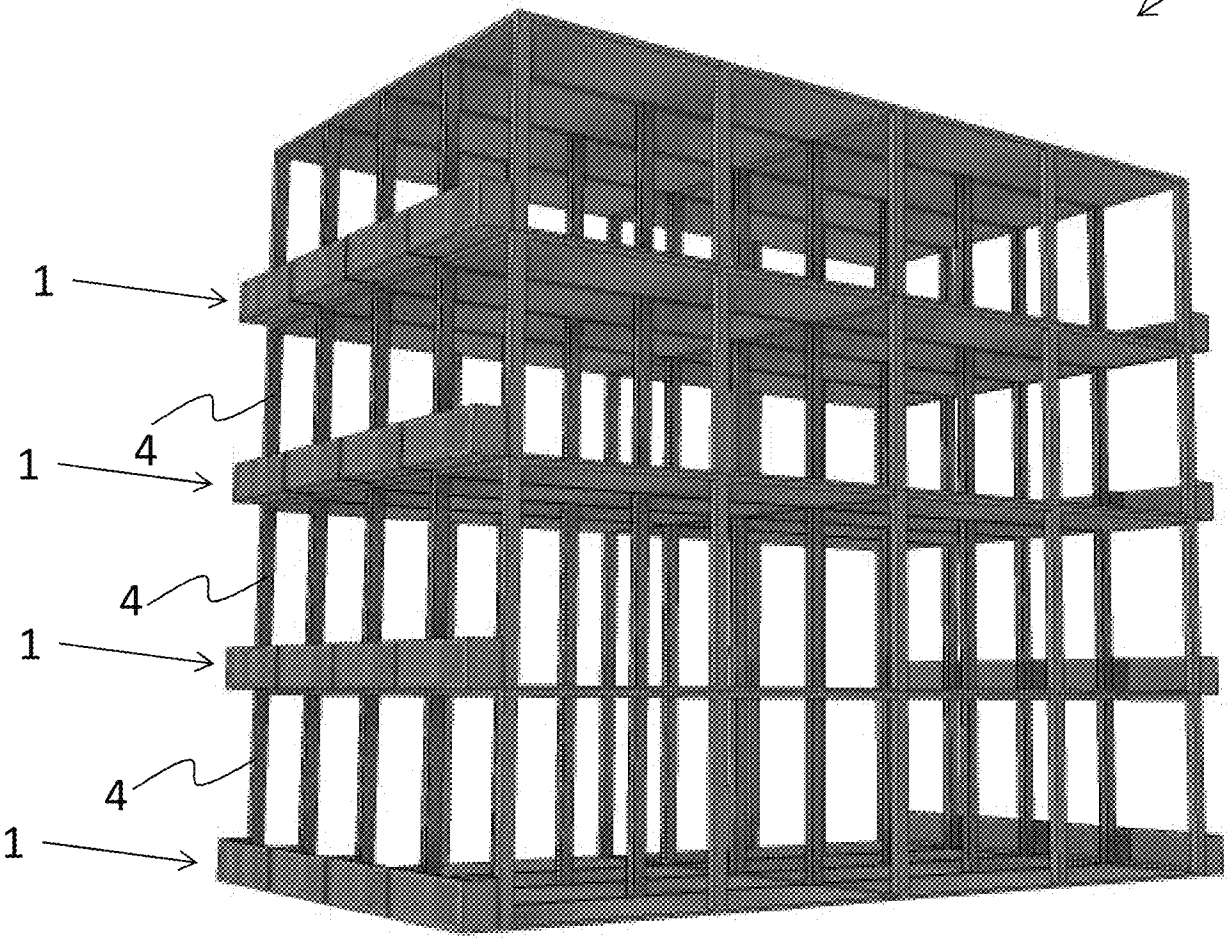
FIG. 39 is a plurality of the pairs of modules of FIG. 38 axially co-aligned to form a multi-storey block, the plurality of reinforcement columns also being aligned to receive a cement or concrete mix.
Figure 40:
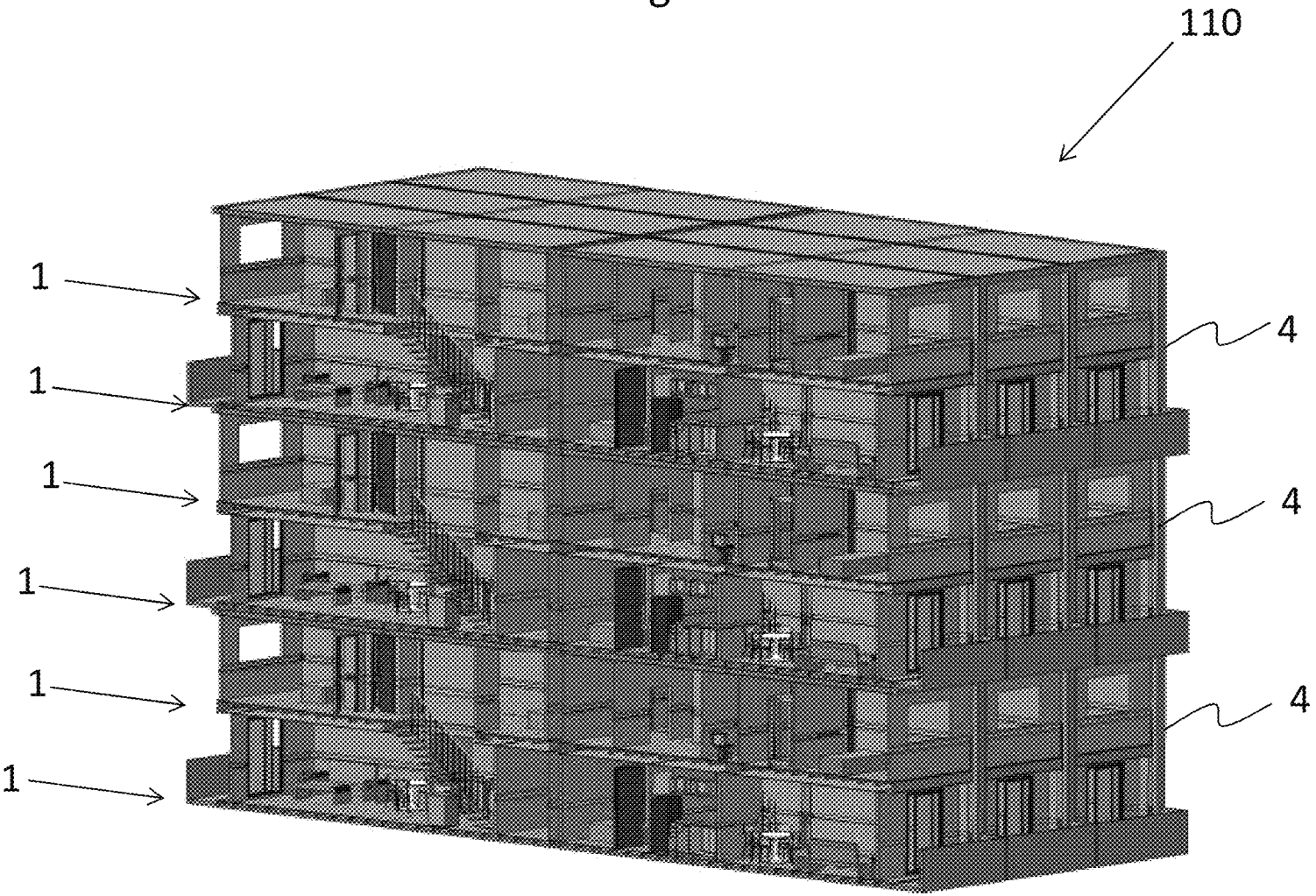
FIG. 40 is a perspective view of the multi-storey block of FIG. 39, configured for use as a multi-person dwelling or residential block.

A plurality of different cappings 93 are contemplated that can provide a flat module 1, a kerbed module, or a series of structural safety barriers. FIGS. 37 to 37C illustrate a number of different forms. FIG. 37 illustrated a high strength barrier that is integrated into the edge regions of the module 1. FIG. 37A illustrates a low kerb form that runs longitudinally along the module 1. FIG. 37B illustrates a safety barrier for such as a guide rail barrier or similar. FIG. 37C illustrates a flat edge module 1 that can be used alone or in combination with similar modules 1 arranged in a side-by-side configuration.

Figure 30B:
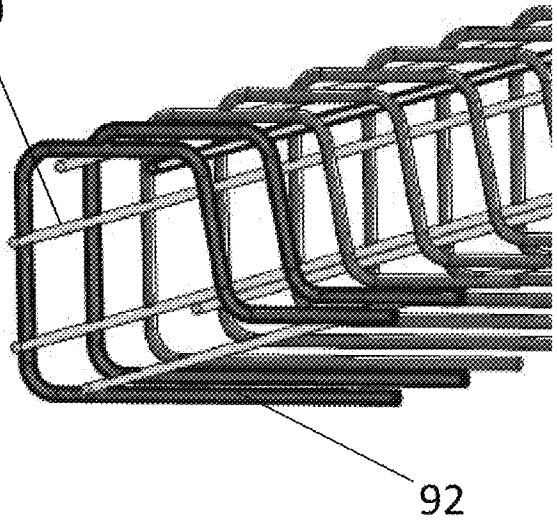
FIG. 30B is a perspective view of the wall supporting structure of FIG. 30A.
Figure 30A:
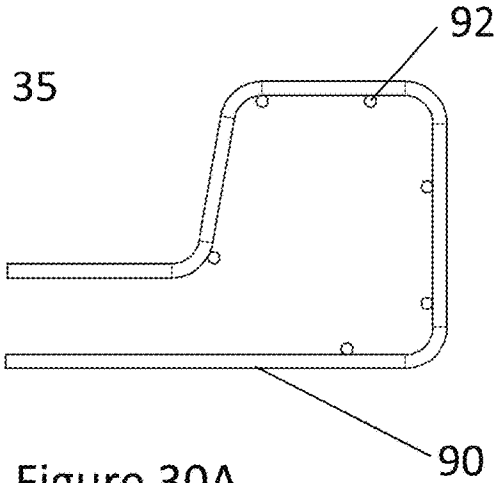
FIG. 30A is a side view of the wall supporting structure in isolation from the reinforcement.
Figure 30:
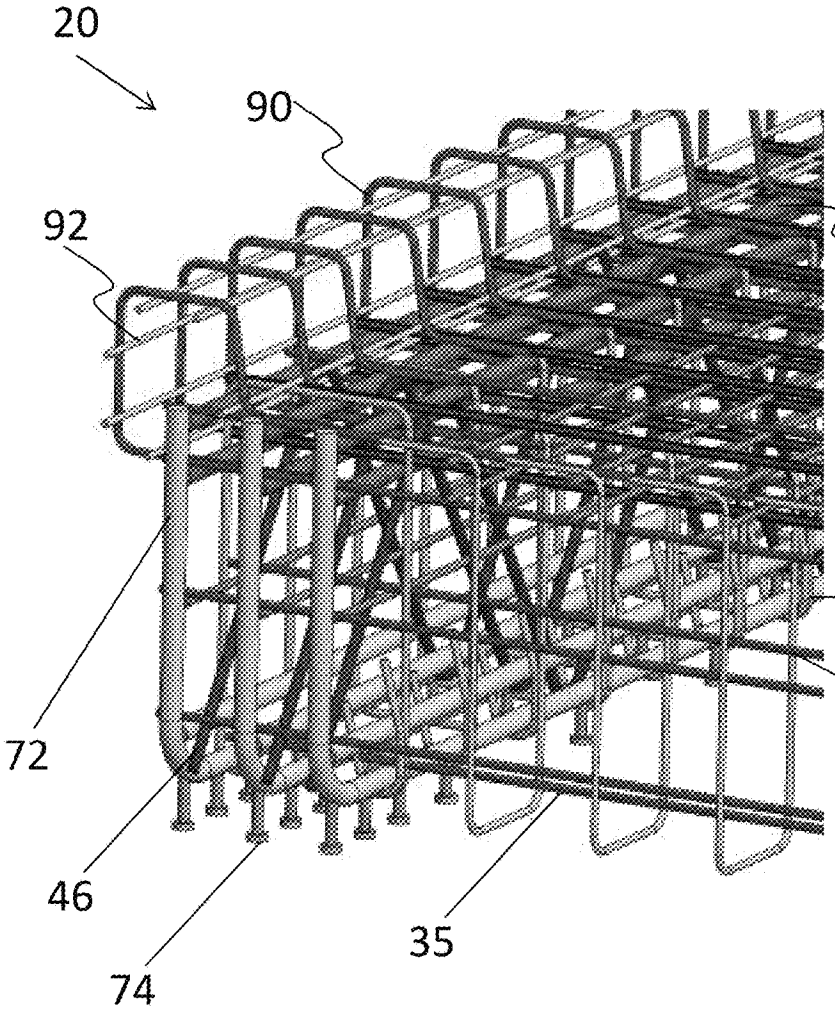
FIG. 30 is a perspective view of the reinforcement further comprising a wall supporting structure.

The different shapes of capping 93 are formed around a structural framework comprising a series of wall supports 90 and wall braces 92, illustrated in FIG. 30B. The wall supports 90 of FIG. 30B are formed from steel bar, rolled into an open loop form, see FIG. 30A. The plurality of wall supports 90 are spaced along a plurality of wall braces 90 at regular intervals therealong. The wall supports 90 and wall braces 92 of the capping 93 are then integrated with the trusses 41 of the reinforcement 20, as illustrated in FIG. 30. FIG. 30 illustrates a kerb form; however, a shallower wall support 90 can be employed to provide a level, flat finish across the deck of the module 1. Alternatively, a raised wall support 90 can be used to provide a higher more structural barrier capping to the module 1.

The wall supports 90 and attached braces 92 are aligned with the cross-wires 35 of the upper reinforcement 30 and extend laterally across the reinforcement 20 beyond the truss 41. As illustrated in FIG. 31 a shield panel 94 is attached to the outer flanges 83*a* of the formwork 10. The shield 94, as illustrated in FIGS. 31 and 31A, provides an extension to the formwork 10 that encases the wall supports 90, such that when the concrete is introduced to the formwork 10 the completed capping 93 is integrally formed with the module 1. The shield 94 can further provide apertures as a guide for horizontal struts 96 that act as mounts for tie-downs into the edge of the finished module 1. The horizontal struts 96 are engaged with the reinforcement 20 and become encased within the module 1 as the concrete cures in the formwork 10. The horizontal struts 96 then provide a mounting for additional barriers or connections to the module 1. The embedded struts 96, when engaged to the reinforcement 20, can also be used when lifting and locating the modules 1, before the concrete is introduced.

An additional connection between the upper reinforcement 30 and the formwork 10 is provided by way of a plate tie-down 88, illustrated in FIG. 31A. The tie-down 88 is mounted to the upper deck via cross-wires 35 and/or line wires 34. The tie-down 88 can be welded or bonded to the deck and has a foot 74' at a free end thereof. The foot 74' can be welded or bonded to the stiffening plate 86 of the formwork 10 to additionally reinforce the formwork 10 prior to concrete being introduced. This provides additional stiffness and reduces bending during transportation of the formwork 10.

Figure 41:
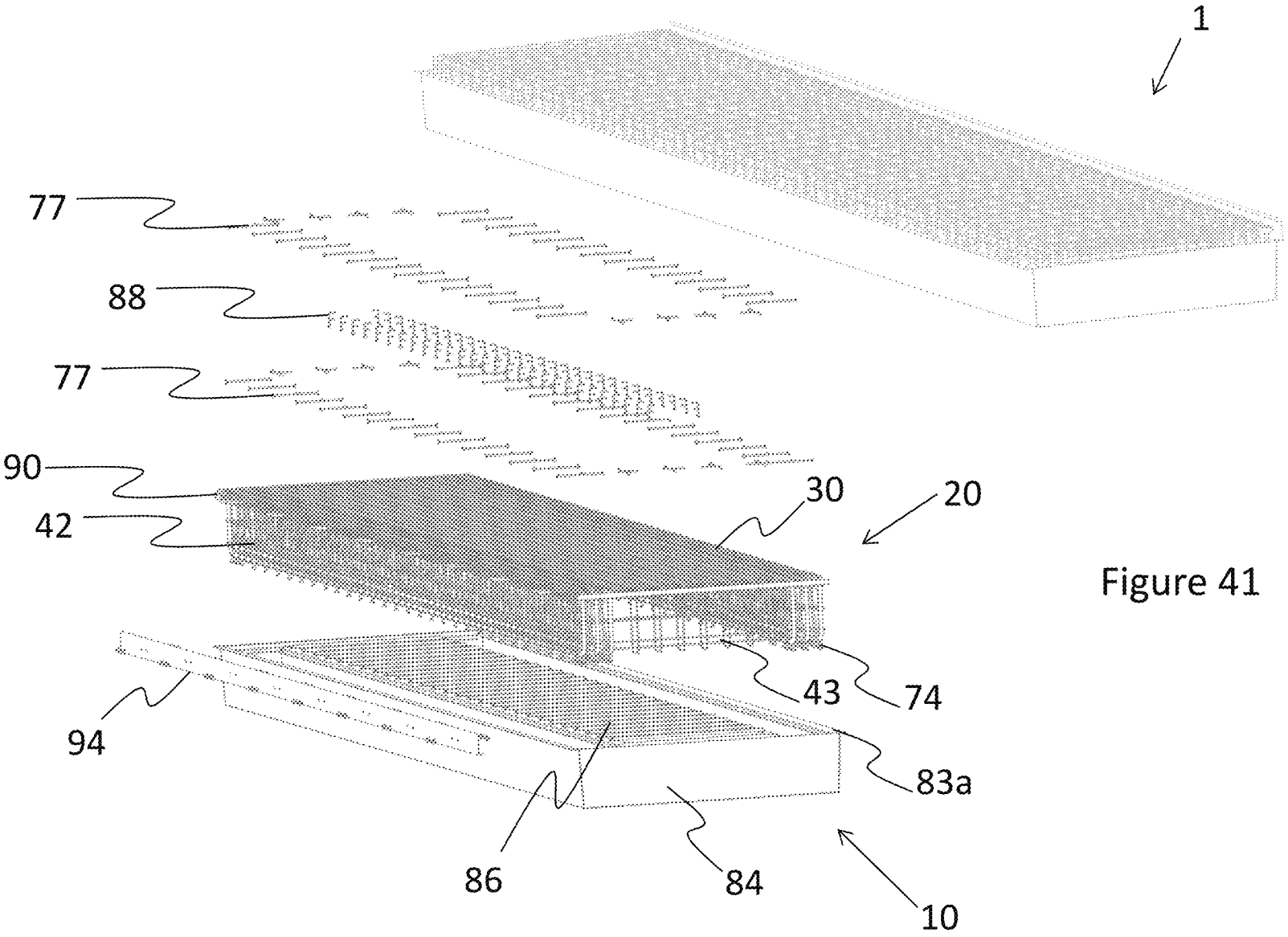
FIG. 41 is an exploded view of a module according to one embodiment of the invention.

An exploded view of a full module 1 is illustrated in FIG. 41, having capping 93 in the form of a kerb on one side, and a flat, level deck 32 on the opposing side of the module 1. The exploded view illustrates a plurality of tie downs 88, cross braces 77 and the shield 94.

Pre-Formed Reinforcement Member

FIGS. 13 to 19 illustrate a prototype scale model bridge 100 (full size: 6 metre span) to aid with development. The scale model was used to validate the modules 1' in a stacked configuration, for transportation in a shipping container, illustrated in FIG. 18. A partially assembled bridge 100 is further illustrated in FIG. 19, using the components of the scale model of module 1'.

Figure 13:
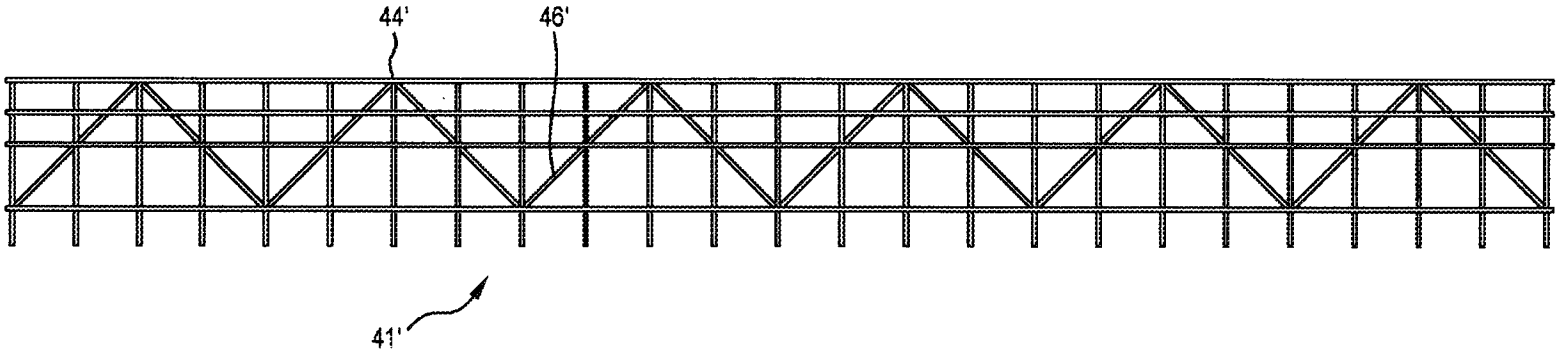
FIG. 13 is a top view of an alternative truss, illustrating horizontal, vertical and diagonal bracing of the truss.
Figure 14:
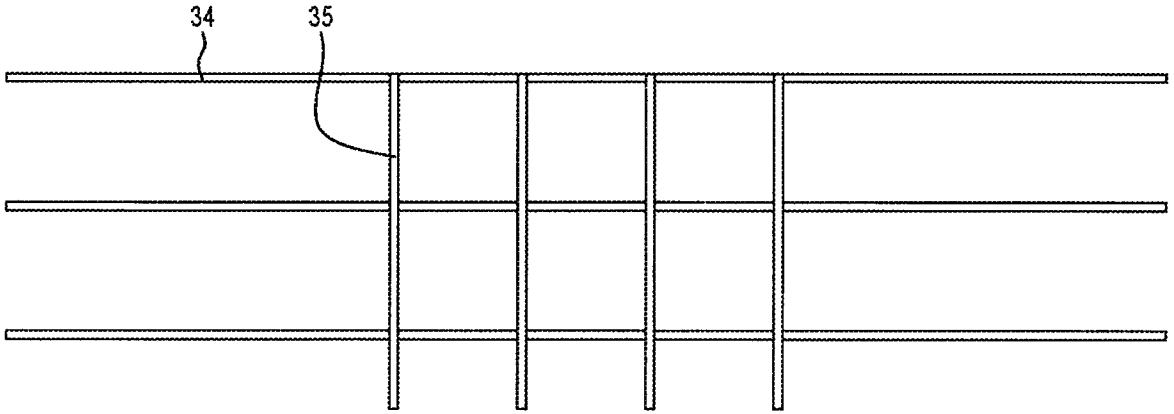
FIG. 14 is a top view of an end truss for disposing in an end portion of the formwork.
Figure 16:
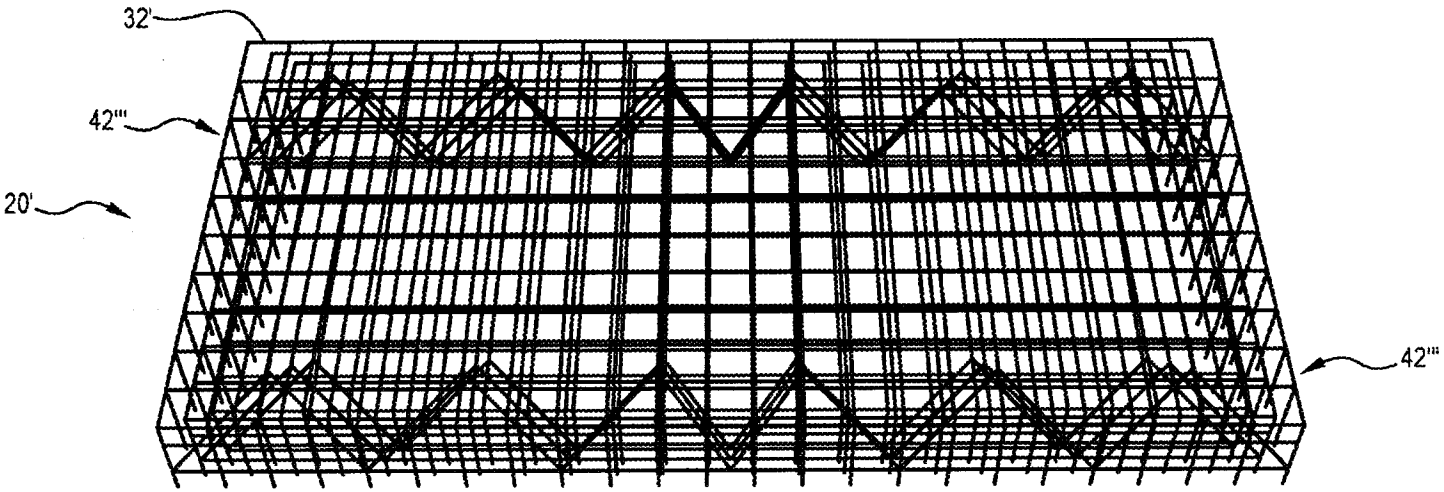
FIG. 16 is a perspective view of a complete reinforcement assembly, illustrating an upper portion comprising a plurality of decks, two opposing side trusses and two opposing end trusses configured to cooperate with the formwork of the bridge module.

Particularly, FIGS. 13 to 15 illustrate the individual components that make-up reinforcement 20' which is illustrated in FIG. 16.

FIG. 13 is a photograph of a scale model of a frame 41'. The frame 41' comprises a plurality of longitudinal members 44' and an intermediate member 46' that traverses the longitudinal members 44' back and forth in a sinusoidal waveform. The top two longitudinal members 44' align with the two decks 32 and replace the intermediate member 46 of the frames 41 of the deck 32 (as described in earlier embodiments).

A plurality of frames 41' can be grouped to form a truss 42'''. The reinforcement 20' comprises two trusses 42'', both of which extend the span of the module 1'.

FIG. 14 illustrates an end truss 43 formed by welding a plurality of line wires 34 to a plurality of cross-wires 35. The reinforcement 20' comprises two end-trusses 43, both of which extend across the width of the module 1'. The reinforcement 20' is designed so that line-wires 34 extend upwardly into the deck 32'providing structural support to the reinforcement 20'. The line-wires 34' at the ends of the end truss 43 have sufficient length to extend out to the sides, which allows the line-wires 34 to be inserted into the trusses 42''.

FIG. 15 illustrates a deck 32' formed by welding a plurality of line wires 34 to a plurality of cross-wires 35. The reinforcement 20' comprises two decks 32', both of which extend across the width and along the span of the module 1'.

The deck 32' provides free ends to the line-wires 34 and cross-wires 35 that extend outwardly in the deck plane. These free ends can be inserted into the trusses 42''' and end trusses 43 of the lower portion 40' of the reinforcement 20'.

The trusses 42''', the end trusses 43 and the decks 32' are combined to form the reinforcement 20', which is inserted into formwork member 10'. The lower portion 40' of reinforcement 20' is rectangular and extends fully around a perimeter of the formwork member 10', which is illustrated in FIGS. 17A-17C.

Formwork member 10' is fabricated from sheet steel and is dimensioned to correspond with reinforcement 20'. The formwork member 10' includes an upper portion 11' and a base 12'. The trusses 42''' extend downwardly into the base 12' of the formwork member 10' and the land portion 18' seats within the reinforcement 20' such that the lower portion 40' of the reinforcement 20' fully surrounds the land portion 18'.

Formwork member 10' includes two engagement members illustrated as side flanges 6. These flanges 6 are used to engage the module 1' with a subsequent module or with fixed structure for supporting the bridge 100. The flanges 6 extend outwardly from the formwork member 10' defining shoulder 26' upon which the weight of the module 1' is supported. Each flange 6 is substantially horizontal to overlap with a flange of a subsequent module 1'. The flanges 6 can be constructed to interleave or interlock with the flanges of another module (not illustrated).

The end walls 16' extend from the base 12' upwardly and rise above the flanges 6. The distance by which the end walls 16' extend the flanges 6 is greater than the depth of the deck 32, such that the reinforcement 20' can be fully encased in concrete and not exposed to the elements in the finished module 1'. If the reinforcement 20' is exposed or too close to the outer surface of the concrete 7 the reinforcement 20' (if iron based) will start to corrode and deteriorate the structural rigidity and performance of the module 1'.

Figure 18:
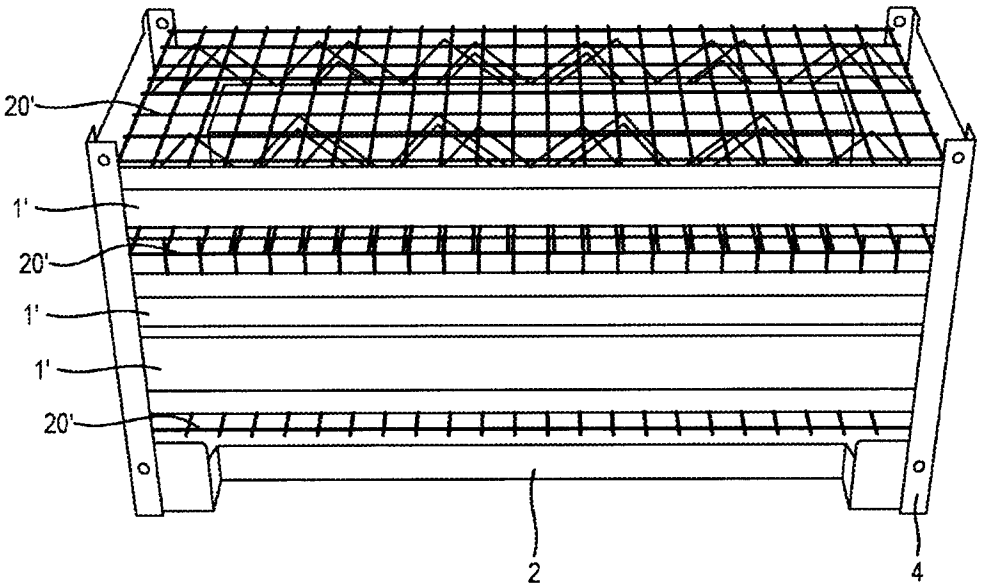
FIG. 18 is a perspective view of a plurality of bridge modules, stacked for transportation on a pallet.

The reinforcement 20' is inserted into the formwork member 10', as illustrated in FIG. 18. Where the reinforcement 20' and formwork member 10' are to be transported simultaneously, the ability of the components to nest is advantageous. The dimensions of the modules 1' are such that three modules 1' and an anchor member 2 can be packaged into a shipping container. This facilitates transport of the modules 1' over great distances. The reinforcement 20' is protected by both of the shipping container and the formwork members 10'. Furthermore, the available resources for transporting shipping containers, whether by sea or by land, can be easily applied to the transportation of modules 1'.

Packing the modules 1' into a container facilitates transport and handling of the modules 1', resulting in significant transport cost savings and enabling the modules 1' to have a global reach.

Four reinforcement columns 4 are secured around the modules 1' and fixed to the anchor 2 for transportation. The modules 1' can also be fixed to the reinforcement columns 4, creating a solid structural container suitable for shipping, trucking, etc. The columns 4 are detachable from the modules 1' and structurally hold the container package together.

FIG. 19 illustrates the modules 1' and anchor 2 of FIG. 18 laid out in an overlapping, spaced configuration ready to receive a pourable concrete mixture that will set across all three modules simultaneously. The reinforcement 20' is only complete in one of the modules 1' with a single deck 32 positioned in the remaining two modules 1' to represent the workings of the invention. After the modules 1' arrive at the construction location, the modules 1' are manoeuvred into their predetermined positions, at which time rails 67 or culvert side-form sections (not illustrated) can be installed. The modules 1' are then ready to receive the wet concrete mix.

It is contemplated that each of the individual forms of frame 41, 41', 141 and 241 can be sold in kit form, to provide for assembly in a secondary location, after manufacture. This provides flexibility and packaging advantages for shipping and transportation of the frames to a location where the reinforcement 20 is to be constructed.

Module Nesting

Figure 34:
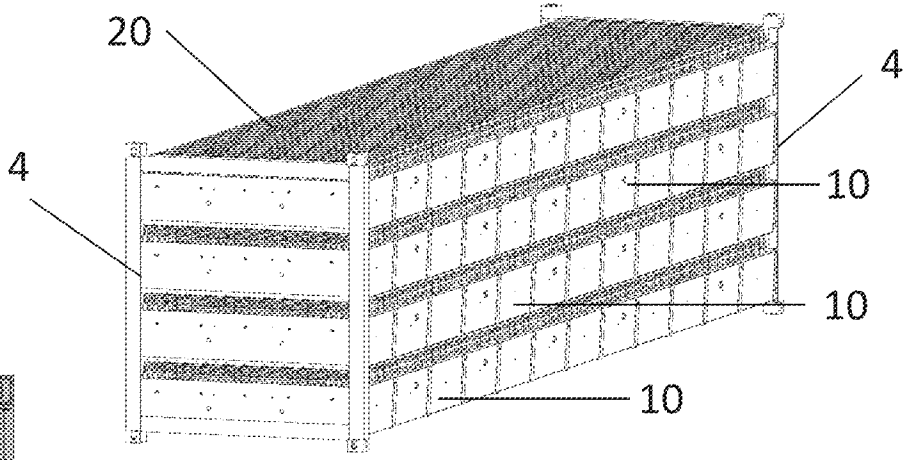
FIG. 34 is a perspective view of a plurality of modules nested for transportation between four columns, illustrating a possible packaging arrangement within a shipping container.
Figure 34A:
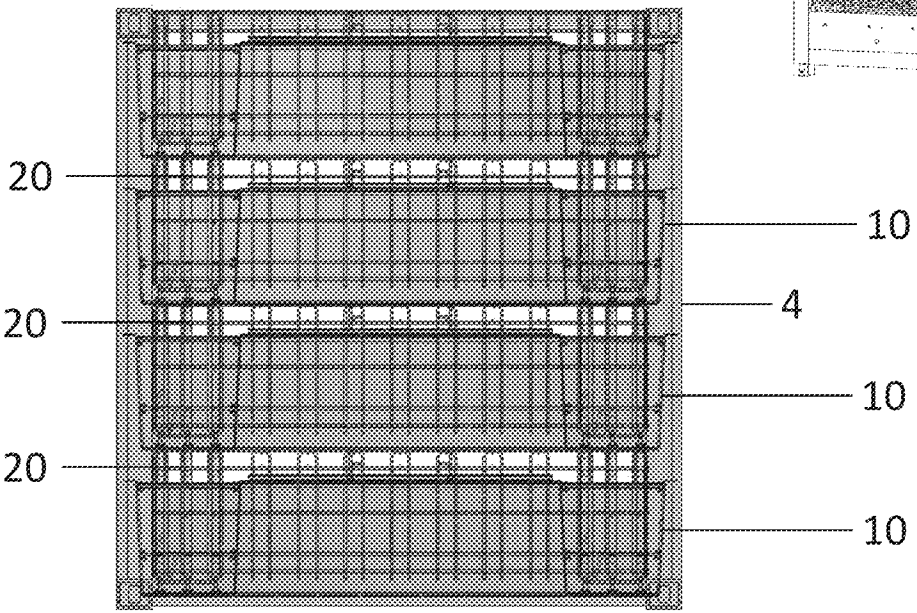
FIG. 34A is an end view of four construction modules stacked for transportation within a shipping container, illustrating a reinforcement housed within each of the formwork panels.

The modules 1 are designed to nest efficiently. Four modules, as illustrated in FIG. 34 can be configured to stack within the dimensions of a standard ISO shipping container. The reinforcement columns 4 are used to constrain the modules 1 and also to structurally stiffen the stacked modules 1 during transit. These reinforcement columns 4 can be returned after use and reused for subsequent module transportation. FIG. 34A is a detailed end view of the container of FIG. 34, with the reinforcement 20 overlaid in dotted lines. It can be seen that the upper reinforcement 30 supports a formwork 10 above. The lower reinforcement 40 in connection with the channels 17 of the trough 82, load into the upper reinforcement of the adjacent module 1 below. This nesting provides an efficient package and further loads the modules 1 so as to minimise unnecessary damage during transport. There is no danger of damage to the concrete as this is only introduced into the module 1 once the formwork 10 and reinforcement 20 are located in situ.

Bridge Construction Method Using Pre-Formed Modules

Figure 20A:
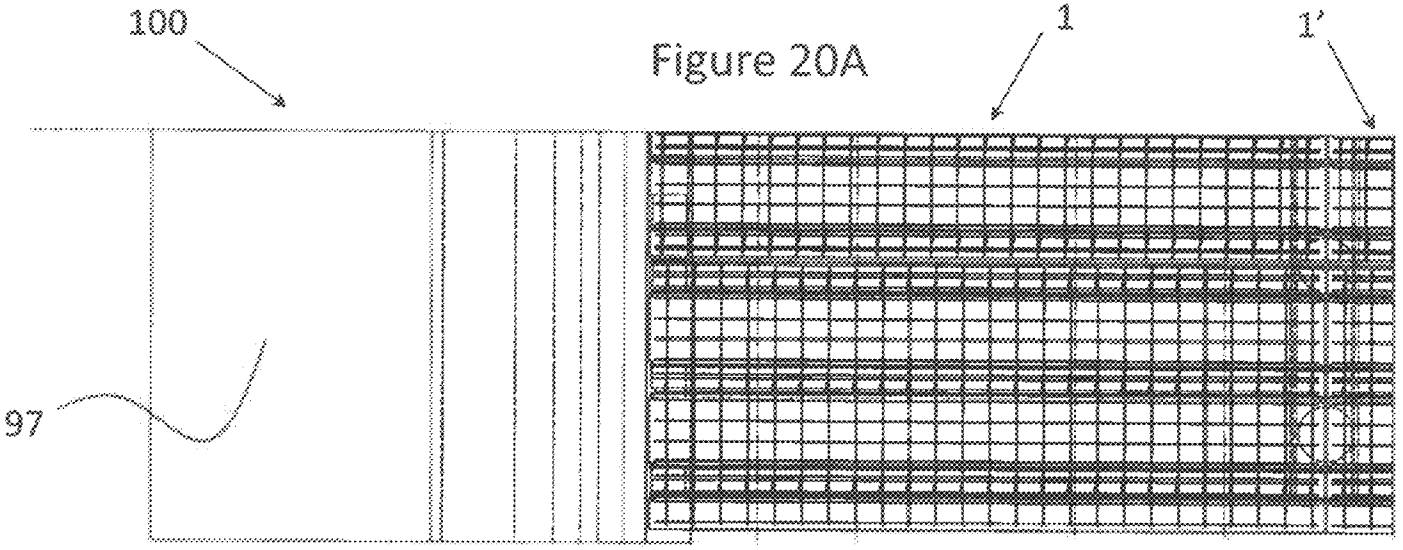
FIG. 20A is a top view of the bridge of FIG. 20.
Figure 20:
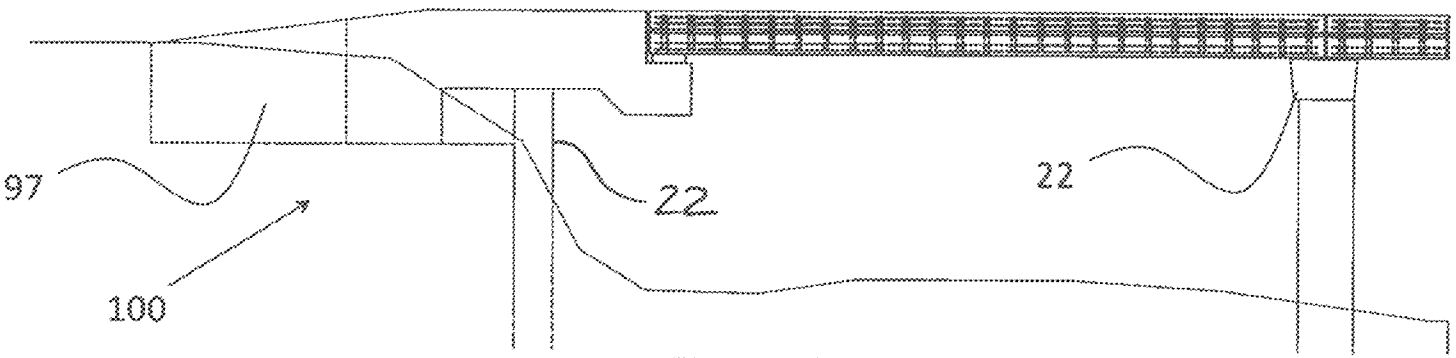
FIG. 20 is a side view of a bridge constructed using bridge modules.
Figure 21A:
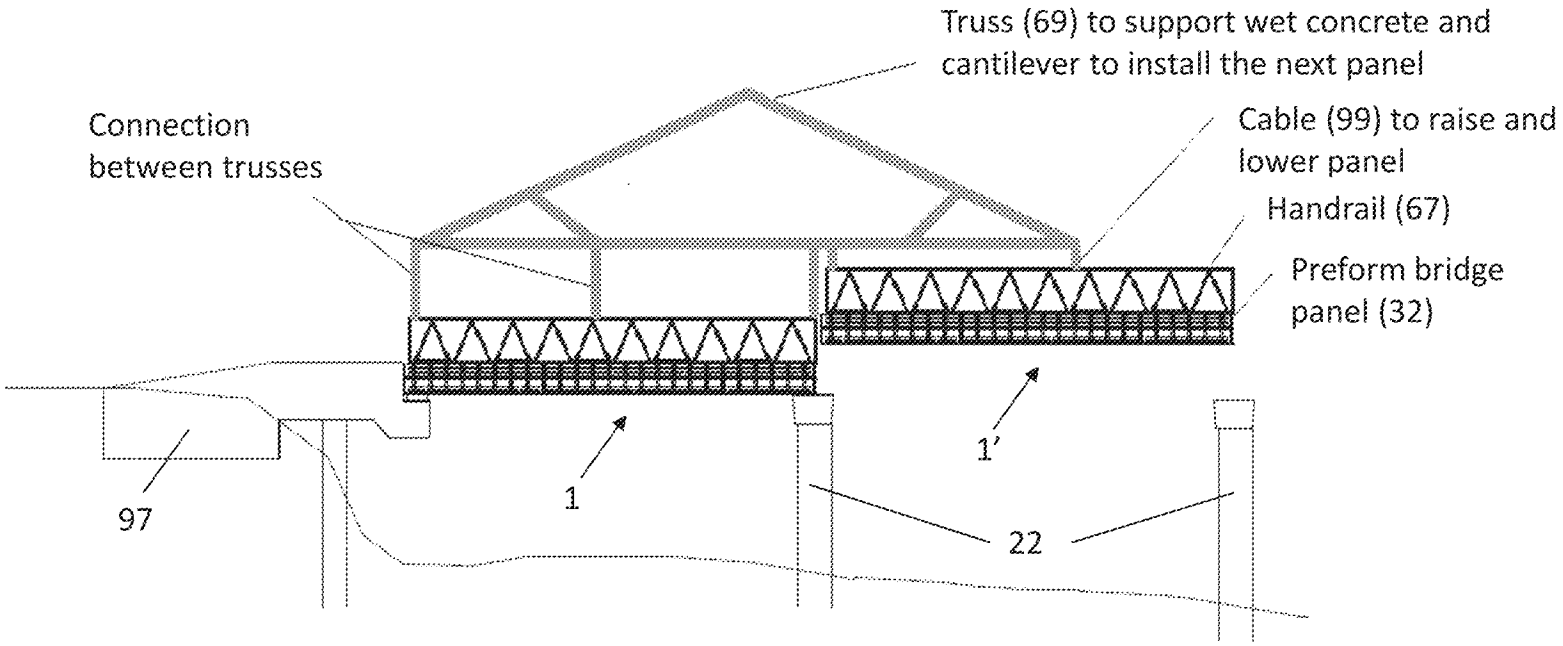
FIGS. 21A-D are side views of discrete stages of a bridge construction process, illustrating the use of a support truss to support and cantilever the bridge modules into position.
Figure 21B:
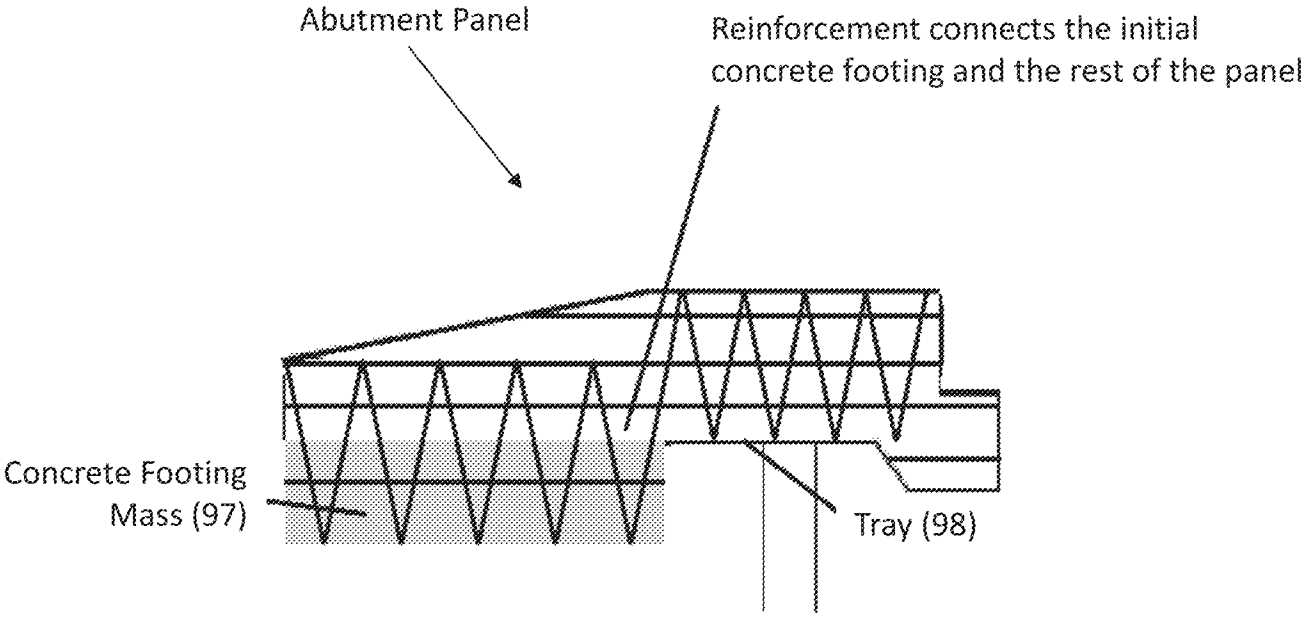
Figure 21C:
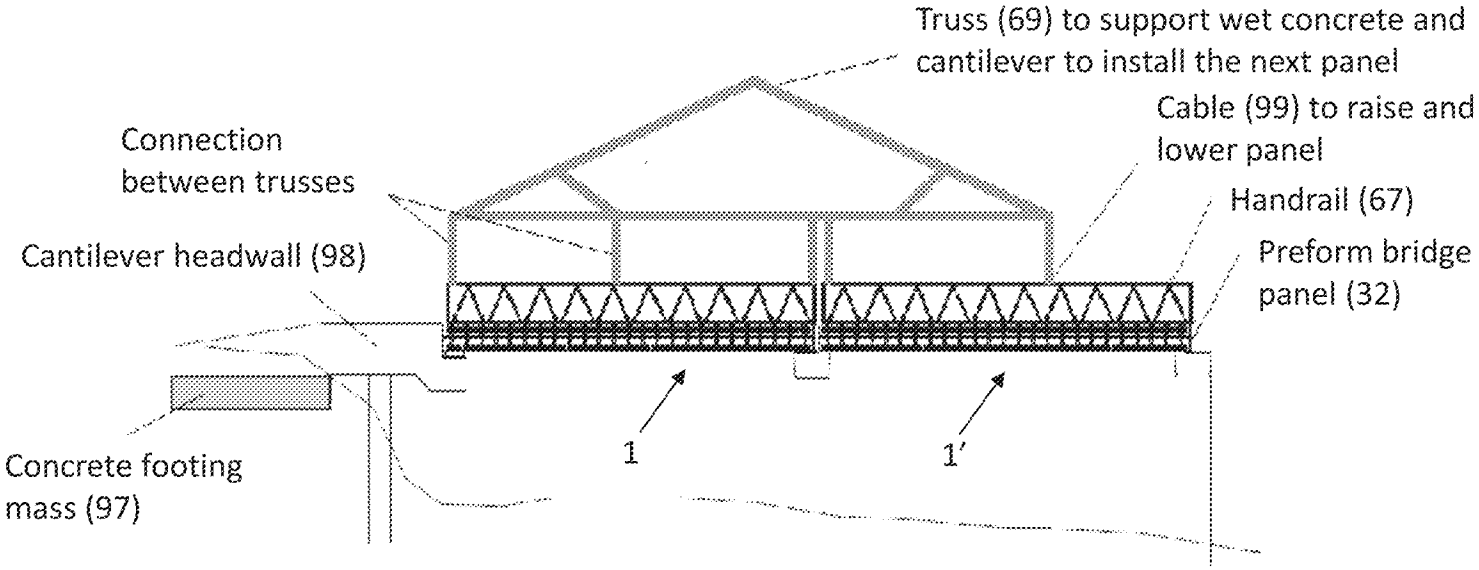
Figure 21D:
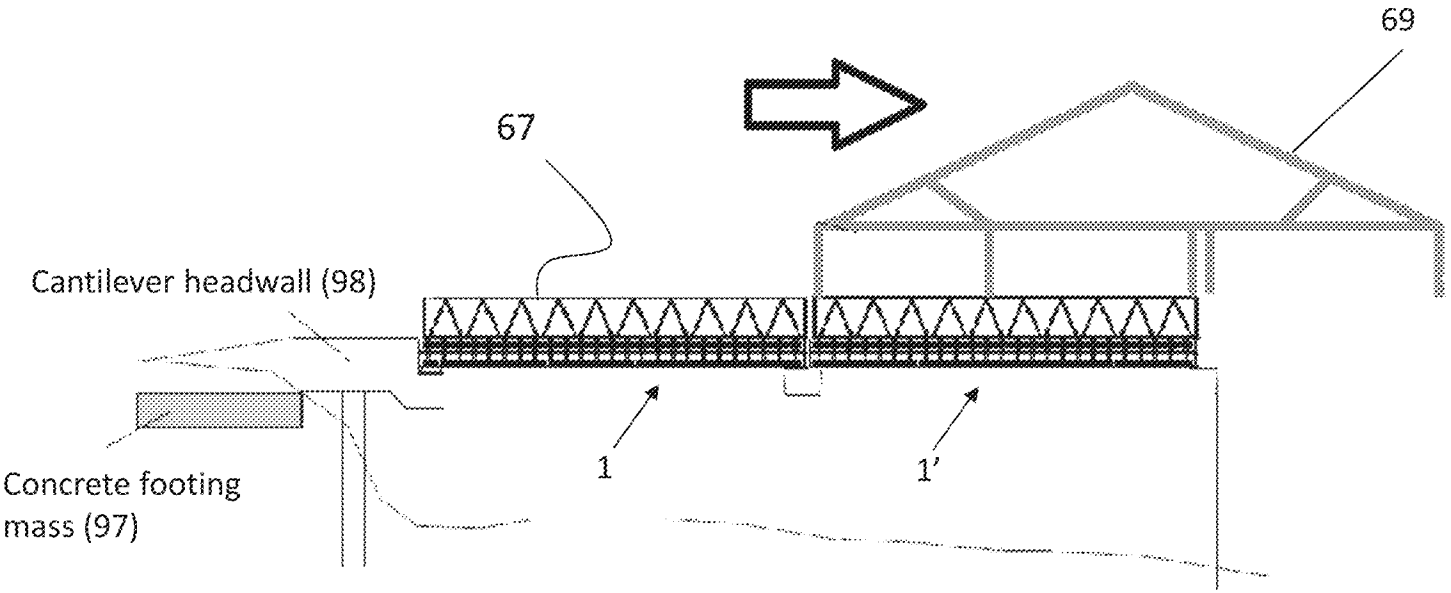

One embodiment of a reinforced modular bridge in accordance with the invention, comprises a plurality of modules 1, each module 1 engaged with a subsequent module 1' in overlapping arrangement, such that each module 1 spans a portion of the width of the bridge, wherein each of the plurality of modules 1 is configured to support a reinforcement member 20 therein for receiving a settable material, illustrated in FIGS. 20 and 20A.

Bridge 100 comprises a plurality of modules 1. A first end of each of the modules 1 is supported by a rigid foundation 97 at an end of the bridge 100. The opposing ends of each module 1 are supported by piers 22 and placed adjacent a subsequent plurality of modules 1' to continue extending the bridge 100.

The bridge 100 span can be supported in the centre (or where required), in order to reduce the size of the required reinforcement 20.

The formwork member 10 can be filled with concrete 7 in stages. For example the reinforcement 20 can be inserted into the formwork member 10 and the concrete 7 poured into the cavities 3 only i.e. up to but not including the upper portion 11 adjacent to the deck 32. In this manner the reinforcement 20 can be secured in position without loading the module 1 to full weight, while not yet in the final installation position. This further allows the deck 32 to be poured when the subsequent modules 1, 1' are in side-by-side position, to allow the top surface of the bridge 100 to be poured in one pour and set across the plurality of modules 1.

The bridge 100 can be designed to satisfy the requirements for T44 (44 Tonnes) and B-double (62.5 Tonnes) loadings for a 12 meter span (from Austroads—Bridge Design Code 1992), and SM1600 for a 10 meter span (from AS5100). These requirements are drawn from specific load cases as set out in the Australian Bridge Design Standard AS 5100.

There are various ways to support the modules 1 while constructing a bridge 100, for example:

(i) using a crane to support the weight of the module 1;

(ii) installing a temporary support truss 69 supported by the reinforcement 20 at each end of the span, which can be connected at intervals along the module 1 to support the bridge 100;

(iii) situating a pillar or pier 22 mid-span of the bridge 100 and connecting a high-tensile cable (not illustrated), which is placed in tension by the weight of the unset concrete. Once the concrete 7 has set the high-tensile cable is fixed in place with a wedging and restraining member used to create a post-tensioning method of increasing the strength of the finished concrete module 1. This method also places the concrete 7 within the module 1 in compression; and (iv) incorporating the rail 67 as a permanent reinforcing member, and directly connecting it to the pre-form bridge support truss 69. The total depth of the rail 67 creates high levels of support strength.

When developing a pre-formed bridge 100 it is important to support unset concrete 7.

Externally supporting the bridge 100 allows a reduction in the required internal reinforcement 20 of the modules 1 and a reduction in material of the formwork members 10. This facilitates further mass savings and cost reductions in each module 1. One such external support supports the bridge 100 from above, by a temporary or permanent support truss 69, crane, etc. Having such a supporting mechanism reduces the need for support below the bridge, as well as a possible reduction in the amount of reinforcement 20 needed to support each module 1, and the wet concrete 7 therein.

In reference to FIGS. 21A-21D a bridge 100 construction method is described, where the installation of the modules 1 involves use of a movable support truss 69. First, an abutment panel 98 is installed at the bridge location and positioned above the ground level. The abutment panel or tray 98 comprises a perimeter barrier 19 without a base 12 such that concrete 7 can be filled down to the ground level but the concrete is retained by the tray 98. A reinforcement bar is placed between these two sections, so that concrete 7 can be poured first into the footing, which is connected to the remainder of the module 1. When the concrete 7 hardens, the solid mass helps to anchor and support the rest of the partially-cantilevered module 1 when it contains unset concrete 7. Secondly, the bridge deck panels 32 are placed using the supporting truss 69. The modules 1 can then be slid into position on rails 67, and the truss 69 connected to an anchoring structure on one end of the module 1 while the opposing end of the module 1 is supported by cables 99. The module 1 is then lowered down onto the bridge piers 22, filled with concrete 7, and the truss 69 is moved to a subsequent module 1', where the entire process is repeated.

The support truss 69 can further incorporate a covering (not illustrated) to protect the curing concrete 7 and workers from rain and other environmental factors.

Single Span Bridge Construction

Figure 35A:
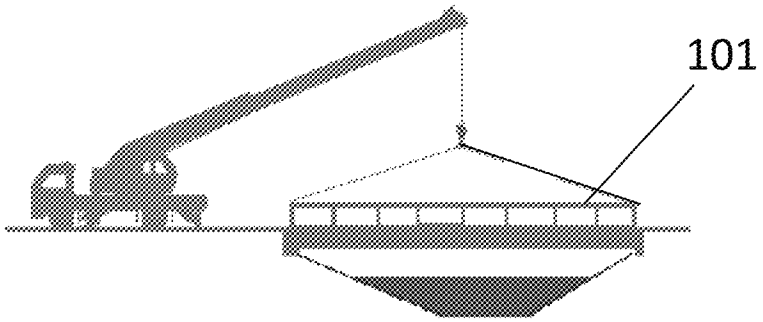
FIGS. 35 and 35A-35C are illustrations of the four stages of a bridge construction process using the construction module described herein: (i) lay the abutments and position the formwork housing the reinforcement, (ii) attach a predetermined side form, (iii) introduce concrete or cement to the formwork, and (iv) allow the concrete to cure.
Figure 35:
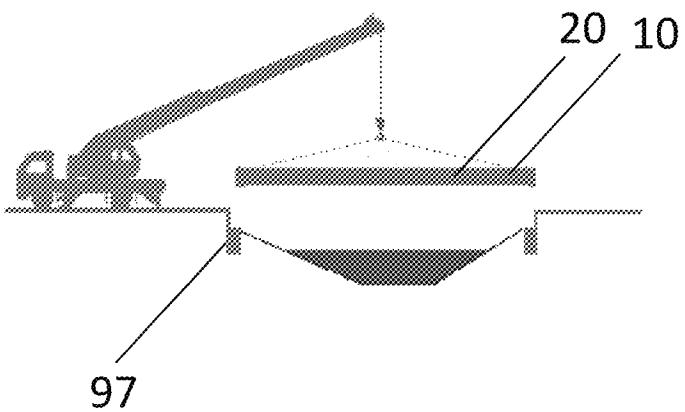
Figure 35C:
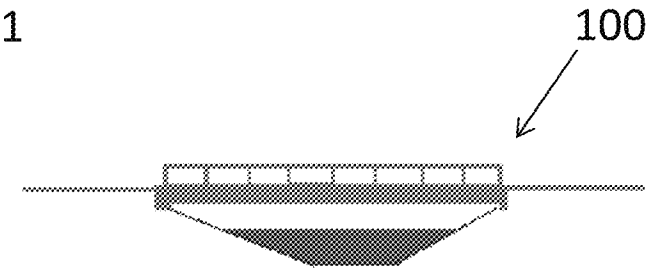
Figure 35B:
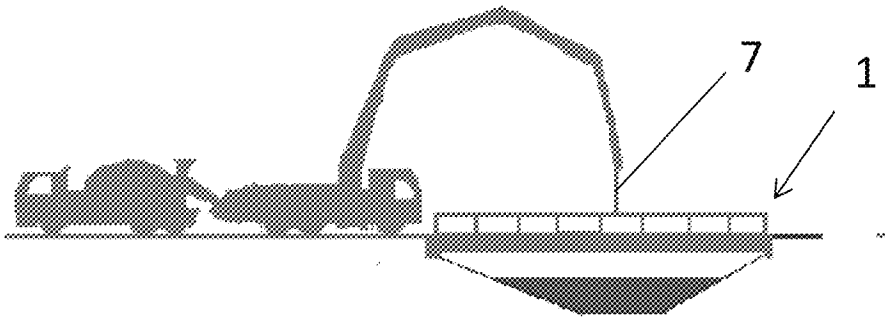

A self-supporting single span bridge 100 can be quickly and easily constructed. This process is illustrated in FIGS. 35-35C. The location for the bridge 100 is established and foundations or abutments 98 are placed in location on either end of the span.

In some embodiments bearings can be used in one or both of the abutments on which the module 1 will rest. However, these bearings can become exposed and result in areas of maintenance and cost over the life of the bridge 100. As the concrete is to be incorporated into the formwork 10 after it is located, the abutment and bearing cavity can be filled with concrete when the module 1 is formed. In this manner one of both of the bearings of the bridge 100 can be located under the module 1 and then concrete filled. This reduces exposure of the bearing over the life of the bridge 100. In some embodiments it is possible to delete one of the bearings altogether, thereby further reducing construction and maintenance costs for the bridge 100.

The deck 32 can be continuously poured into the abutment 98, giving a very firm connection to the ground, which enables more effective resistance of braking inertia.

Once in position any capping features can be added to the formwork 10 and reinforcement 20 to form a barrier 101.

The concrete 7 is then added to the formwork 10 to smother the reinforcement 20 and fully encase the reinforcement within the concrete 7. As the concrete 7 cures the reinforcement 20 and formwork 10 become integrated with the concrete to form the finished module 1 (see FIG. 35C).

Figure 36B:
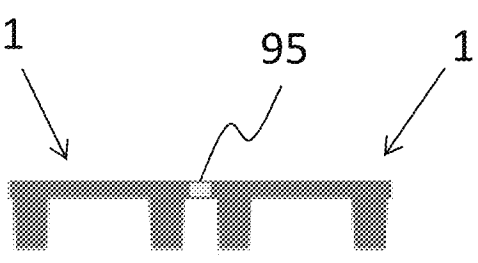
FIG. 36B is the pair of modules of FIG. 36A having an extension panel mounted therebetween.
Figure 36A:
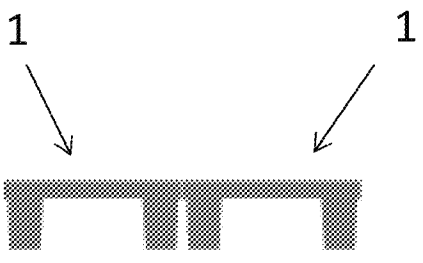
FIG. 36A is a pair of modules of FIG. 35 arranged in side-by-side layout.
Figure 36:
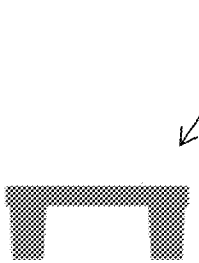
FIG. 36 is a schematic end view of an embodiment of a module.

The single span bridge 100 can be constructed with multiple modules 1 in side-by-side arrangement to increase the width of the bridge 100. FIGS. 36, 36A and 36B illustrate some examples. FIG. 36B further incorporates an extension panel 95. The extension panel 95 is a form of infill panels that allows the deck 32 to be increased to meet the width requirements for the bridge 100. This allows further dimensional flexibility to the overall dimensions of the module 1.

The bridge 100 has high earthquake resistance, as the deck 32 is a single concrete mass, and includes a structurally connected steel reinforcement 20.

The bridge 100 requires less inspection that a precast bridge as the deck 32 is poured in a single mass. This eliminates connection points and joints that can be the starting point for structural damage.

The bridge 100 can be designed to satisfy engineering requirements for a 100 years plus lifespan. Installation can utilise local contractors, with minimal need to work under the bridge 100, thus improving safety of the construction process.

Cappings such as barriers and kerbs can be integrally incorporated into the module 1, with optional designs to suit application requirements. These can be installed prior to installation on-site to give an additional safety rail, and are connected in-situ to the deck.

Handrails can be sold separately depending on construction codes and site risk evaluation.

Abutment

Figures 42, 42A:
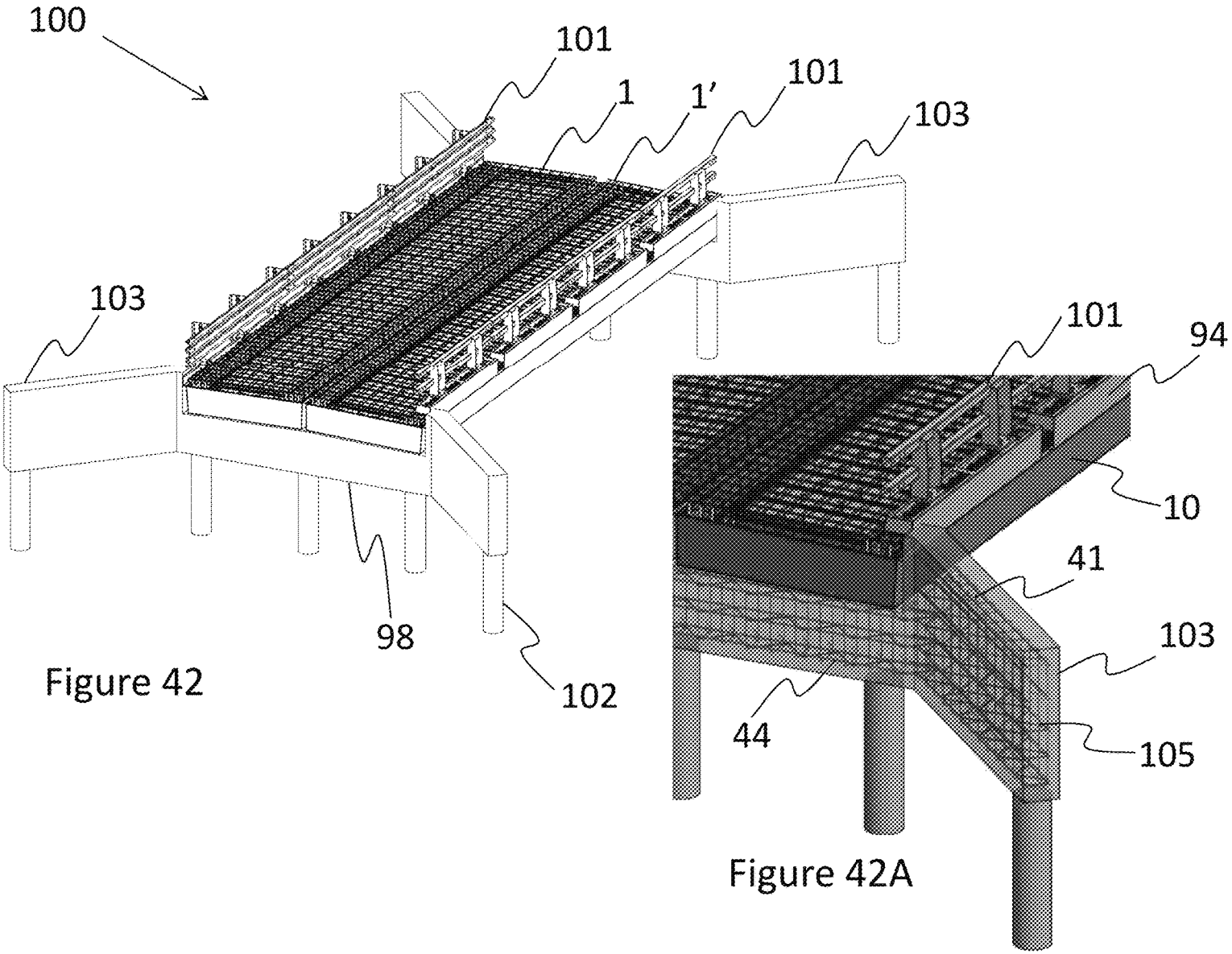
FIG. 42 is a perspective view of a bridge according to one embodiment of the invention, illustrating a winged abutment.
FIG. 42A is an enlarged view of a wing of the winged abutment, illustrating the internal reinforcement of the winged abutment.

The abutment 98 is configured to adapt to the location upon which the bridge 100 is to be constructed. In one embodiment, the abutment 98 is winged, as illustrated in FIGS. 42 and 42A. FIG. 42 illustrates a pair of modules 1, 1' arranged side-by-side. The modules 1, 1' are supported by the abutment 98 having wing walls 103 at opposing ends thereof. From a top view, this provides the bridge 100 with a substantially X-shaped footprint.

The abutment 98 and wing walls 103 can be formed in a single concrete pour. As illustrated in FIG. 42A, a series of reinforcing frames 41 are layered to construct the abutment reinforcement 105. The abutment reinforcement 105 is then encased in concrete to form the abutment 98 and integrated wing walls 103. The abutment and wing walls are located on a series of support pillars 102, to provide a support system for the modules 1, 1' at the predetermined height.

Figure 43:
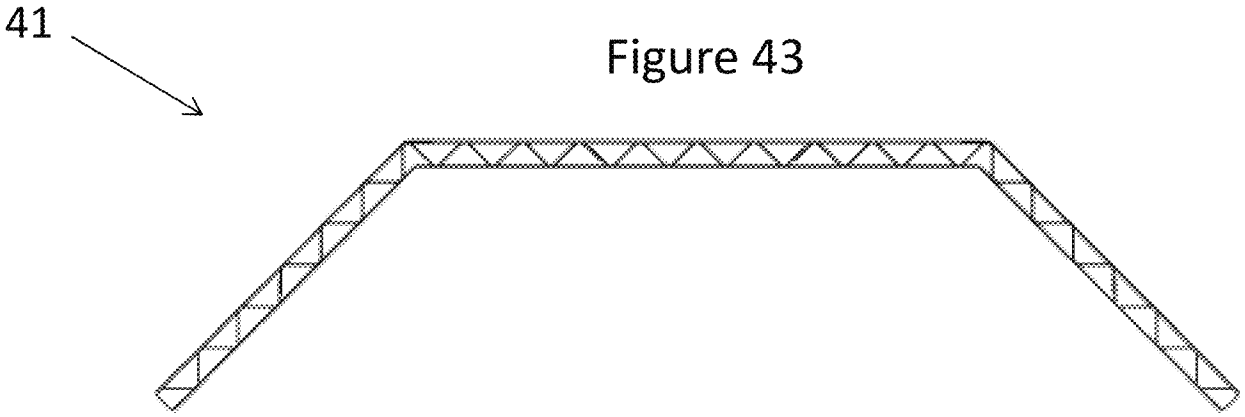
FIG. 43 is a top view of a reinforcement frame from within the winged abutment of FIG. 42.
Figure 43A:
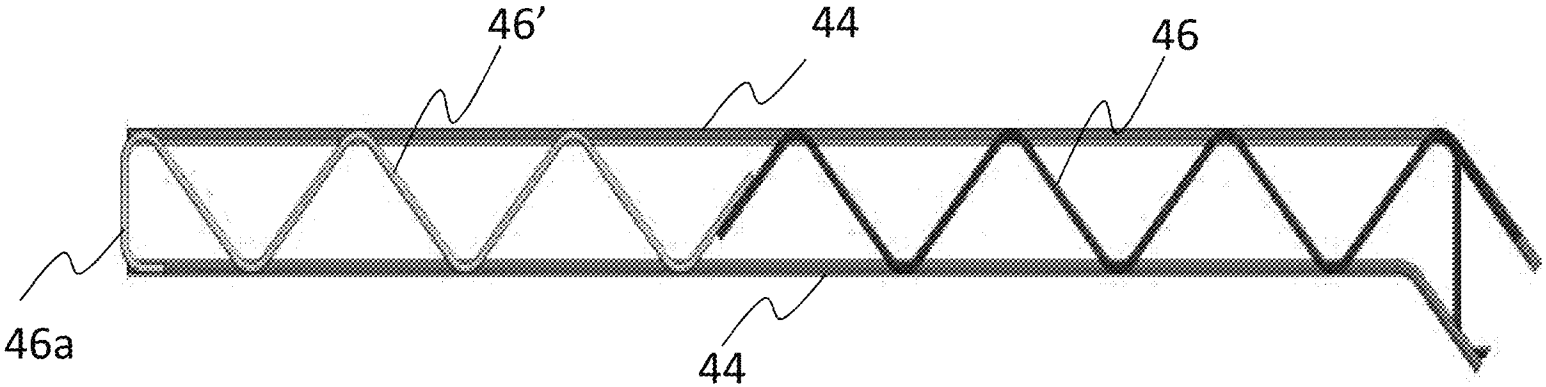
FIG. 43A is an enlarged top view of the reinforcement frame of FIG. 43.

FIGS. 43 and 43A illustrate a reinforcement frame 41 from the abutment reinforcement 105. The frame 41 is configured in a similar manner to the frames 41 of the reinforcement 20. However, the abutment 98 and wing walls 103 of FIG. 43 require an angled frame 41. FIG. 43A illustrates a pair of parallel longitudinal members 44 in an enlarged view of the frame 41 of FIG. 43. The pair of longitudinal members 44 are joined by a pair of intermediate members 46 and 46'. Both intermediate members zig-zag across the pair of longitudinal members 44 and are connected where in contact. The members 44, 46 and 46' can be welded or bonded to form a rigid connection therebetween. Intermediate member 46 is configured to provide reinforcement within the abutment 98 and within the wing wall 103, and as such travels through an angle to extend between the abutment and wing wall portions of the reinforcement 105. Intermediate member 46' is located at the end of the frame 41 and terminates in a curved end portion 46*a* that traverses the longitudinals 44 at right-angles and turns back upon itself. In this manner the end portions of longitudinals 44 are constrained to each other by the intermediate member 46'. The construction of members 44, 46, 46' will be similar materials and gauges as contemplated to those described herein in reference to the frame 41 of trusses 42.

Figure 44:
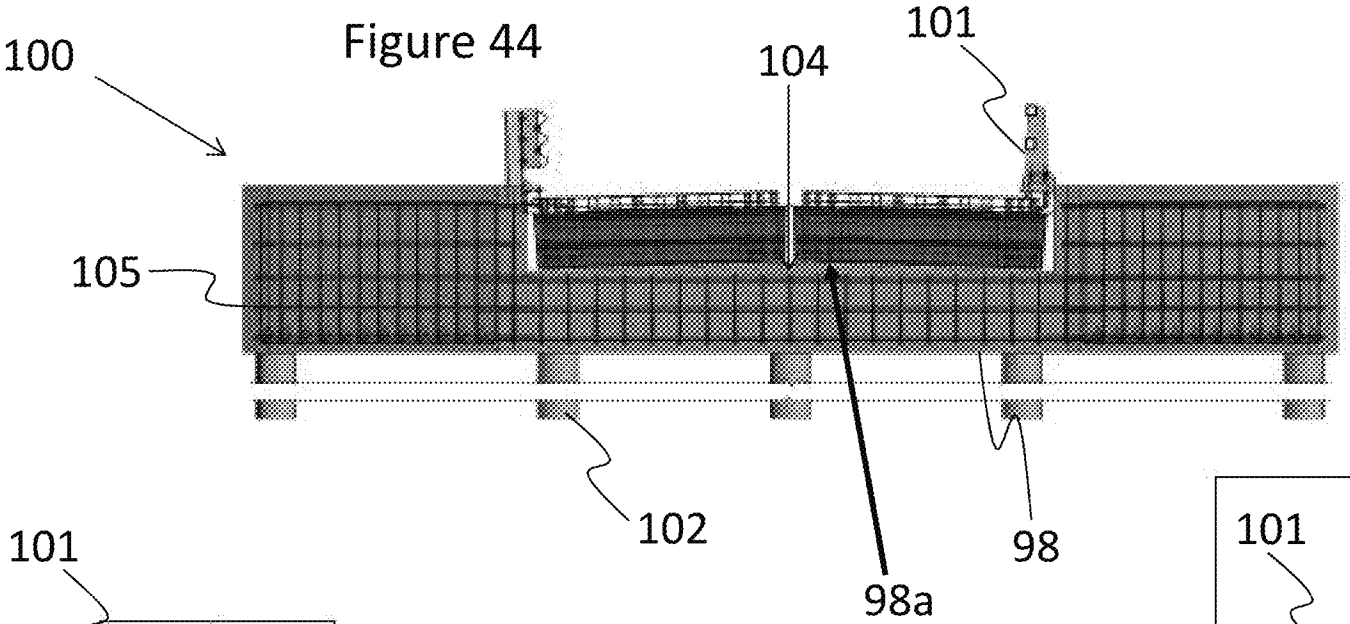
FIG. 44 is an end view of the bridge of FIG. 42, illustrating the gradient of the abutment to camber two adjacent modules to form a double span bridge.
Figure 44A:
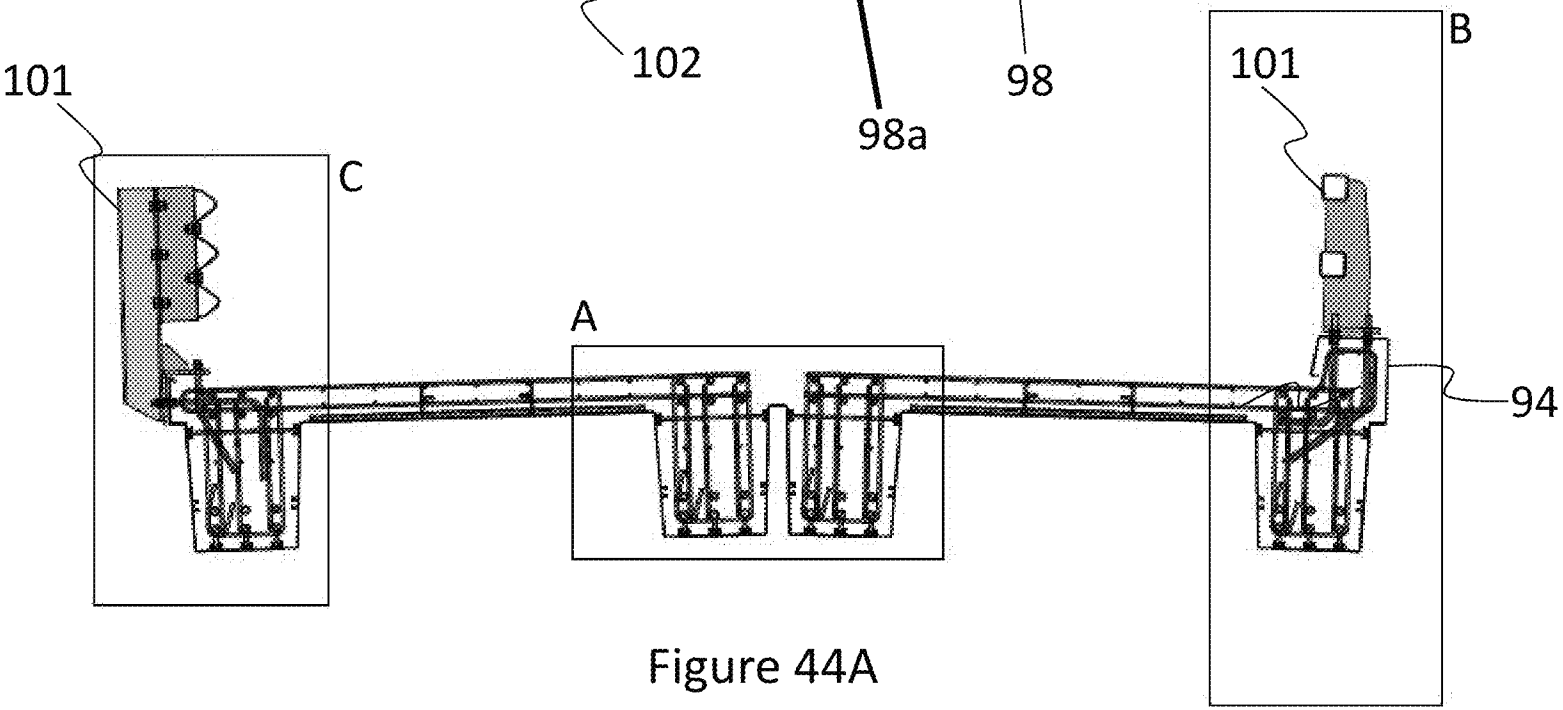
FIG. 44A is a cross sectional view of the bridge of FIG. 44

A central portion 104 of the abutment 98 is raised, to provide an angled surface 98*a* to the abutment 98. When the adjacent modules 1 and 1' are arranged in side-by-side layout on the abutment 98, the modules 1, 1' are slightly tilted to provide a camber to the bridge 100. The camber facilitates water runoff and overall drainage from the bridge 100 in use. The camber of the bridge 100 is more prominently seen in FIG. 44A, where the abutment 98 and wing wall 103 are not illustrated. FIG. 44A further illustrates two alternative barriers 101 in boxes B and C. The barriers 101 are inter-connected with the reinforcement 20 via a series of wall supports 90 and horizontal mounts 96 (as described herein).

Figure 45:
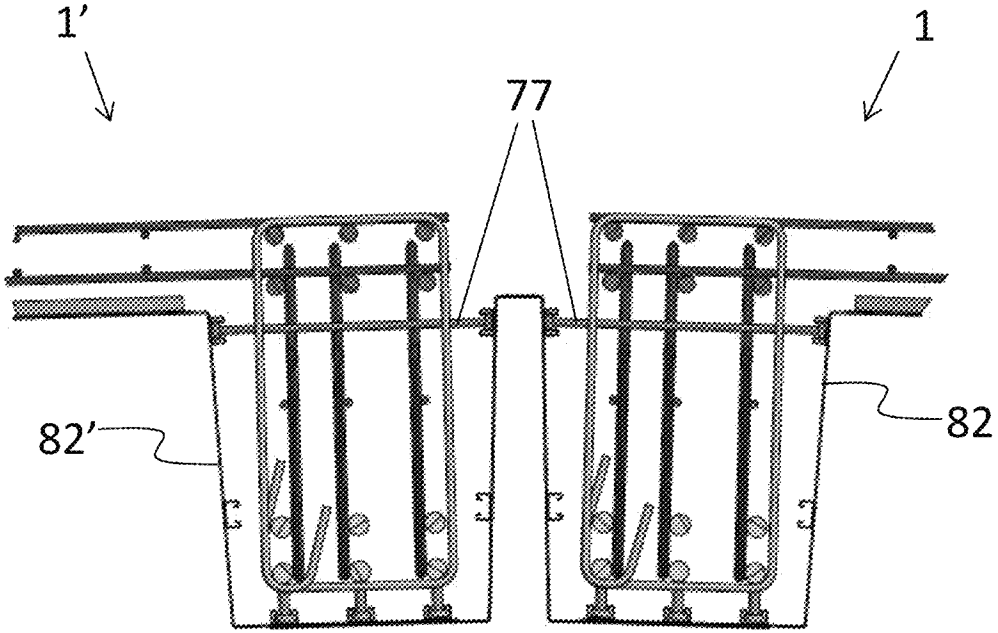
FIG. 45 is an enlarged view of Box A of FIG. 44A, illustrating the orientation of two adjacent modules.

Box A of FIG. 44A illustrates the camber angle between the two adjacent modules 1, 1'. This sectional view is enlarged in FIG. 45, a section taken through troughs 82, 82' of the two adjacent modules where the offset angle between the cross braces 77, 77' is emphasised. The desired camber angle is set when the abutment 98 and wing walls 103 are erected.

Figure 46:
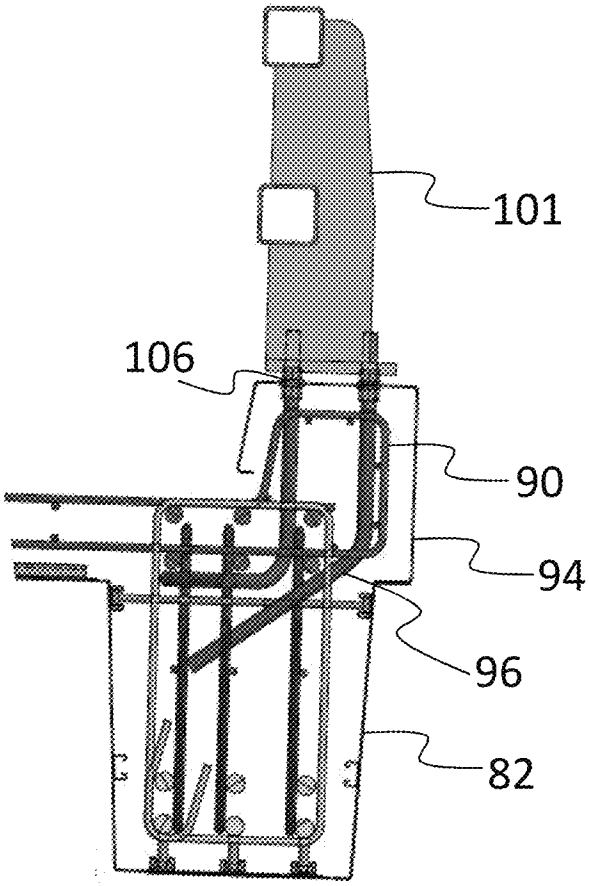
FIG. 46 is an enlarged view of Box B of FIG. 44A, illustrating the connection between the modules and an attached safety barrier.

FIG. 46 is an enlarged view of Box B of FIG. 44A and again illustrates the camber at the outermost portion of the module 1, in sectional view. The barrier 101 is a high speed safety barrier and is mounted to the horizontal mounts 96 of the capping. The mounts 96 extend out of the module 1 to meet connectors 106 of the barrier 101. The mounts 96 also extend downwardly into the module 1 to engage with the wall supports 90 within the capping 94, and the longitudinal members 44 of the truss 42.

High Rise

As described above, the structures of the invention include high rise buildings formed from the modules 1.

By way of example, a plurality of modules 1 can be stacked and arranged side-by-side, as illustrated in FIGS. 38, 38A, 29 and 40.

The concrete 7 is not added to the formwork 10 and reinforcement 20 until each layer of modules 1 is in place. The columns 4 are configured to be hollow and once in position, concrete 7 can be poured down into the aligned columns 4. This allows for a continuous pour of concrete 7 into each of the support columns to improve the structural integrity of the finished building 110.

The term "standard shipping container" is understood herein to refer to typical International Standards Organization (ISO) standard sized metal shipping containers, the dimensions of which are set out below in table 1.

TABLE 1

| | Exterior | | | Interior | | |
|---|---|---|---|---|---|---|
| | Length | Width | Height | Length | Width | Height |
| 10' Standard Dry Container | 10' | 8' | 8'6" | 9'3" | 7'8" | 7' 9⅞" |
| 20' Standard Dry Container | 20' | 8' | 8'6" | 19'3" | 7'8" | 7' 9⅞" |
| 40' Standard Dry Container | 40' | 8' | 8'6" | 39' 5" | 7'8" | 7' 9⅞" |
| 40' High Cube Dry Container | 40' | 8' | 9'6" | 39' 5" | 7'8" | 8' 10" |
| 45' High Cube Dry Container | 45' | 8' | 9'6" | 44' 5" | 7'8" | 8' 10" |

The bridge 100 is standardised, pre-engineered and pre-certified, and as such can be mass-produced off-site. It can then be transported globally within a shipping container, and stored in a depot for rapid deployment to maintain efficient construction timelines, and for emergencies. The product is designed to use locally available resources such as light-weight cranes and easily-available concrete (N40 strength). The bridge 100 further provides a multitude of structural and logistical advantages.

The bridge deck 32 has been engineered to meet the AS5100 standards, and is suitable for T44 and T62.5 B-double requirements for 12 meter spans, as well as the SM1600 requirements for a 10 meter span.

Manufacturing the standardised components of the bridge 100 in a factory facilitates mass-production using modular techniques, leading to high levels of quality control, reduced assembly costs, improved workplace safety, and the ability to pre-certify the engineered components.

The formwork 10 and reinforcement 20 are designed to be stacked and transported in the format of a shipping container if required, making transport and storage easier and more cost-effective.

As the stacked formwork 10 and reinforcement 20 do not contain concrete during transport, they are light and relatively easy to manipulate when compared to standard precast concrete panels. The combined weight of a formwork 10 and reinforcement 20 is 3400 kg. An equivalent precast concrete panel weighs 26000 kg. This weight saving simplifies the distribution and installation requirements, and the associated costs, as all the required moving machinery (side-loader container trucks, etc.) is more readily available for handling lighter loads. For example, the formwork 10 and reinforcement 20 for a two-lane, single span bridge 100 can be transported on a single truck.

The stacked formwork 10 and reinforcement 20 can be deployed on the day required and stored efficiently until the day of deployment.

Concrete for the bridge 100 is added in a single pour, creating one homogeneous slab and eliminating longitudinal joins across the length and/or the width of the bridge 100. This has major structural advantages and increases confidence in the bridge durability and lifespan. For example, it eliminates longitudinal joins, particularly undesirable 'dry joins' which occur when filling in the gaps between precast panels with wet concrete; and the single large mass of concrete can better resist braking inertia, which is particularly important for large freight trucks.

In this manner the bridge 100 construction maintains many of the benefits of precast construction with the additional advantages of off-site manufacturing, standardisation, quality control and time savings, while reducing the transportation and cost limitations inherent to the precast construction method. It also eliminates the possibility of fractural cracking of the concrete during transport, which is a serious risk for precast panels.

The modules 1 use pre-certified designs, reducing the need for on-site engineers. Additionally, the reduction in on-site skills required makes it easier to source the required labour locally. This bridge construction method is particularly attractive for remote areas, such as mines, where transporting precast slabs is not a viable or economical option, and there are limited skilled resources for in situ construction.

Standardisation reduces design replication, and provides a flexibility and versatility in applying the modules to a variety of different applications.

When compared to precast construction techniques, any additional costs incurred from on-site concrete placement/finishing can be offset by the cost savings from installation of the panels, as the system does not require heavy lifting assembly and infill or stitching concrete sections. This provides further advantages in that less long-term maintenance is required on the bridge.

As the bridge system is fully modular, it can be assembled in many different formats for various design requirements. It can be containerised for long-distance transport; different side attachments used for different barrier strengths and purposes; and depending on the width of the bridge, different numbers of panels and/or infill sections are used.

It will be appreciated by persons skilled in the art that numerous variations and modifications may be made to the above-described embodiments, without departing from the scope of the following claims. The present embodiments are, therefore, to be considered in all respects as illustrative and not restrictive.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

LEGEND

| Ref# | Description |
|---|---|
| 1 | Construction Module |
| 2 | Anchor |
| 3 | Cavity |
| 4 | Reinforcement column |
| 5 | Upper cavity |
| 6 | Engagement member |
| 7 | Concrete |
| 8 | Elongate beam |
| 9 | |
| 10 | Formwork Member |
| 11 | Upper portion |
| 12 | Lower portion |
| 13 | |
| 14 | Side wall |
| 15 | |
| 16 | End wall |
| 17 | Channels |
| 18 | Land portion |
| 19 | Perimeter barrier |
| 20 | Reinforcement |
| 21 | |
| 22 | Pier |
| 23 | |
| 24 | Frame supports |
| 25 | |
| 26 | Shoulders |
| 27 | |
| 28 | Arms |
| 29 | |
| 30 | Upper Reinf |
| 31 | |
| 32 | Deck |
| 33 | |
| 34 | Line-wire |
| 35 | Cross-wire |
| 39 | Mounts |
| 40 | Lower Reinf |
| 41 | Frames |
| 42 | Truss |
| 43 | End truss |
| 44 | Longitudinal member |
| 45 | Connection point |
| 46 | Intermediate member |
| 47 | base |
| 48 | End portion |
| 49 | End flange |
| 50 | Planar Spacer |
| 51 | |
| 52 | T-Shaped cradles |
| 53 | |
| 54 | U-shaped cradles |
| 55 | |
| 56 | Peripheral lip inner |
| 57 | Peripheral lip outer |
| 58 | |
| 59 | Lightening holes |
| 60 | Brace |
| 61 | |
| 62 | Flange |
| 63 | |
| 64 | |
| 65 | Connector |
| 66 | |
| 67 | Handrail |
| 68 | |
| 69 | Support Truss |

-continued

LEGEND

| Ref# | Description |
|---|---|
| 60 | Brace |
| 61 | |
| 62 | |
| 63 | |
| 64 | |
| 65 | |
| 70 | |
| 71 | |
| 72 | Member and hook |
| 72a | |
| 73 | Legs |
| 74 | Feet |
| 75 | Overlap bars |
| 76 | Ctrl brace beam |
| 77 | Cross-brace |
| 78 | Ligature |
| 79 | End ligature |
| 80 | Pan |
| 81 | |
| 82 | Trough |
| 83 | Top flange |
| 83a/83b | Inner/Outer |
| 84 | End cap |
| 85 | Mount flange |
| 86 | Stiffening plate |
| 87 | |
| 88 | Plate tie-down |
| 89 | Trough side wall |
| 90 | Wall Support |
| 91 | |
| 92 | Wall brace |
| 93 | Capping |
| 94 | Side shield |
| 95 | Extension panel |
| 96 | Horiz mounts |
| 97 | Foundation |
| 98 | Abutment panel |
| 99 | Cables |
| 100 | Bridge |
| 101 | Barriers |
| 102 | Support pillars |
| 103 | Wing walls |
| 104 | Central abutment |
| 105 | Abutment reinforcement |
| 106 | Barrier connector |
| 110 | Building |

The invention claimed is:

1. A module for a structure comprising:

a formwork tray comprising a base and a pair of side walls that extend upwardly therefrom, the base and sidewalls together defining a cavity for reinforcement and concrete, the cavity including an upper section and a lower section; and a reinforcement member located in the cavity and comprising an upper portion and a lower portion, the upper portion extending across a width and along a length of the upper section of the cavity, and the lower portion extending at least substantially along a length of the lower section of the cavity;

wherein a section of the base projects upwardly from adjacent sections thereof to define a land portion within the cavity that separates the lower section of the cavity into at least two spaced-apart elongate troughs; and wherein when concrete fills the cavity and at least partially covers the reinforcement member, the lower portion of the reinforcement member and the concrete together define at least one elongate beam, the land portion defining a volume of the formwork tray that does not receive concrete.

2. The module for a structure of claim 1, wherein the formwork tray comprises across a width thereof a plurality of interconnected discrete formwork sections.

3. The module for a structure of claim 2, wherein the plurality of discrete formwork sections include at least two U-shaped sections interconnected by a stiffening member.

4. The module for a structure of claim 1, wherein each of the elongate troughs span along an entire length of the module, such that the lower portion of the reinforcement member and the concrete together define at least two elongate beams.

5. The module for a structure of claim 1, wherein the formwork tray further comprises a pair of end walls forming with the side walls a perimeter about the base.

6. The module for a structure of claim 1, wherein the formwork tray provides a plurality of channels and the reinforcement member has a plurality of attachment members to engage with the plurality of channels to engage the formwork tray with the reinforcement member independently of the concrete introduced into the cavity.

7. The module for a structure of claim 1, wherein the lower portion of the reinforcement member and the upper portion of the reinforcement member are integrally formed.

8. The module for a structure of claim 1, wherein the reinforcement member is configured to conform to the cavity.

9. The module for a structure of claim 1, wherein the upper portion of the reinforcement member comprises a plurality of layers of mesh.

10. The module for a structure of claim 1, wherein the lower portion of the reinforcement member further includes an end portion, such that concrete fills the cavity, the lower portion of the reinforcement member and the concrete together define a cross-beam oriented perpendicularly of the or each of the elongate beams.

11. The module for a structure of claim 1, wherein the lower portion of the reinforcement member comprises a plurality of trusses.

12. The module for a structure of claim 11, wherein each truss includes a pair of parallel line wires being interconnected by a cross-wire, the cross-wire extending diagonally back and forth between the pair of parallel line wires.

13. The module for a structure of claim 11, wherein each truss further comprises a brace member.

14. The module for a structure of claim 13, wherein each brace member is retained in engagement with each truss by tension.

15. The module for a structure of claim 1, wherein the concrete at least partially fills the upper section of the cavity to cover the upper portion of the reinforcement member, such that the reinforcement member and the concrete together define an integrated, reinforced structure.

16. A reinforced concrete bridge comprising a module according to claim 1, wherein the module spans at least partially across a width of the bridge and extends at least partially along a length of the bridge.

* * * * *